US007390464B2

(12) United States Patent
Kido et al.

(10) Patent No.: US 7,390,464 B2
(45) Date of Patent: Jun. 24, 2008

(54) FLUIDIC CIRCUITS FOR SAMPLE PREPARATION INCLUDING BIO-DISCS AND METHODS RELATING THERETO

(75) Inventors: Horacio Kido, Niland, CA (US); James R. Norton, Santa Ana, CA (US); James H. Coombs, Nassim Park (SG)

(73) Assignees: Burstein Technologies, Inc., Irvine, CA (US); Nagaoka & Co., Ltd., Hyogo (JP)

( * ) Notice: Subject to any disclaimer, the term of this patent is extended or adjusted under 35 U.S.C. 154(b) by 0 days.

(21) Appl. No.: 10/899,388

(22) Filed: Jul. 26, 2004

(65) Prior Publication Data

US 2005/0084422 A1 Apr. 21, 2005

Related U.S. Application Data

(63) Continuation-in-part of application No. 10/871,203, filed on Jun. 18, 2004, now abandoned.

(60) Provisional application No. 60/489,978, filed on Jul. 25, 2003.

(51) Int. Cl.
*B01L 3/00* (2006.01)

(52) U.S. Cl. ..... 422/102; 422/100; 422/72; 436/45

(58) Field of Classification Search ..... 422/100, 422/72, 102; 435/288.5; 436/45
See application file for complete search history.

(56) References Cited

U.S. PATENT DOCUMENTS

| | | | |
|---|---|---|---|
| 3,901,658 | A | 8/1975 | Burtis et al. |
| 4,233,402 | A | 11/1980 | Maggio et al. |
| 4,284,602 | A | 8/1981 | Kelton et al. |
| 4,456,581 | A | 6/1984 | Edelmann et al. |
| 4,469,793 | A | 9/1984 | Guigan |
| 4,743,558 | A | 5/1988 | Guigan |
| 5,061,381 | A | 10/1991 | Burd |
| 5,122,284 | A | 6/1992 | Braynin et al. |
| 5,160,702 | A | 11/1992 | Kopf-Sill et al. |
| 5,173,193 | A | 12/1992 | Schembri |
| 5,173,262 | A | 12/1992 | Burtis et al. |
| 5,242,606 | A | 9/1993 | Braynin et al. |
| 5,310,523 | A | 5/1994 | Smethers et al. |
| 5,472,603 | A | 12/1995 | Schembri |
| 5,478,751 | A | 12/1995 | Oosta et al. |

(Continued)

FOREIGN PATENT DOCUMENTS

| | | |
|---|---|---|
| EP | 0 417 305 A1 | 3/1991 |

(Continued)

*Primary Examiner*—Jill Warden
*Assistant Examiner*—Natalia Levkovich
(74) *Attorney, Agent, or Firm*—Knobbe Martens Olson & Bear, LLP

(57) ABSTRACT

A fluidic circuit for receiving a fluid and separating a component of a fluid from the fluid comprises a separation chamber for receiving the fluid, an air chamber in fluid communication with the separation chamber, and a return channel in fluid communication with the separation chamber. In an advantageous embodiment, the fluidic circuit is subjected to a force, such as a centrifugal force, so that substantially all of the component of the fluid is moved to the return channel while substantially all remaining portions of the fluid are moved to the separation chamber.

8 Claims, 44 Drawing Sheets

U.S. PATENT DOCUMENTS 5,518,930 A 5/1996 Burd
5,585,069 A 12/1996 Zanzucchi et al.
5,591,643 A 1/1997 Schembri
5,593,838 A 1/1997 Zanzucchi et al.
5,627,041 A * 5/1997 Shartle ..... 435/7.24
5,755,942 A 5/1998 Zanzucchi et al.
5,843,767 A 12/1998 Beattie
5,858,804 A 1/1999 Zanzucchi et al.
5,863,708 A 1/1999 Zanzucchi et al.
5,892,577 A 4/1999 Gordon
5,932,799 A 8/1999 Moles
6,001,307 A 12/1999 Naka et al.
6,013,513 A 1/2000 Reber et al.
6,030,581 A 2/2000 Virtanen
6,063,589 A 5/2000 Kellogg et al.
6,117,630 A 9/2000 Reber et al.
6,143,248 A 11/2000 Kellogg et al.
6,261,519 B1 7/2001 Harding et al.
6,287,517 B1 9/2001 Ackley et al.
6,302,134 B1 10/2001 Kellogg et al.
6,327,031 B1 12/2001 Gordon
6,342,395 B1 1/2002 Hammock et al.
6,344,326 B1 * 2/2002 Nelson et al. ..... 435/6
6,387,331 B1 5/2002 Hunter
6,399,361 B2 6/2002 Brotherston et al.
6,476,907 B1 11/2002 Gordon
6,548,788 B2 * 4/2003 Kellogg et al. ..... 219/543
6,881,541 B2 * 4/2005 Petersen et al. ..... 435/6
6,919,058 B2 * 7/2005 Andersson et al. ..... 366/341
2001/0046453 A1 11/2001 Weigle et al.
2001/0055812 A1 12/2001 Mian et al.
2002/0076354 A1 6/2002 Cohen
2002/0106786 A1 * 8/2002 Carvalho et al. ..... 435/287.3
2002/0145960 A1 10/2002 Worthington et al.
2002/0163642 A1 11/2002 Zoval et al.
2002/0196435 A1 12/2002 Cohen et al.
2003/0223913 A1 12/2003 Karp et al.

FOREIGN PATENT DOCUMENTS

WO WO 95/33986 12/1995
WO WO 97/21090 6/1997
WO WO 98/38510 9/1998
WO WO 98/53311 11/1998
WO WO 00/26677 5/2000
WO WO 00/78455 A1 12/2000
WO WO 01/02737 A1 1/2001
WO WO 01/47638 A2 7/2001
WO WO 01/87485 A2 11/2001
WO WO 01/87487 A2 11/2001

* cited by examiner

FLUIDIC CIRCUITS FOR SAMPLE PREPARATION INCLUDING BIO-DISCS AND METHODS RELATING THERETO

This application is a continuation in part of U.S. patent application Ser. No. 10/871,203, filed on Jun. 18, 2004 now abandoned and claims priority under 35 U.S.C. §119(e) to U.S. Provisional Application Ser. No. 60/489,978, filed on Jul. 25, 2003, the disclosure of which is incorporated by reference herein in its entirety.

BACKGROUND OF THE INVENTION

1. Field of the Invention

This invention relates in general to optical discs, optical disc drives and optical disc interrogation methods and, in particular, to sample preparation in optical discs. More specifically, this invention relates to optical discs including fluidic circuits with rotationally controlled liquid valves.

2. Description of the Related Art

The Optical Bio-Disc, also referred to as Bio-Compact Disc (BCD), bio-optical disc, optical analysis disc or compact bio-disc, is known in the art for performing various types of bio-chemical analyses. In particular, an optical disc may utilize a laser source of an optical storage device to detect biochemical reactions on or near the operating surface of the disc itself. These reactions may be occurring in small channels inside the disc or may be reactions occurring on the open surface of the disc. Whatever the system, multiple reaction sites may be used to either simultaneously detect different reactions or to repeat the same reaction for error detection purposes.

SUMMARY OF CERTAIN EMBODIMENTS OF THE INVENTION

In one embodiment, the invention is directed to optical discs including fluidic circuits with rotationally controlled liquid valves which may be used independently or in combination with air chambers for pneumatic fluid displacement used for sample isolation, and to related disc drive systems and methods.

In an exemplary embodiment, the invention is directed to an optical analysis bio-disc. The disc may advantageously include a substrate having an inner perimeter and an outer perimeter; an operational layer associated with the substrate and including encoded information located along information tracks; and an analysis area including investigational features. In this embodiment, the analysis area is positioned between the inner perimeter and the outer perimeter and is directed along the information tracks so that when an incident beam of electromagnetic energy tracks along them, the investigational features within the analysis area are thereby interrogated circumferentially.

In another embodiment, the invention is directed to an optical analysis disc as defined above, wherein when an incident beam of electromagnetic energy tracks along the information tracks, the investigational features within the analysis area are thereby interrogated according to a spiral path or, in general, according to a path of varying angular coordinate.

In an advantageous embodiment, the substrate includes a series of substantially circular information tracks that increase in circumference as a function of radius extending from the inner perimeter to the outer perimeter, the analysis area is circumferentially elongated between a pre-selected number of circular information tracks and the investigational features are interrogated substantially along the circular information tracks between a pre-selected inner and outer circumference.

In one embodiment, the analysis area includes a fluid chamber. Preferably, rotation of the bio-disc distributes investigational features in a substantially consistent distribution along the analysis area and/or in a substantially even distribution along the analysis area.

The invention is further directed to an optical analysis bio-disc. In this embodiment, the bio-disc includes a substrate having an inner perimeter and an outer perimeter; and an analysis zone including investigational features, the analysis zone being positioned between the inner perimeter and the outer perimeter of the substrate and extending according to a varying angular coordinate, and preferably according to a substantially circumferential or spiral path.

Preferably, the analysis zone extends according to a varying angular and radial coordinate. In an alternative embodiment, the analysis zone extends according to a varying angular coordinate and at a substantially fixed radial coordinate.

In one embodiment, the disc comprises an operational layer associated with the substrate and including encoded information located substantially along information tracks.

According to another embodiment, the substrate includes a series of information tracks, preferably of a substantially circular profile and increasing in circumference as a function of radius extending from the inner perimeter to the outer perimeter, and the analysis zonedis directed substantially along the information tracks, so that when an incident beam of electromagnetic energy tracks along the information tracks, the investigational features within the analysis zone are thereby interrogated circumferentially. In one embodiment, the analysis zone is circumferentially elongated between a pre-selected number of circular information tracks, and the investigational features are interrogated substantially along the circular information tracks between a pre-selected inner and outer circumference.

In another embodiment, the analysis zone includes a plurality of reaction sites and/or a plurality of capture zones or target zones arranged according to a varying angular coordinate.

The optical analysis bio-disc may also include a plurality of analysis zones positioned between the inner perimeter and the outer perimeter of the substrate, at least one of which extends according to a varying angular coordinate.

Preferably, the analysis zones of the plurality extend according to a substantially circumferential path and are concentrically arranged around the bio-disc inner perimeter.

In a variant embodiment, the disc includes multiple tiers of analysis zones, wherein each analysis zone extends according to a substantially circumferential path and each tier is arranged onto the bio-disc at a respective radial coordinate.

In a further preferred embodiment, the analysis zone includes one or more fluid chambers extending according to a varying angular coordinate, which chamber(s) has a central portion extending according to a varying angular coordinate and two lateral arm portions extending according to a radial direction.

Preferably, the chamber central portion has an angular extension $\theta_a$ being in a ratio $\theta_a/\theta$ equal to or greater than 0.25 with the angle $\theta$ comprised between the chamber arm portions.

Furthermore, such embodiment may provide that the analysis zone includes at least a liquid-containing channel extending accordingly along a substantially circumferential path and the radius of curvature of the channel $r_c$ and the length of the column of liquid b contained within the channel are in a ratio $r_c/b$ equal to or greater than 0.5, and more preferably equal to or greater than 1.

Moreover, the optical analysis disc may include two inlet ports located at a lower radial coordinate of the bio-disc itself with respect to the analysis zone. Preferably, such ports are located each at one end of a respective lateral arm portion of the fluid chamber.

In a further preferred embodiment, the at least one fluid chamber is a fluid channel extending according to a varying angular coordinate.

In such embodiment, the disc may include multiple tiers of analysis fluid channels, eventually comprising different assays, blood types, concentrations of cultured cells and the like. A set of fluid channels can also be arranged at substantially the same radial coordinate. Furthermore, the fluid channels can have the same or different sizes.

The disc may be either a reflective-type or transmissive-type optical bio-disc. As in previous embodiments, preferably rotation of the bio-disc distributes investigational features in a substantially consistent and/or even distribution along the analysis zone.

According to another preferred embodiment, the optical analysis bio-disc may include a substrate having an inner perimeter and an outer perimeter; and an analysis zone including investigational features and positioned between the inner perimeter and the outer perimeter of the substrate. The analysis zone includes at least a liquid-containing channel having at least a portion which extends along a substantially circumferential path. The radius of curvature of the channel circumferential portion $r_c$ and the length of the column of liquid b contained within the channel are preferably in a ratio $r_c/b$ equal to or greater than 0.5. More Preferably, the ratio $r_c/b$ is equal to or greater than 1. Also in this embodiment, the disc can be either a reflective-type or a transmissive-type optical bio-disc.

The invention is also directed to an optical analysis bio-disc system for use with an optical analysis bio-disc as defined so far, which system includes interrogation devices of the investigational features adapted to interrogate the latter according to a varying angular coordinate.

Such interrogation devices may be such that when an incident beam of electromagnetic energy tracks along disc information tracks, any investigational features within the analysis zone are thereby interrogated circumferentially.

Preferably, the interrogation devices are adapted to interrogate the investigational features according to a varying angular coordinate at a substantially fixed radial coordinate or, alternatively, according to a varying angular and radial coordinate.

More preferably, the interrogation devices are employed to interrogate the investigational features according to a spiral or a substantially circumferential path.

According to a further preferred embodiment, the interrogation devices are utilized to interrogate investigational features at a plurality of reaction sites or capture or target zones arranged according to a varying angular coordinate.

The invention is also directed to a method for the interrogation of investigational features within an optical analysis bio-disc as defined so far. This method provides interrogation of the investigational features according to a varying angular coordinate, and preferably according to a spiral or a substantially circumferential path.

Such interrogation step may also be such that when an incident beam of electromagnetic energy tracks along disc information tracks, any investigational features within the analysis zone are thereby interrogated circumferentially.

Preferably, the interrogation step provides interrogation of the investigational features according to a varying angular coordinate at a substantially fixed radial coordinate or, alternatively, according to a varying angular and radial coordinate.

According to a further preferred embodiment, the interrogation step provides interrogation of investigational features at a plurality of similar or different, reaction sites, capture zones, or target zones arranged according to a varying angular coordinate.

This invention or different aspects thereof may be readily implemented in or adapted to many of the discs, assays, and systems disclosed in the prior art.

The above described methods and apparatus according to the invention as disclosed herein can have one or more advantages which include, but are not limited to, simple and quick on-disc processing without the necessity of an experienced technician to run the test, small sample volumes, use of inexpensive materials, and use of known optical disc formats and drive manufacturing. These and other features and advantages will be better understood by reference to the following detailed description when taken in conjunction with the accompanying drawing figures and technical examples.

BRIEF DESCRIPTION OF THE DRAWINGS

Further objects of the invention, together with additional features contributing thereto, and advantages accruing therefrom will be apparent from the following description of the certain embodiments of the invention which are shown in the accompanying drawing figures with like reference numerals indicating like components throughout, wherein:

FIGS. 36A, 36B, 36C, and 36D are each a top view of a fluidic circuit configured to be placed on a bio-disc, wherein FIGS. 36B, 36C, and 36D are illustrative of steps in an assay process;

FIGS. 38A, 38B, 38C, and 38D are each a top view of a fluidic circuit with an air chamber for pneumatic fluid displacement, wherein FIGS. 38B, 38C, and 38D are illustrative of steps in separating samples using the fluidic circuit; and FIGS. 39A, 39B, 39C, and 39D are each a top view of another embodiment of a fluid fluidic, wherein FIGS. 39B, 39C, and 39D are illustrative of steps for separating samples using the fluidic circuit.

DETAILED DESCRIPTION OF THE PREFERRED EMBODIMENT

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
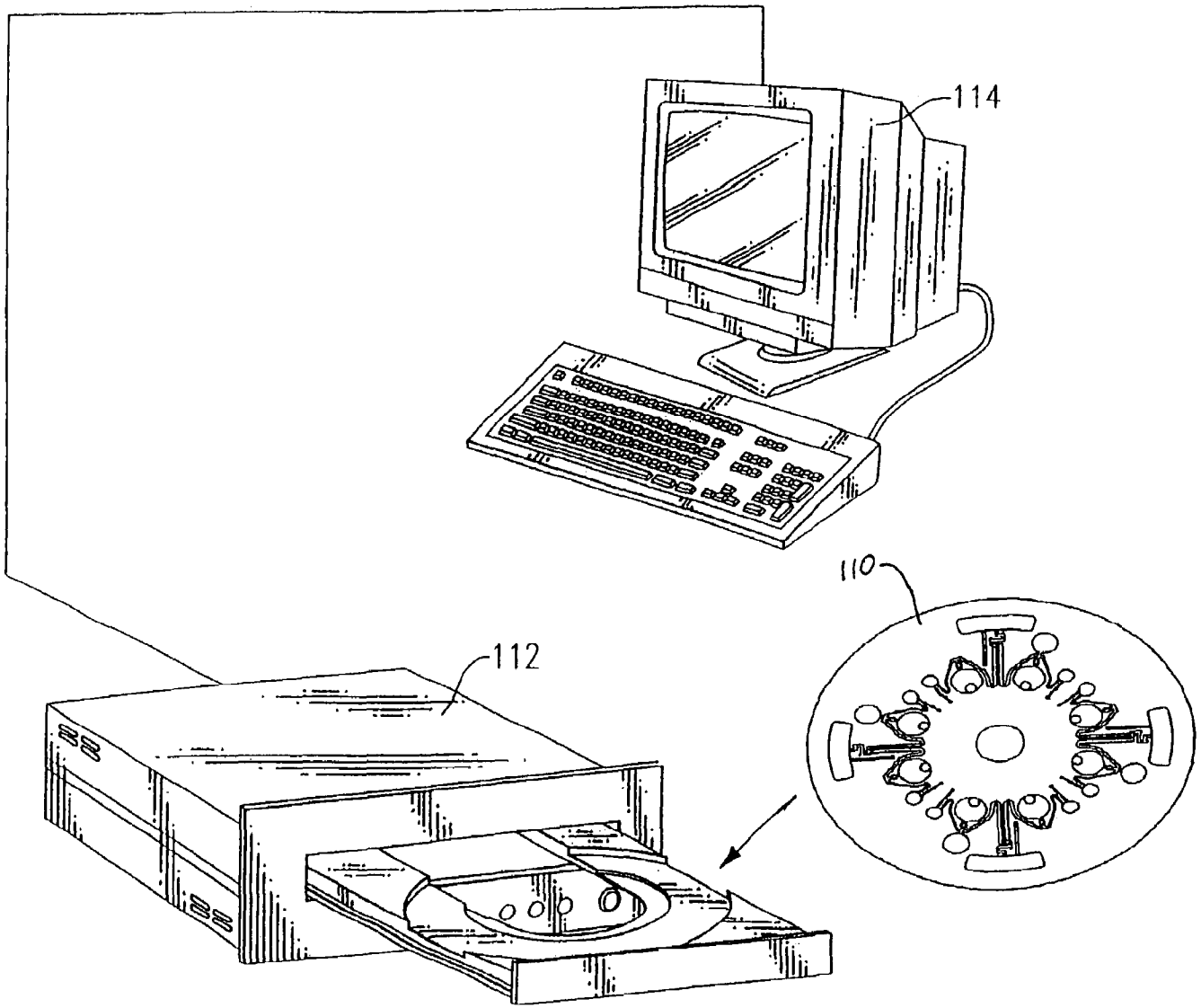
FIG. 1 is a pictorial representation of a bio-disc system.

FIG. 1 is a perspective view of an optical bio-disc 110 for conducting biochemical analyses, and in particular cell counts and differential cell counts. The present optical bio-disc 110 is shown in conjunction with an optical disc drive 112 and a display monitor 114.

Figure 2:
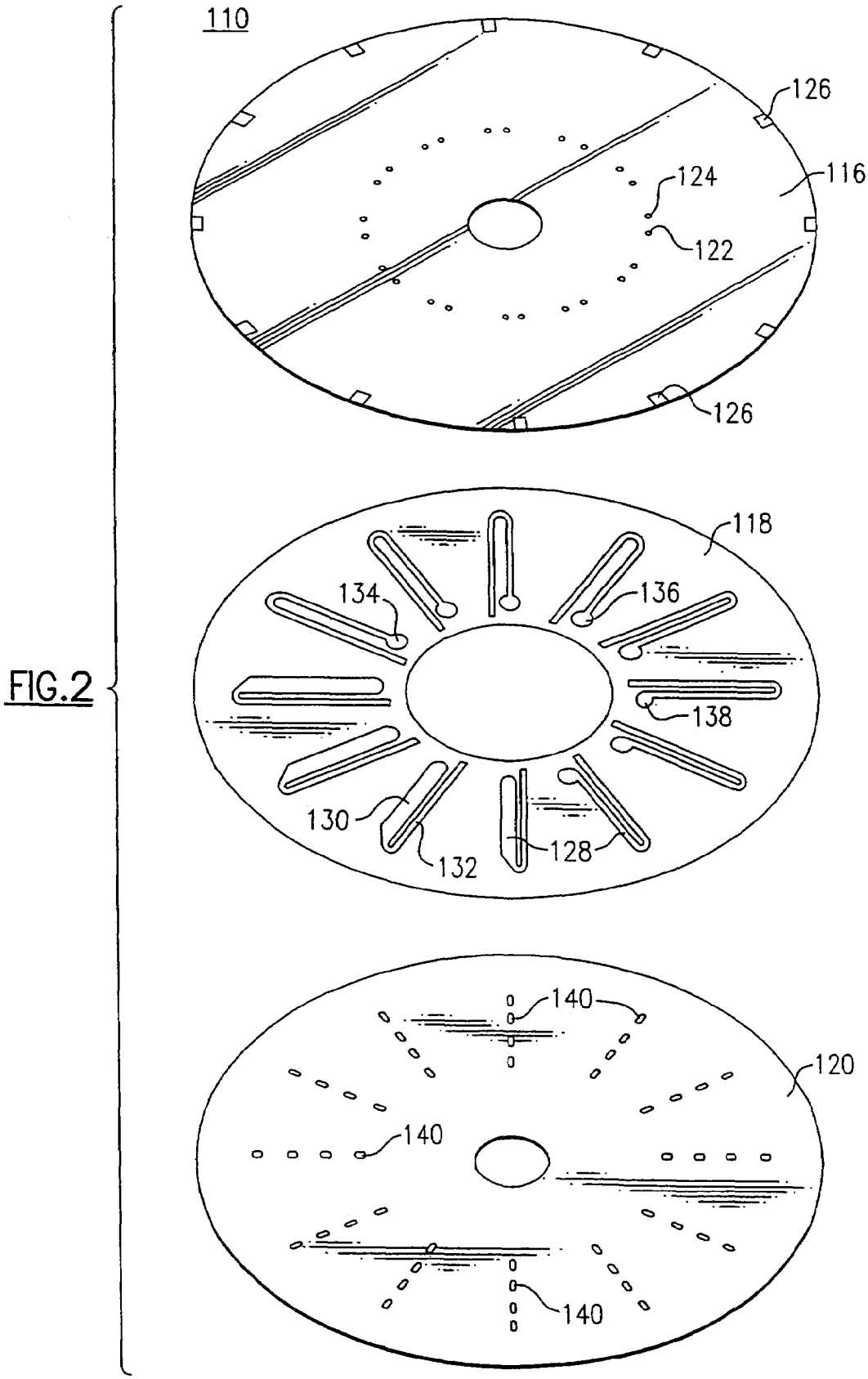
FIG. 2 is an exploded perspective view of a reflective bio-disc.
Figure 6:
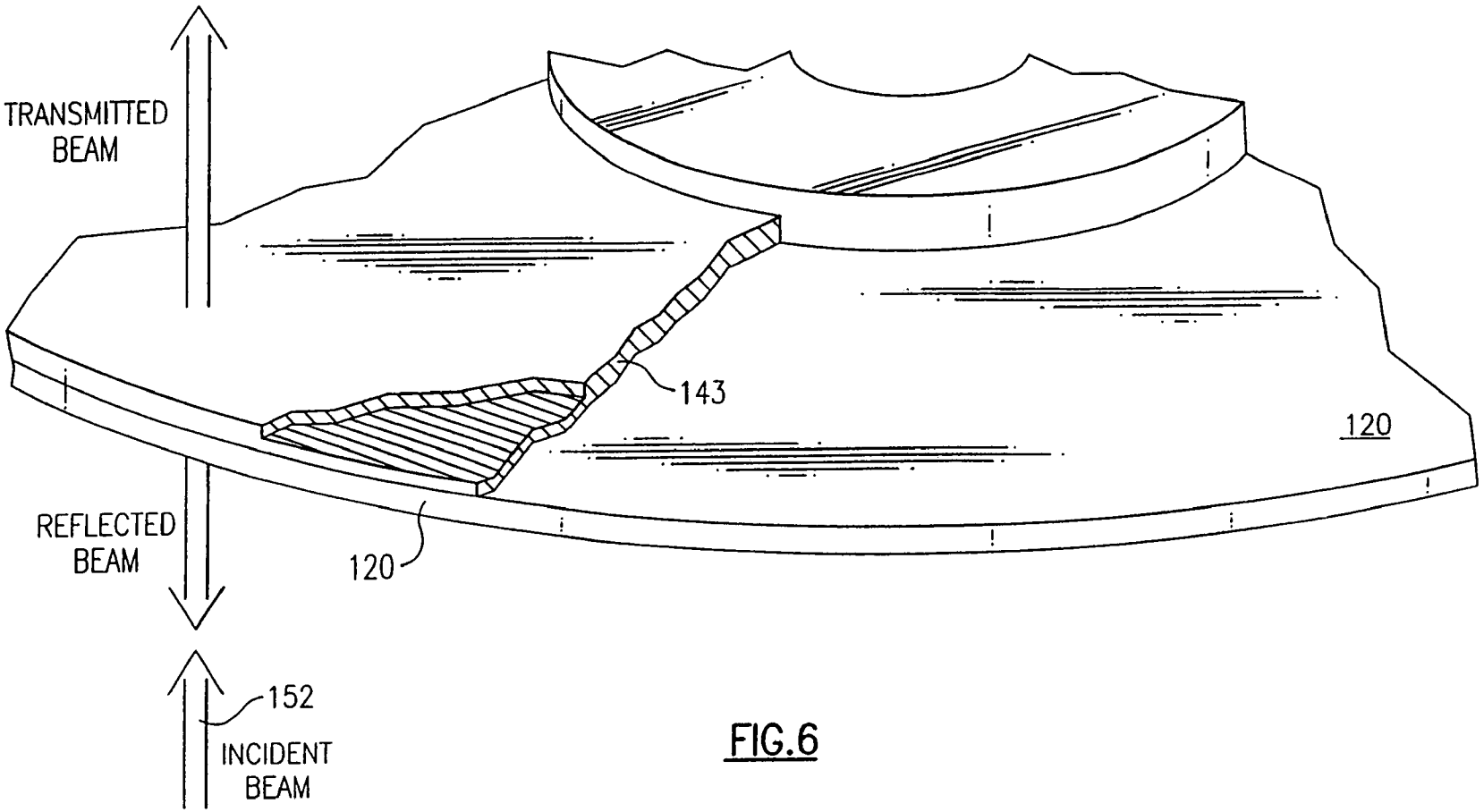
FIG. 6 is a perspective view representing the disc shown in FIG. 5 with a cut-away section illustrating the functional aspects of a semi-reflective layer of the disc.
Figure 10:
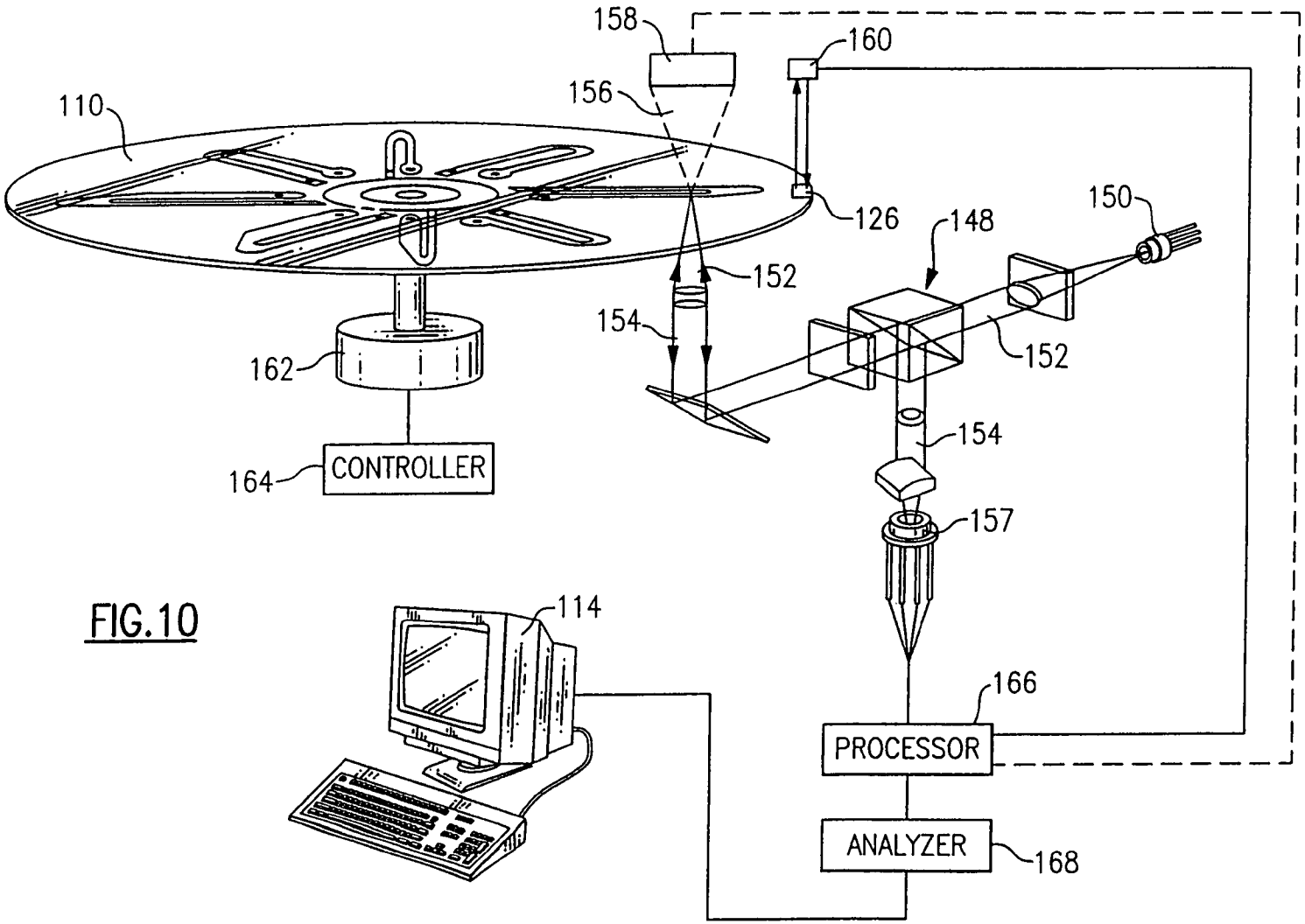
FIG. 10 is a perspective and block diagram representation illustrating the system of FIG. 1 in more detail.

FIG. 2 is an exploded perspective view of the principal structural elements of one embodiment of the optical bio-disc 110. FIG. 2 is an example of a reflective zone optical bio-disc 110 (hereinafter "reflective disc") that may be used in conjunction with the systems and methods described herein. The optical bio-disc 110 includes a cap portion 116, an adhesive member or channel layer 118, and a substrate 120. In the embodiment of FIG. 2, the cap portion 116 includes one or more inlet ports 122 and one or more vent ports 124. The cap portion 116 may be formed from polycarbonate and is preferably coated with a reflective surface 146 (shown in FIG. 4) on the bottom thereof as viewed from the perspective of FIG. 2. In one embodiment, trigger marks or markings 126 are included on the surface of a reflective layer 142 (shown in FIG. 4). Trigger markings 126 may include a clear window in all three layers of the bio-disc, an opaque area, or a reflective or semi-reflective area encoded with information that sends data to a processor 166, as shown FIG. 10, that in turn interacts with the operative functions of an interrogation or incident beam 152, as shown in FIGS. 6 and 10.

In the embodiment of FIG. 2, the adhesive member or channel layer 118 includes fluidic circuits 128 or U-channels formed therein. The fluidic circuits 128 may be formed by stamping or cutting the membrane to remove plastic film and form the shapes as indicated. Each of the fluidic circuits 128 includes a flow channel or analysis zone 130 and a return channel 132. Some of the fluidic circuits 128 illustrated in FIG. 2 include a mixing chamber 134. Two different types of mixing chambers 134 are illustrated. The first is a symmetric mixing chamber 136 that is symmetrically formed relative to the flow channel 130. The second is an off-set mixing chamber 138. The off-set mixing chamber 138 is formed to one side of the flow channel 130 as indicated.

In the embodiment of FIG. 2, the substrate 120 includes target or capture zones 140. In an advantageous embodiment, the substrate 120 is made of polycarbonate and has the aforementioned reflective layer 142 deposited on the top thereof (shown in FIG. 4). The target zones 140 may be formed by removing the reflective layer 142 in the indicated shape or alternatively in any desired shape. Alternatively, the target zone 140 may be formed by a masking technique that includes masking the target zone 140 area before applying the reflective layer 142. The reflective layer 142 may be formed from a metal such as aluminum or gold.

Figure 3:
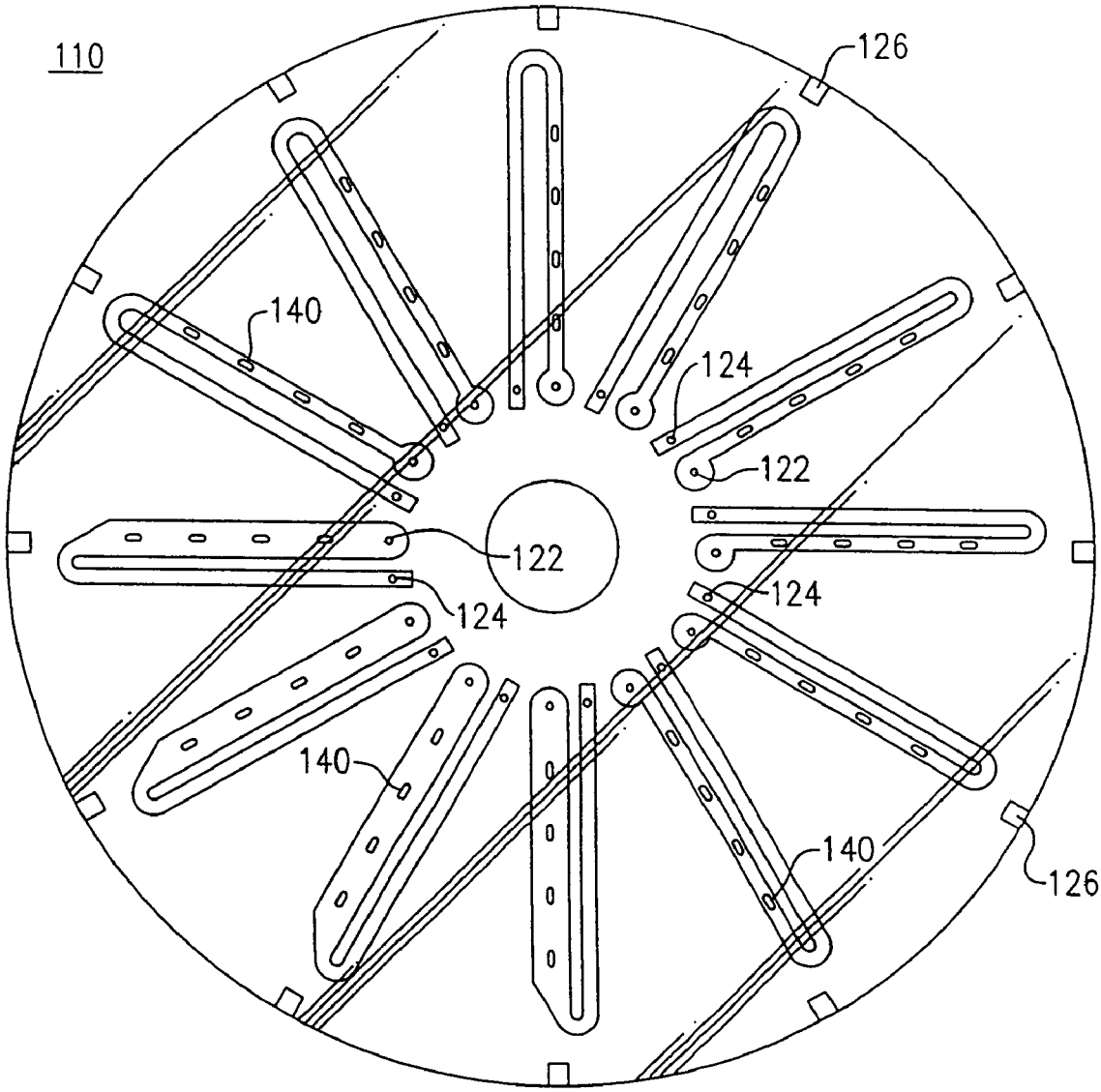
FIG. 3 is a top plan view of the disc shown in FIG. 2.

FIG. 3 is a top plan view of the optical bio-disc 110 illustrated in FIG. 2 with the reflective layer 146 on the cap portion 116 shown as transparent to reveal the fluidic circuits 128, the target zones 140, and trigger markings 126 situated within the disc.

Figure 4:
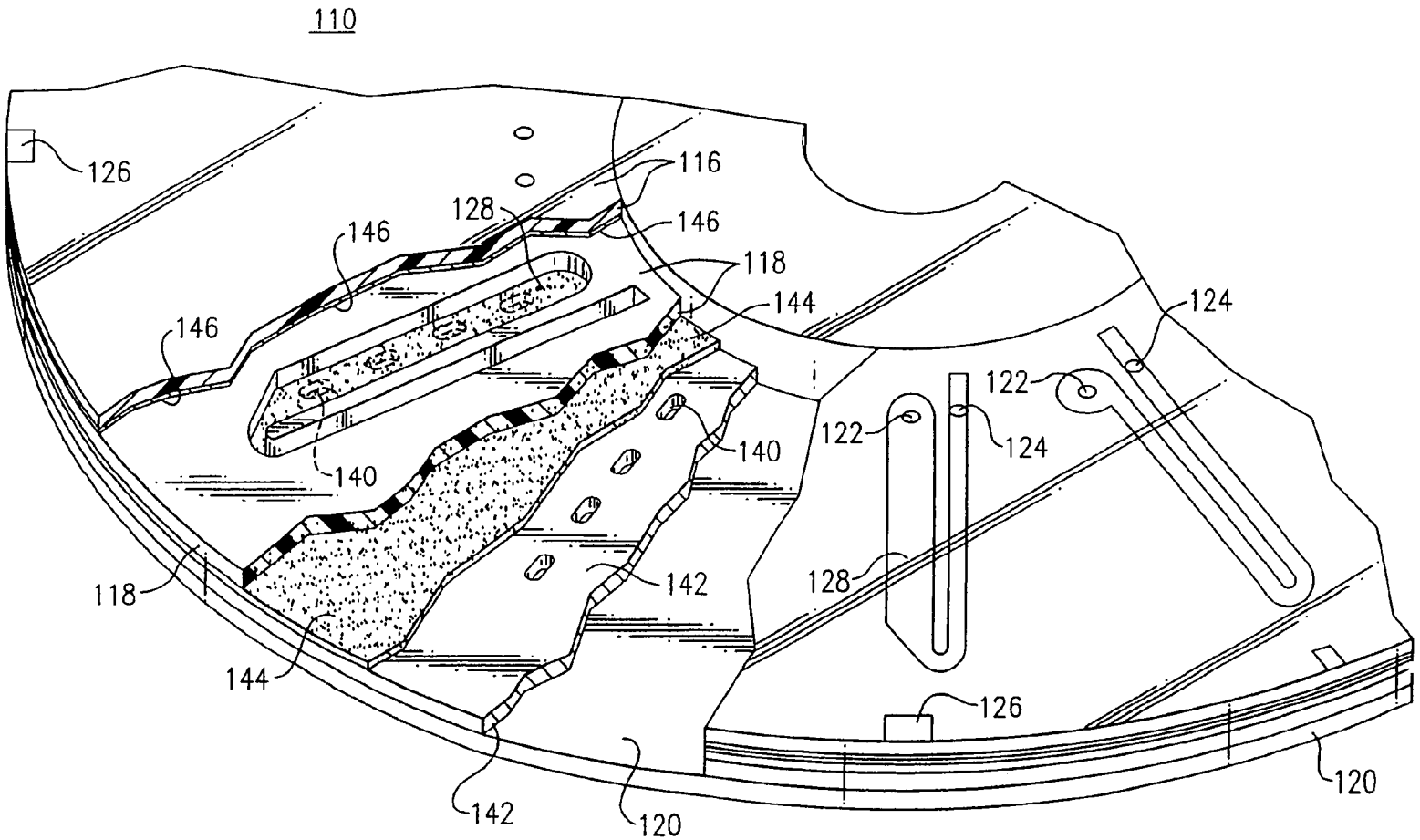
FIG. 4 is a perspective view of the disc illustrated in FIG. 2 with cut-away sections showing the different layers of the disc.

FIG. 4 is an enlarged perspective view of the reflective zone type optical bio-disc 110 according to one embodiment. FIG. 4 illustrates a portion of the various layers of the optical bio-disc 110 cut away to illustrate a partial sectional view of several layers. In particular, FIG. 4 illustrates the substrate 120 coated with the reflective layer 142. An active layer 144 is applied over the reflective layer 142. In an advantageous embodiment, the active layer 144 may be formed from polystyrene. Alternatively, polycarbonate, gold, activated glass, modified glass, or modified polystyrene, for example, polystyrene-co-maleic anhydride, may be used. In addition, hydrogels can be used. Alternatively, as illustrated in this embodiment, the plastic adhesive member 118 is applied over the active layer 144. The exposed section of the plastic adhesive member 118 illustrates the cut out or stamped U-shaped form that creates the fluidic circuits 128. The final principal structural layer in this reflective zone embodiment of the present bio-disc is the cap portion 116. In the embodiment of FIG. 4, the cap portion 116 includes the reflective surface 146 on the bottom thereof. The reflective surface 146 may be made from a metal such as aluminum or gold.

Figure 5:
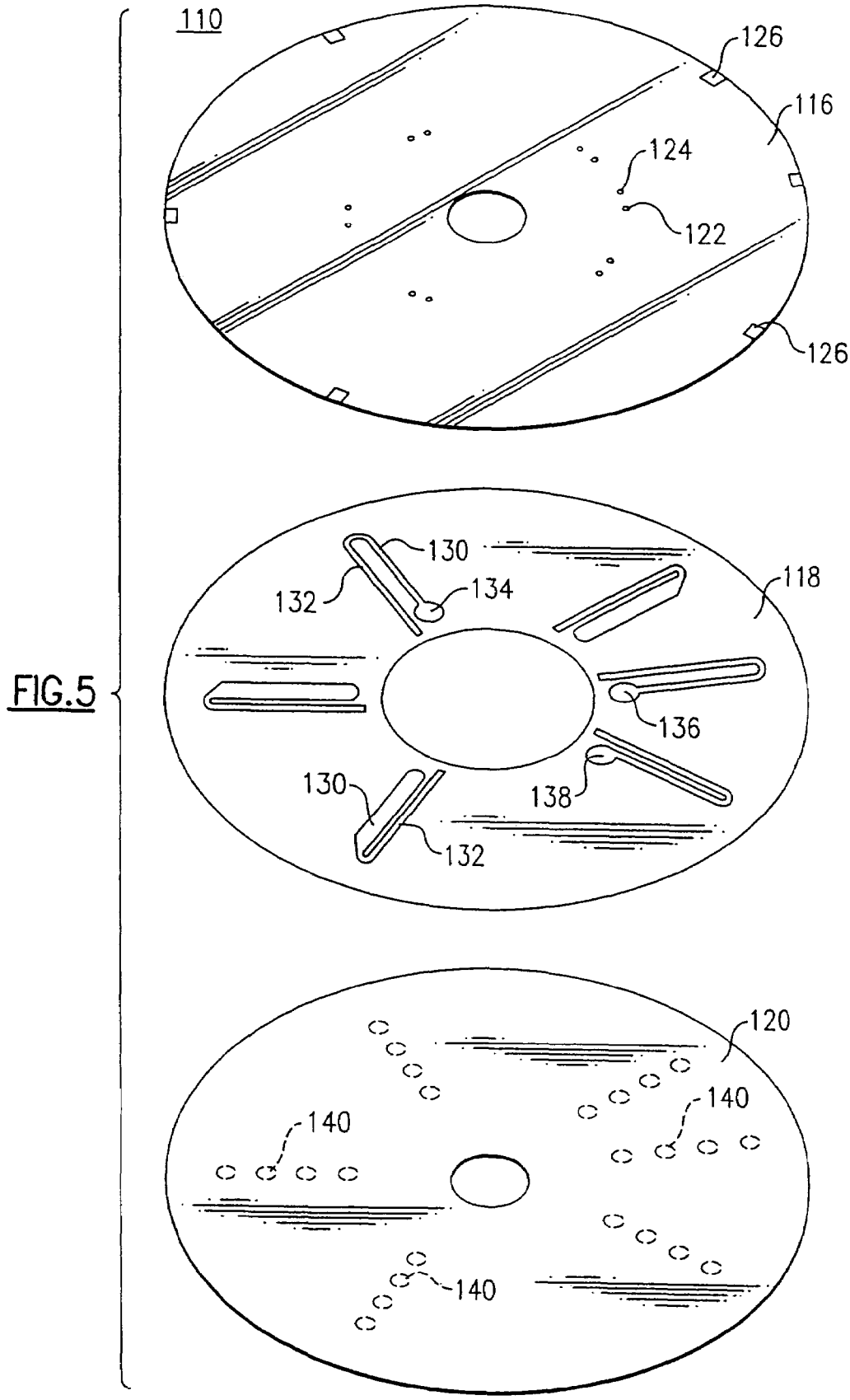
FIG. 5 is an exploded perspective view of a transmissive bio-disc.
Figure 9:
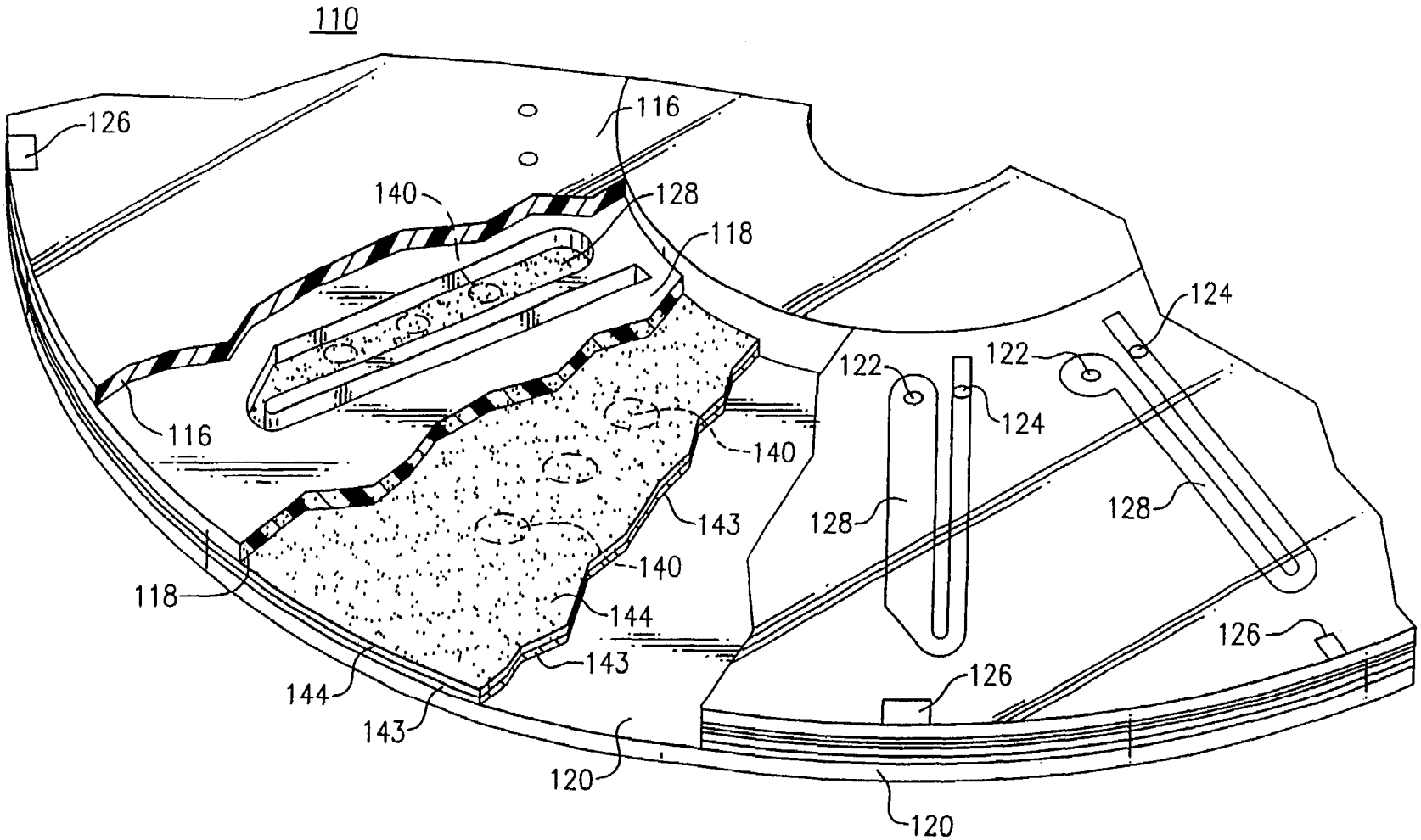
FIG. 9 is a perspective view of the disc illustrated in FIG. 5 with cut-away sections showing the different layers of the disc including the type of semi-reflective layer shown in FIG. 6.

FIG. 5 is an exploded perspective view of certain elements of a transmissive type optical bio-disc 110, including the cap portion 116, the adhesive or channel member 118, and the substrate 120 layer. In this embodiment, the cap portion 116 includes one or more inlet ports 122 and one or more vent ports 124. The cap portion 116 may be formed from a polycarbonate layer. Optional trigger markings 126 may be included on the surface of a thin semi-reflective layer 143, as illustrated in FIGS. 6 and 9. Trigger markings 126 may include a clear window in all three layers of the bio-disc, an opaque area, or a reflective or semi-reflective area encoded with information that sends data to a processor 166, FIG. 10, which in turn interacts with the operative functions of an interrogation beam 152, FIGS. 6 and 10.

The adhesive member or channel layer 118 is illustrated including fluidic circuits 128 or U-channels formed therein. The fluidic circuits 128 may be formed by stamping or cutting the membrane to remove plastic film and form the shapes as indicated. In the embodiment of FIG. 5, each of the fluidic circuits 128 includes the flow channel 130 and the return channel 132. Some of the fluidic circuits 128 illustrated in FIG. 5 include a mixing chamber 134, such as those described above with respect to FIG. 2.

Figure 12:
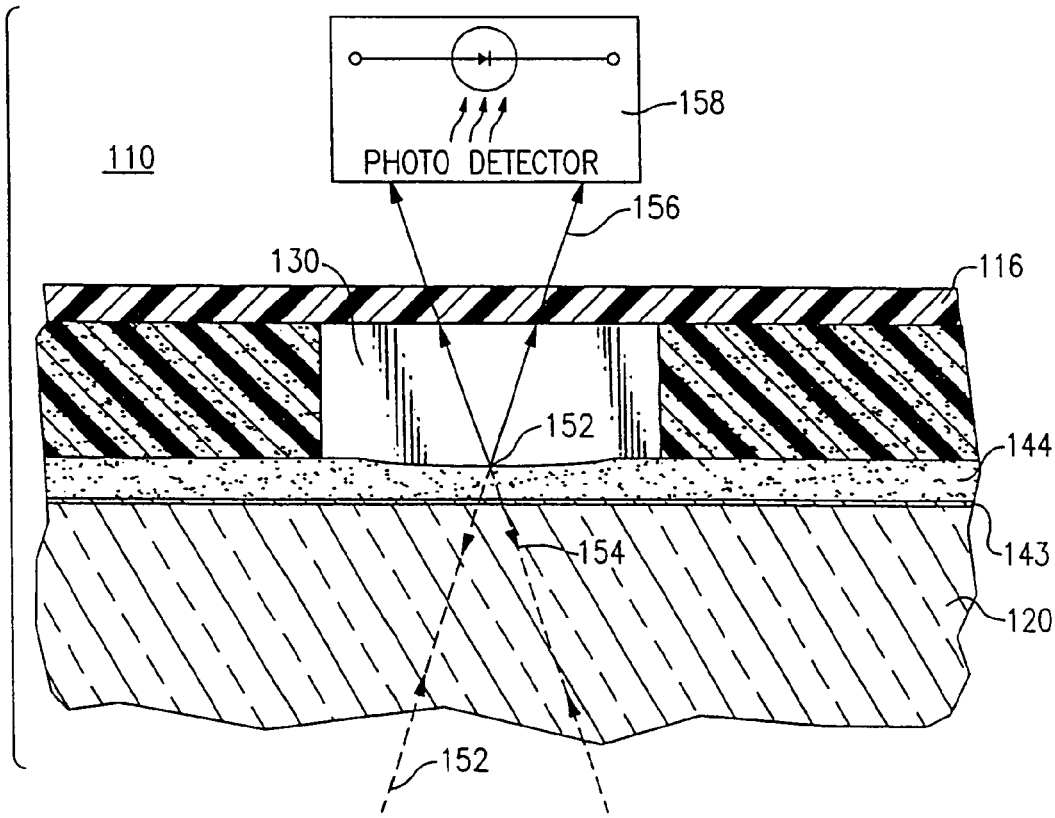
FIG. 12 is a partial cross sectional view taken perpendicular to a radius of the transmissive optical bio-disc illustrated in FIGS. 5, 8, and 9 showing a flow channel formed therein and a top detector.

The substrate 120 may include target or capture zones 140. In one embodiment, the substrate 120 is made of polycarbonate and has the aforementioned thin semi-reflective layer 143 deposited on the top thereof, FIG. 6. The semi-reflective layer 143 associated with the substrate 120 of the disc 110 illustrated in FIGS. 5 and 6 may be significantly thinner than the reflective layer 142 on the substrate 120 of the reflective disc 110 illustrated in FIGS. 2, 3 and 4. The thinner semi-reflective layer 143 may allows for some transmission of the interrogation beam 152 through the structural layers of the transmissive disc as shown in FIGS. 6 and 12. The thin semi-reflective layer 143 may be formed from a metal such as aluminum or gold.

FIG. 6 is an enlarged partially cut away perspective view of a portion of the substrate 120 and semi-reflective layer 143 of the transmissive embodiment of the optical bio-disc 110 illustrated in FIG. 5. The thin semi-reflective layer 143 may be made from a metal such as aluminum or gold. In an advantageous embodiment, the thin semi-reflective layer 143 of the transmissive disc illustrated in FIGS. 5 and 6 is approximately 100-300 Å thick and does not exceed 400 Å. This thinner semi-reflective layer 143 allows a portion of the incident or interrogation beam 152 to penetrate and pass through the semi-reflective layer 143 to be detected by a top detector 158, FIGS. 10 and 12, while some of the light is reflect or returned back along the incident path. Table 1, below, presents the reflective and transmissive characteristics of an exemplary gold film relative to the thickness of the film. The gold film layer is fully reflective at a thickness greater than 800 Å. While the threshold density for transmission of light through the gold film is approximately 400 Å.

Figure 7:
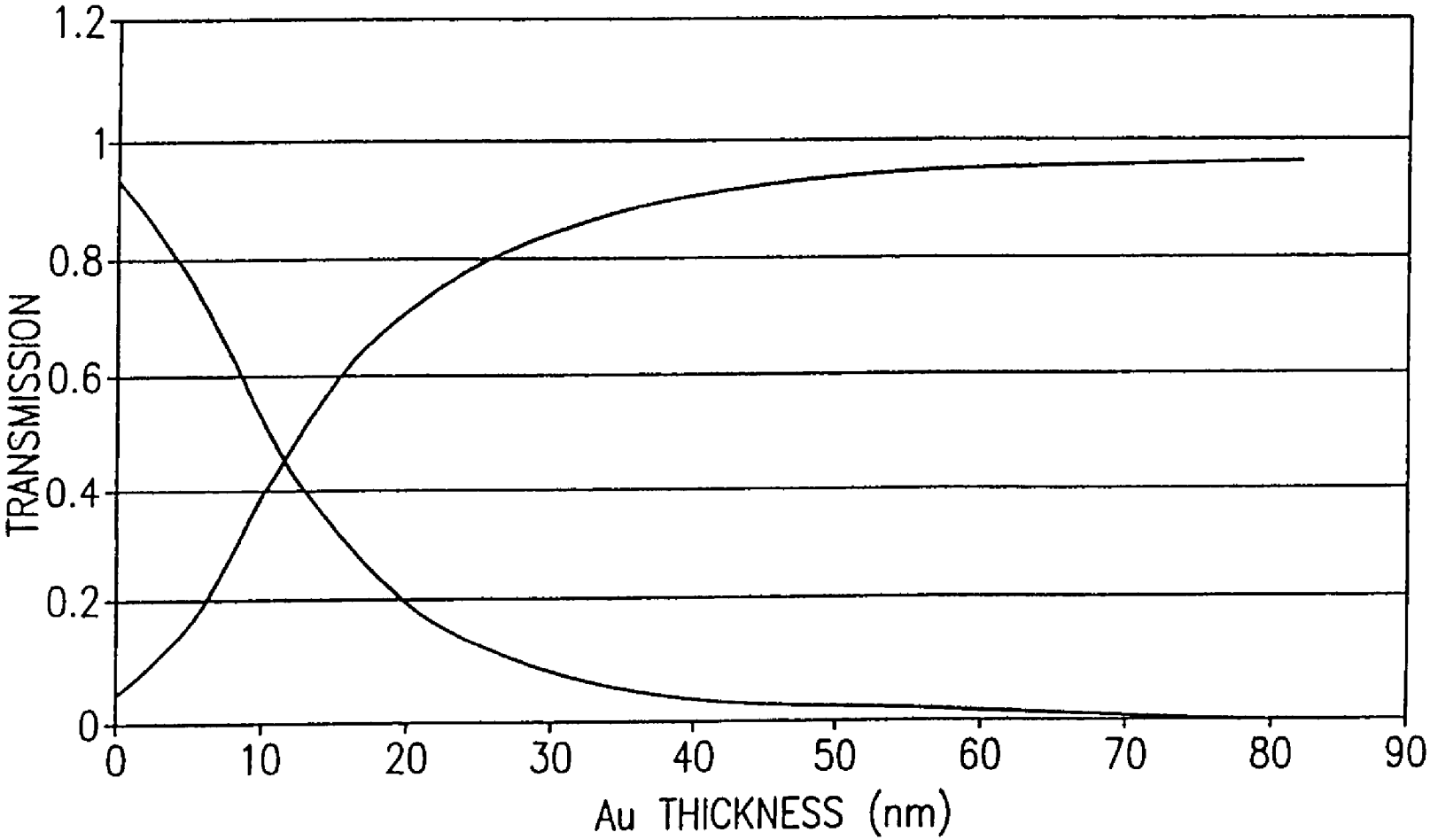
FIG. 7 is a graphical representation showing the relationship between thickness and transmission of a thin gold film.

In addition to Table 1, FIG. 7 provides a graphical representation of the inverse relationship of the reflective and transmissive nature of the thin semi-reflective layer 143 based upon the thickness of the gold. Reflective and transmissive values used in the graph illustrated in FIG. 7 are absolute values.

TABLE 1

Au film Reflection and Transmission (Absolute Values)

| Thickness (Angstroms) | Thickness (nm) | Reflectance | Transmittance |
|---|---|---|---|
| 0 | 0 | 0.0505 | 0.9495 |
| 50 | 5 | 0.1683 | 0.7709 |
| 100 | 10 | 0.3981 | 0.5169 |
| 150 | 15 | 0.5873 | 0.3264 |
| 200 | 20 | 0.7142 | 0.2057 |
| 250 | 25 | 0.7959 | 0.1314 |

TABLE 1-continued

Au film Reflection and Transmission (Absolute Values)

| Thickness (Angstroms) | Thickness (nm) | Reflectance | Transmittance |
|---|---|---|---|
| 300 | 30 | 0.8488 | 0.0851 |
| 350 | 35 | 0.8836 | 0.0557 |
| 400 | 40 | 0.9067 | 0.0368 |
| 450 | 45 | 0.9222 | 0.0244 |
| 500 | 50 | 0.9328 | 0.0163 |
| 550 | 55 | 0.9399 | 0.0109 |
| 600 | 60 | 0.9448 | 0.0073 |
| 650 | 65 | 0.9482 | 0.0049 |
| 700 | 70 | 0.9505 | 0.0033 |
| 750 | 75 | 0.9520 | 0.0022 |
| 800 | 80 | 0.9531 | 0.0015 |

Figure 8:
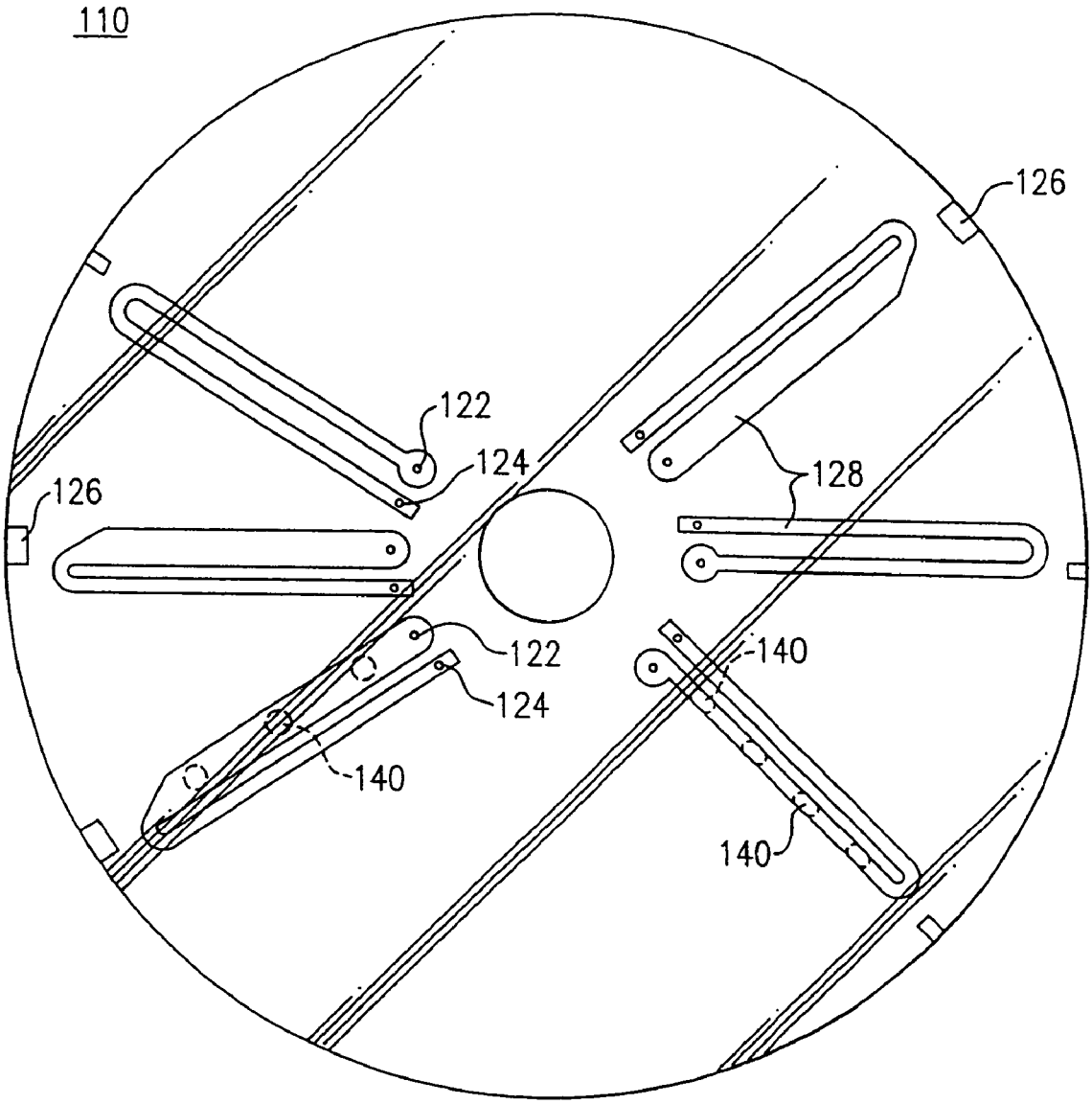
FIG. 8 is a top plan view of the disc shown in FIG. 5.

With reference next to FIG. 8, there is shown a top plan view of the transmissive type optical bio-disc 110 illustrated in FIGS. 5 and 6 with the transparent cap portion 116 revealing the fluidic channels, the trigger markings 126, and the target zones 140 as situated within the disc.

FIG. 9 is an enlarged partially cut away perspective view of a portion of the optical bio-disc 110 according to the transmissive disc embodiment. The disc 110 is illustrated with a portion of the various layers thereof cut away to show a partial sectional view of each principal layer, substrate, coating, or membrane. FIG. 9 illustrates a transmissive disc format with the clear cap portion 116, the thin semi-reflective layer 143 on the substrate 120, and trigger markings 126. In this embodiment, trigger markings 126 include opaque material placed on the top portion of the cap. Alternatively the trigger marking 126 may be formed by clear, non-reflective windows etched on the thin reflective layer 143 of the disc, or any mark that absorbs or does not reflect the signal coming from a trigger detector 160, FIG. 10. FIG. 9 also shows the target zones 140 formed by marking the designated area in the indicated shape or alternatively in any desired shape. Markings to indicate target zone 140 may be made on the thin semi-reflective layer 143 on the substrate 120 or on the bottom portion of the substrate 120 (under the disc). Alternatively, the target zones 140 may be formed by a masking technique that includes masking the entire thin semi-reflective layer 143 except the target zones 140. In this embodiment, target zones 140 may be created by silk screening ink onto the thin semi-reflective layer 143. In the transmissive disc format illustrated in FIGS. 5, 8, and 9, the target zones 140 may alternatively be defined by address information encoded on the disc. In this embodiment, target zones 140 do not include a physically discernable edge boundary.

With continuing reference to FIG. 9, an active layer 144 is illustrated as applied over the thin semi-reflective layer 143. In the preferred embodiment, the active layer 144 is a 10 to 200 μm thick layer of 2% polystyrene. Alternatively, polycarbonate, gold, activated glass, modified glass, or modified polystyrene, for example, polystyrene-co-maleic anhydride, may be used. In addition, hydrogels can be used. As illustrated in this embodiment, the plastic adhesive member 118 is applied over the active layer 144. The exposed section of the plastic adhesive member 118 illustrates the cut out or stamped U-shaped form that creates the fluidic circuits 128.

The final principal structural layer in this transmissive embodiment of the present bio-disc 110 is the clear, non-reflective cap portion 116 that includes inlet ports 122 and vent ports 124.

Referring now to FIG. 10, there is a representation in perspective and block diagram illustrating optical components 148, a light source 150 that produces the incident or interrogation beam 152, a return beam 154, and a transmitted beam 156. In the case of the reflective bio-disc illustrated in FIG. 4, the return beam 154 is reflected from the reflective surface 146 of the cap portion 116 of the optical bio-disc 110. In this reflective embodiment of the present optical bio-disc 110, the return beam 154 is detected and analyzed for the presence of signal elements by a bottom detector 157. In the transmissive bio-disc format, on the other hand, the transmitted beam 156 is detected, by the aforementioned top detector 158, and is also analyzed for the presence of signal elements. In the transmissive embodiment, a photo detector may be used as top detector 158.

FIG. 10 also shows a hardware trigger mechanism that includes the trigger markings 126 on the disc and the aforementioned trigger detector 160. The hardware triggering mechanism is used in both reflective bio-discs (FIG. 4) and transmissive bio-discs (FIG. 9). The triggering mechanism allows the processor 166 to collect data only when the interrogation beam 152 is on a respective target zone 140, e.g. at a predetermined reaction site. Furthermore, in the transmissive bio-disc system, a software trigger may also be used. The software trigger uses the bottom detector to signal the processor 166 to collect data as soon as the interrogation beam 152 hits the edge of a respective target zone 140. FIG. 10 further illustrates a drive motor 162 and a controller 164 for controlling the rotation of the optical bio-disc 110. FIG. 10 also shows the processor 166 and analyzer 168 implemented in the alternative for processing the return beam 154 and transmitted beam 156 associated with the transmissive optical bio-disc.

Figure 11:
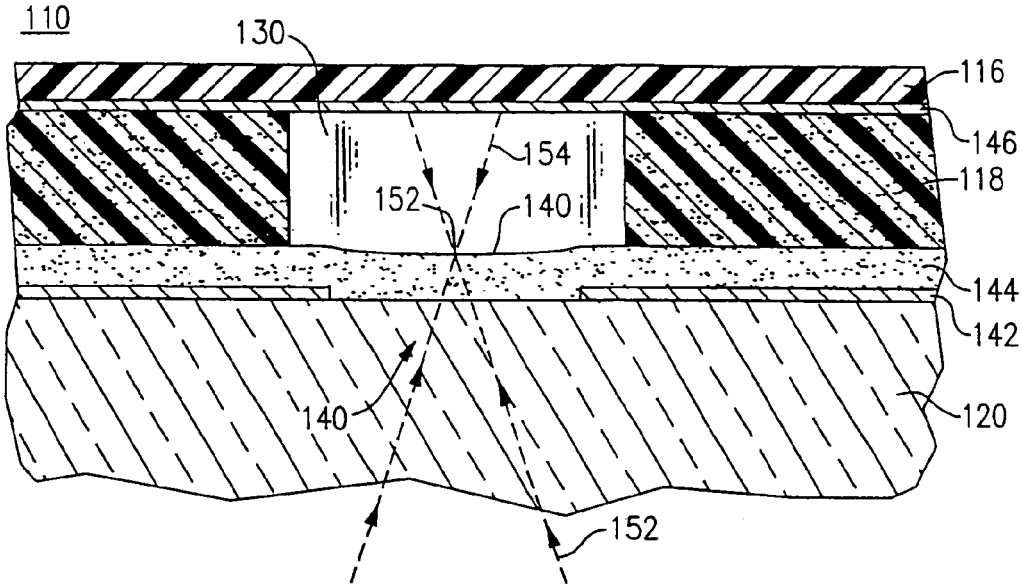
FIG. 11 is a partial cross sectional view taken perpendicular to a radius of the reflective optical bio-disc illustrated in FIGS. 2, 3, and 4 showing a flow channel formed therein.

As shown in FIG. 11, there is presented a partial cross sectional view of the reflective disc embodiment of the optical bio-disc 110. FIG. 11 illustrates the substrate 120 and the reflective layer 142. As indicated above, the reflective layer 142 may be made from a material such as aluminum, gold or other suitable reflective material. In this embodiment, the top surface of the substrate 120 is smooth. FIG. 11 also shows the active layer 144 applied over the reflective layer 142. As also shown in FIG. 11, the target zone 140 is formed by removing an area or portion of the reflective layer 142 at a desired location or, alternatively, by masking the desired area prior to applying the reflective layer 142. As further illustrated in FIG. 11, the plastic adhesive member 118 is applied over the active layer 144. FIG. 11 also shows the cap portion 116 and the reflective surface 146 associated therewith. Thus when the cap portion 116 is applied to the plastic adhesive member 118 including the desired cutout shapes, flow channel 130 is thereby formed. As indicated by the arrowheads shown in FIG. 11, the path of the incident beam 152 is initially directed toward the substrate 120 from below the disc 110. The incident beam then focuses at a point proximate the reflective layer 142. Since this focusing takes place in the target zone 140 where a portion of the reflective layer 142 is absent, the incident continues along a path through the active layer 144 and into the flow channel 130. The incident beam 152 then continues upwardly traversing through the flow channel to eventually fall incident onto the reflective surface 146. At this point, the incident beam 152 is returned or reflected back along the incident path and thereby forms the return beam 154.

FIG. 12 is a partial cross sectional view of the transmissive embodiment of the bio-disc 110. FIG. 12 illustrates a transmissive disc format with the clear cap portion 116 and the thin semi-reflective layer 143 on the substrate 120. FIG.

12 also shows the active layer 144 applied over the thin semi-reflective layer 143. In the preferred embodiment, the transmissive disc has the thin semi-reflective layer 143 made from a metal such as aluminum or gold approximately 100-300 Angstroms thick and does not exceed 400 Angstroms. This thin semi-reflective layer 143 allows a portion of the incident or interrogation beam 152, from the light source 150, FIG. 10, to penetrate and pass upwardly through the disc to be detected by top detector 158, while some of the light is reflected back along the same path as the incident beam but in the opposite direction. In this arrangement, the return or reflected beam 154 is reflected from the semi-reflective layer 143. Thus in this manner, the return beam 154 does not enter into the flow channel 130. The reflected light or return beam 154 may be used for tracking the incident beam 152 on pre-recorded information tracks formed in or on the semi-reflective layer 143 as described in more detail in conjunction with FIGS. 13 and 14. In the disc embodiment illustrated in FIG. 12, a physically defined target zone 140 may or may not be present. Target zone 140 may be created by direct markings made on the thin semi-reflective layer 143 on the substrate 120. These marking may be formed using silk screening or any equivalent method. In the alternative embodiment where no physical indicia are employed to define a target zone (such as, for example, when encoded software addressing is utilized) the flow channel 130 in effect may be employed as a confined target area in which inspection of an investigational feature is conducted.

Figure 13:
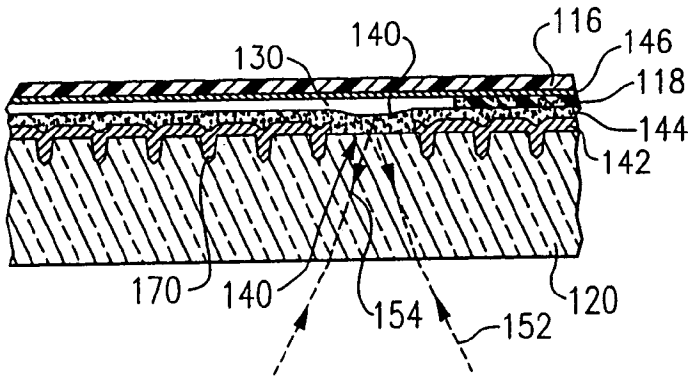
FIG. 13 is a partial longitudinal cross sectional view of the reflective optical bio-disc shown in FIGS. 2, 3, and 4 illustrating a wobble groove formed therein.

FIG. 13 is a cross sectional view taken across the tracks of the reflective disc embodiment of the bio-disc 110. This view is taken longitudinally along a radius and flow channel of the disc. FIG. 13 includes the substrate 120 and the reflective layer 142. In this embodiment, the substrate 120 includes a series of grooves 170. The grooves 170 are in the form of a spiral extending from near the center of the disc toward the outer edge. The grooves 170 are implemented so that the interrogation beam 152 may track along the spiral grooves 170 on the disc. This type of groove 170 is known as a "wobble groove". A bottom portion having undulating or wavy sidewalls forms the groove 170, while a raised or elevated portion separates adjacent grooves 170 in the spiral. The reflective layer 142 applied over the grooves 170 in this embodiment is, as illustrated, conformal in nature. FIG. 13 also shows the active layer 144 applied over the reflective layer 142. As shown in FIG. 13, the target zone 140 is formed by removing an area or portion of the reflective layer 142 at a desired location or, alternatively, by masking the desired area prior to applying the reflective layer 142. As further illustrated in FIG. 13, the plastic adhesive member 118 is applied over the active layer 144. FIG. 13 also shows the cap portion 116 and the reflective surface 146 associated therewith. Thus, when the cap portion 116 is applied to the plastic adhesive member 118 including the desired cutout shapes, the flow channel 130 is thereby formed.

Figure 14:
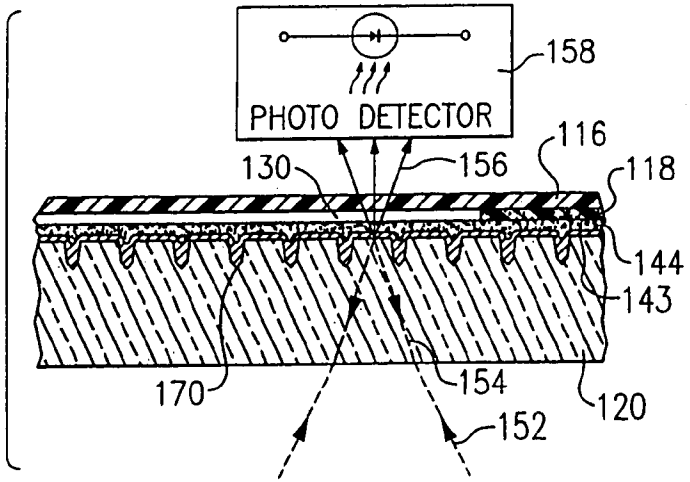
FIG. 14 is a partial longitudinal cross sectional view of the transmissive optical bio-disc illustrated in FIGS. 5, 8, and 9 showing a wobble groove formed therein and a top detector.

FIG. 14 is a cross sectional view taken across the tracks of the transmissive disc embodiment of the bio-disc 110 as described in FIG. 12, for example. This view is taken longitudinally along a radius and flow channel of the disc. FIG. 14 illustrates the substrate 120 and the thin semi-reflective layer 143. This thin semi-reflective layer 143 allows the incident or interrogation beam 152, from the light source 150, to penetrate and pass through the disc to be detected by the top detector 158, while some of the light is reflected back in the form of the return beam 154. The thickness of the thin semi-reflective layer 143 is determined by the minimum amount of reflected light required by the disc reader to maintain its tracking ability. The substrate 120 in this embodiment, like that discussed in FIG. 13, includes the series of grooves 170. The grooves 170 in this embodiment are also preferably in the form of a spiral extending from near the center of the disc toward the outer edge. The grooves 170 are implemented so that the interrogation beam 152 may track along the spiral. FIG. 14 also shows the active layer 144 applied over the thin semi-reflective layer 143. As further illustrated in FIG. 14, the plastic adhesive member or channel layer 118 is applied over the active layer 144. FIG. 14 also shows the cap portion 116 without a reflective surface 146. Thus, when the cap is applied to the plastic adhesive member 118 including the desired cutout shapes, the flow channel 130 is thereby formed and a part of the incident beam 152 is allowed to pass therethrough substantially unreflected.

Figure 16:
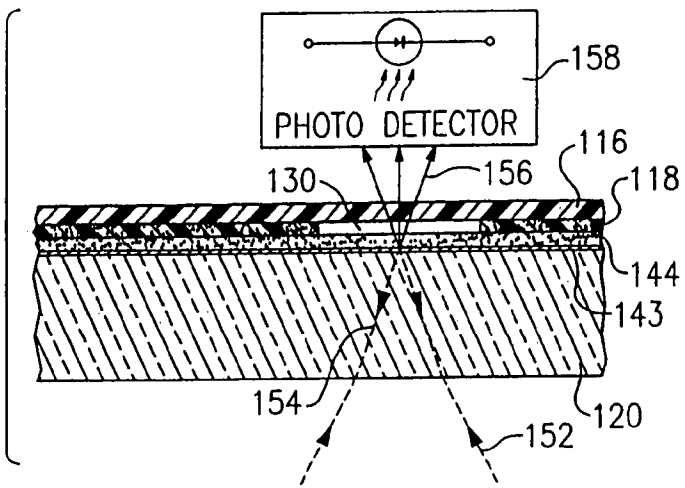
FIG. 16 is a view similar to FIG. 12 showing the entire thickness of the transmissive disc and the initial refractive property thereof.
Figure 15:
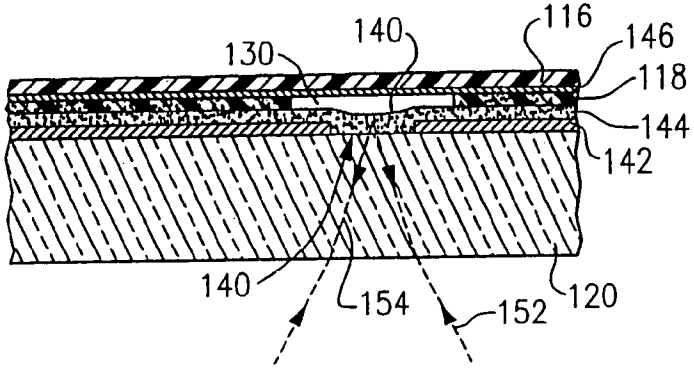
FIG. 15 is a view similar to FIG. 11 showing the entire thickness of the reflective disc and the initial refractive property thereof.

FIG. 15 is a view similar to FIG. 11 showing the entire thickness of the reflective disc and the initial refractive property thereof. FIG. 16 is a view similar to FIG. 12 showing the entire thickness of the transmissive disc and the initial refractive property thereof. Grooves 170 are not seen in FIGS. 15 and 16 since the sections are cut along the grooves 170. FIGS. 15 and 16 show the presence of the narrow flow channel 130 that is situated perpendicular to the grooves 170 in these embodiments. FIGS. 13, 14, 15, and 16 show the entire thickness of the respective reflective and transmissive discs. In these figures, the incident beam 152 is illustrated initially interacting with the substrate 120 which has refractive properties that change the path of the incident beam as illustrated to provide focusing of the beam 152 on the reflective layer 142 or the thin semi-reflective layer 143.

Counting Methods and Related Software

By way of illustrative background, a number of methods and related algorithms for white blood cell counting using optical disc data are herein discussed in further detail. These methods and the related algorithms are not limited to counting white blood cells, but may be readily applied to conducting counts of any type of particulate matter including, but not limited to, red blood cells, white blood cells, beads, and any other objects, both biological and non-biological, that produce similar optical signatures that can be detected by an optical reader.

For the purposes of illustration, the following description of the methods and algorithms related to the invention as described with reference to FIGS. 17-21, are directed to cell counting. With some modifications, these methods and algorithms can be applied to counting other types of objects similar in size to cells. The data evaluation aspects of the cell counting methods and algorithms are described generally herein to provide related background for the methods and apparatus of the invention. Methods and algorithms for capturing and processing investigational data from the optical bio-disc has general broad applicability and has been disclosed in further detail in commonly assigned U.S. Provisional Application No. 60/291,233 entitled "Variable Sampling Control For Rendering Pixelation of Analysis Results In Optical Bio-Disc Assembly And Apparatus Relating Thereto" filed May 16, 2001 which is herein incorporated by reference and the above incorporated U.S. Provisional Application No. 60/404,921 entitled "Methods For Differential Cell Counts Including Related Apparatus And Software For Performing Same". In the following discussion, the basic scheme of the methods and algorithms with a brief explanation is presented. As illustrated in FIG. 10, information concerning attributes of the biological test sample is retrieved from the optical bio-disc 110 in the form of a beam of electromagnetic radiation that has been modified or modulated by interaction with the test sample. In the case of the reflective optical bio-disc discussed in conjunction with FIGS. 2, 3, 4, 11, 13, and 15, the return beam 154 carries the information about the biological sample. As discussed above, such information about the biological sample is contained in the return beam essentially only when the incident beam is within the flow channel 130 or target zones 140 and thus in contact with the sample. In the reflective embodiment of the bio-disc 110, the return beam 154 may also carry information encoded in or on the reflective layer 142 or otherwise encoded in the wobble grooves 170 illustrated in FIGS. 13 and 14. As would be apparent to one of skill in the art, pre-recorded information is contained in the return beam 154 of the reflective disc with target zones, only when the corresponding incident beam is in contact with the reflective layer 142. Such information is not contained in the return beam 154 when the incident beam 152 is in an area where the information bearing reflective layer 142 has been removed or is otherwise absent. In the case of the transmissive optical bio-disc discussed in conjunction with FIGS. 5, 6, 8, 9, 12, 14, and 16, the transmitted beam 156 carries the information about the biological sample.

With continuing reference to FIG. 10, the information about the biological test sample, whether it is obtained from the return beam 154 of the reflective disc or the transmitted beam 156 of the transmissive disc, is directed to processor 166 for signal processing. This processing involves transformation of the analog signal detected by the bottom detector 157 (reflective disc) or the top detector 158 (transmissive disc) to a discrete digital form.

Figure 17:
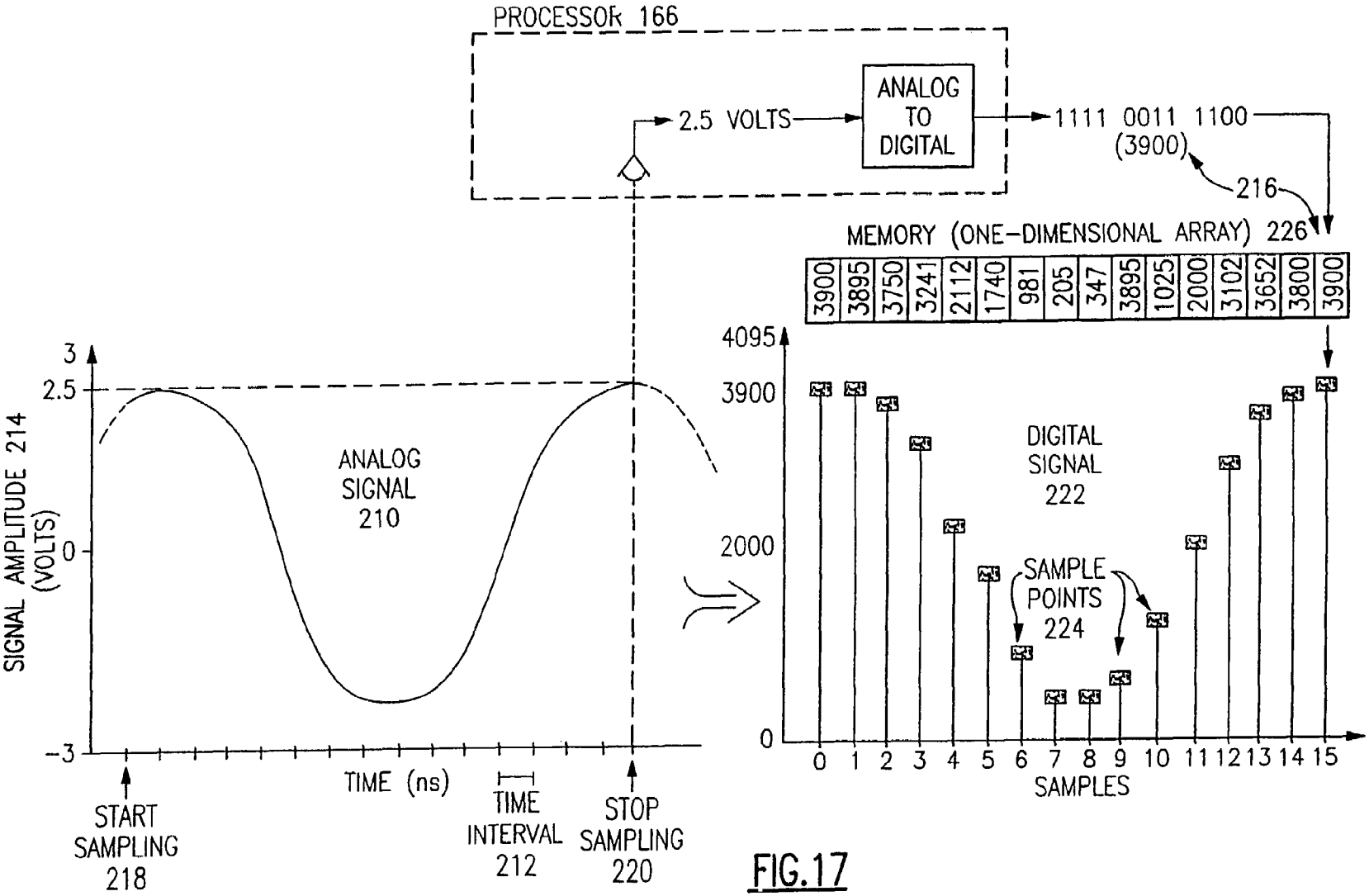
FIG. 17 is a pictorial graphical representation of the transformation of a sampled analog signal to a corresponding digital signal that is stored as a one-dimensional array.

Referring next to FIG. 17, the signal transformation involves sampling the analog signal 210 at fixed time intervals 212, and encoding the corresponding instantaneous analog amplitude 214 of the signal as a discrete binary integer 216. Sampling is started at some start time 218 and stopped at some end time 220. The two common values associated with any analog-to-digital conversion process are sampling frequency and bit depth. The sampling frequency, also called the sampling rate, is the number of samples taken per unit time. A higher sampling frequency yields a smaller time interval 212 between consecutive samples, which results in a higher fidelity of the digital signal 222 compared to the original analog signal 210. Bit depth is the number of bits used in each sample point to encode the sampled amplitude 214 of the analog signal 210. The greater the bit depth, the better the binary integer 216 will approximate the original analog amplitude 214. In the present embodiment, the sampling rate is 8 MHz with a bit depth of 12 bits per sample, allowing an integer sample range of 0 to 4095 (0 to $(2n-1)$, where n is the bit depth. This combination may change to accommodate the particular accuracy necessary in other embodiments. By way of example and not limitation, it may be desirable to increase sampling frequency in embodiments involving methods for counting beads, which are generally smaller than cells. The sampled data is then sent to processor 166 for analog-to-digital transformation.

During the analog-to-digital transformation, each consecutive sample point 224 along the laser path is stored consecutively on disc or in memory as a one-dimensional array 226. Each consecutive track contributes an independent one-dimensional array, which yields a two-dimensional array 228 (FIG. 20A) that is analogous to an image.

Figure 18:
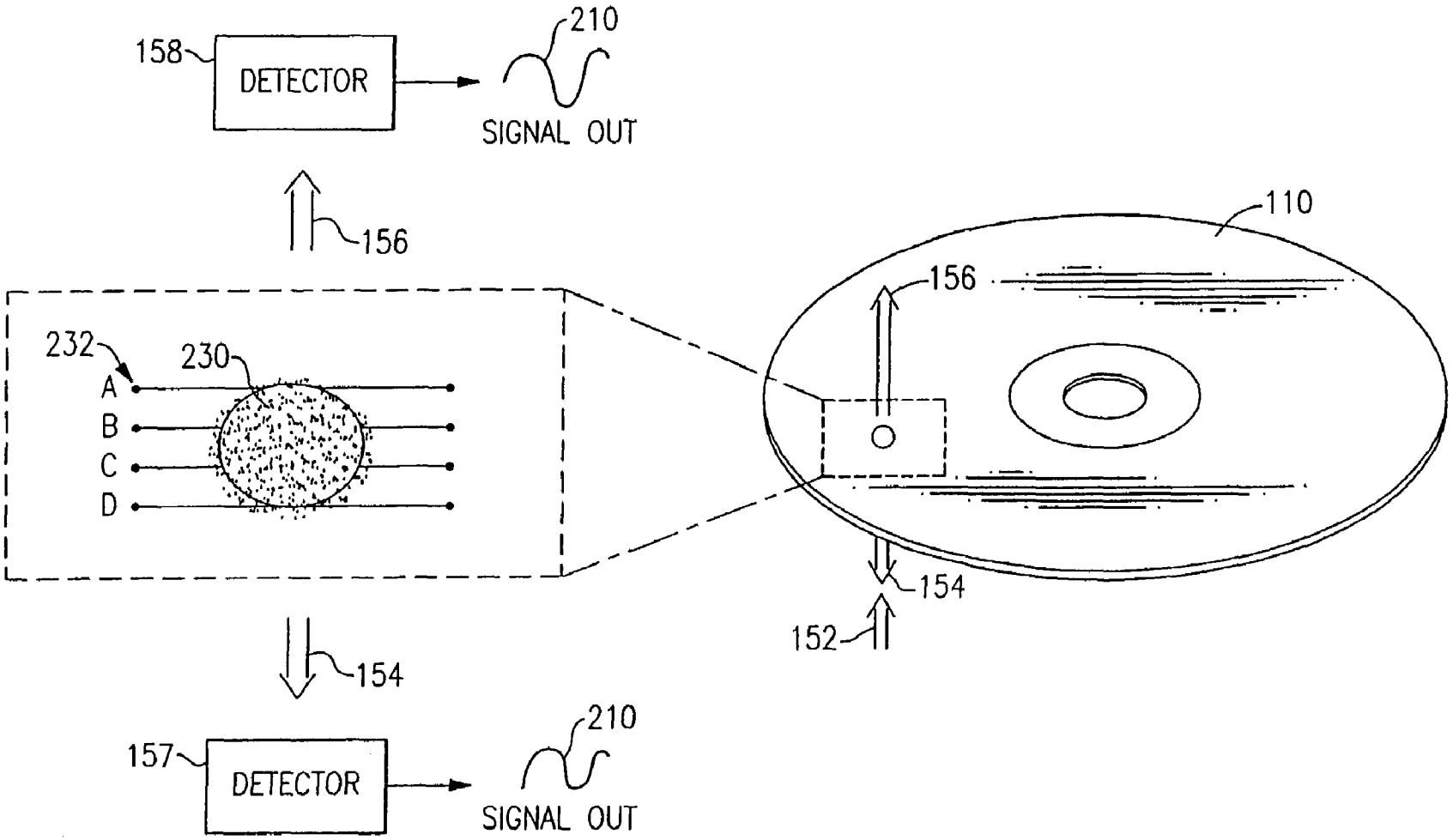
FIG. 18 is a perspective view of an optical disc with an enlarged detailed view of an indicated section showing a captured white blood cell positioned relative to the tracks of the bio-disc yielding a signal-containing beam after interacting with an incident beam.

FIG. 18 is a perspective view of an optical bio-disc 110 with an enlarged detailed perspective view of the section indicated showing a captured white blood cell 230 positioned relative to the tracks 232 of the optical bio-disc. The white blood cell 230 is used herein for illustrative purposes only. As indicated above, other objects or investigational features such as beads or agglutinated matter may be utilized herewith. As shown, the interaction of incident beam 152 with white blood cell 230 yields a signal-containing beam, either in the form of a return beam 154 of the reflective disc or a transmitted beam 156 of the transmissive disc, which is detected by either of detectors 157 or 158.

Figure 19A:
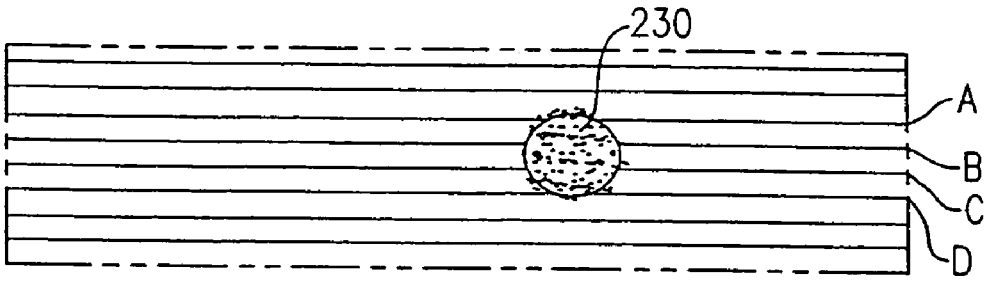
FIG. 19A is a graphical representation of a white blood cell positioned relative to the tracks of an optical bio-disc.
Figure 19B:
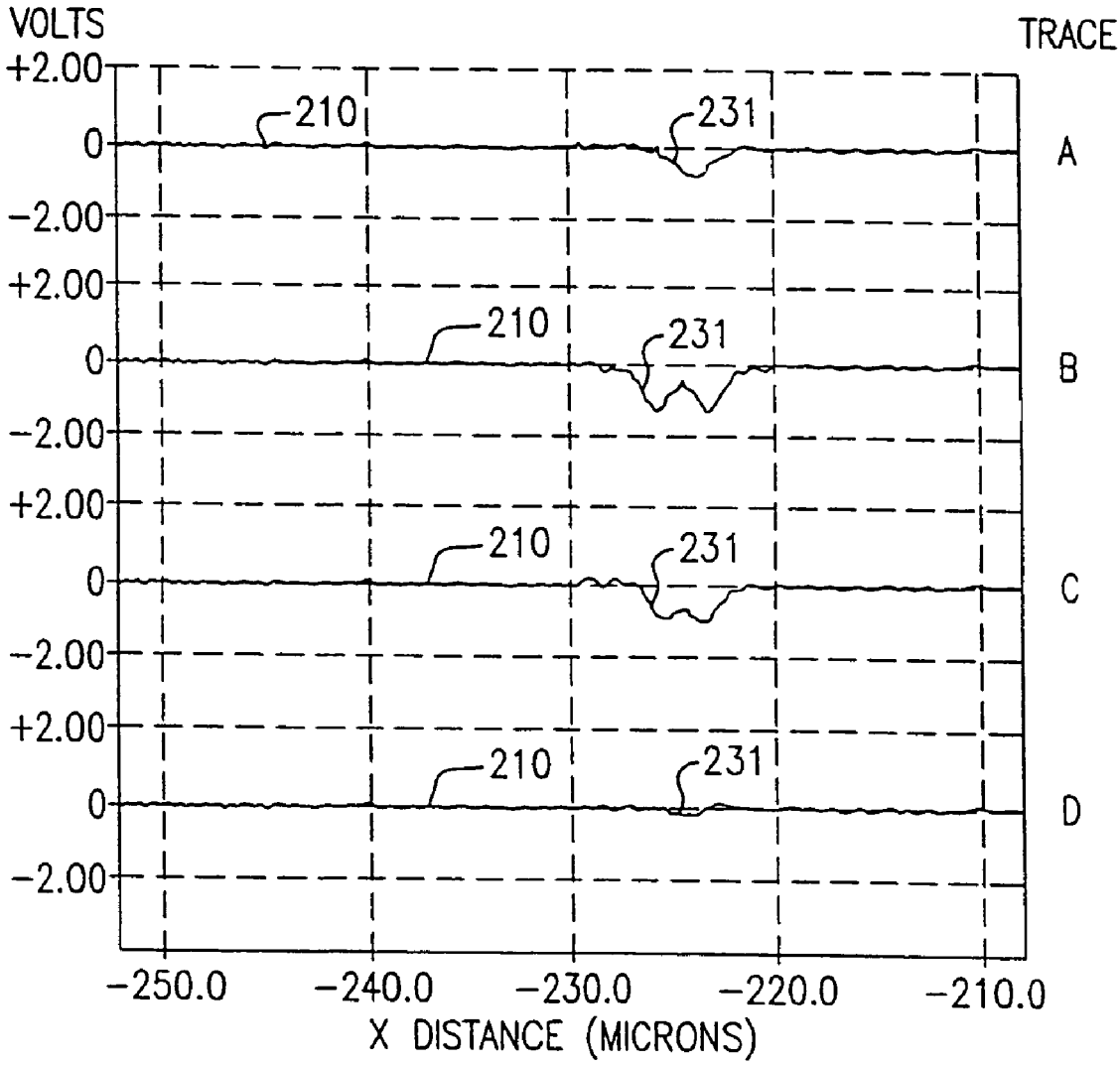
FIG. 19B is a series of signature traces derived from the white blood cell of FIG. 19A.

FIG. 19A is another graphical representation of the white blood cell 230 positioned relative to the tracks 232 of the optical bio-disc 110 shown in FIG. 18. As shown in FIGS. 18 and 19A, the white blood cell 230 covers approximately four tracks A, B, C, and D. FIG. 19B shows a series of signature traces derived from the white blood cell 210 of FIGS. 19 and 19A. As indicated in FIG. 19B, the detection system provides four analogue signals A, B, C, and D corresponding to tracks A, B, C, and D. As further shown in FIG. 19B, each of the analogue signals A, B, C, and D carries specific information about the white blood cell 230. Thus as illustrated, a scan over a white blood cell 230 yields distinct perturbations of the incident beam that can be detected and processed. The analog signature traces (signals) 210 are then directed to processor 166 for transformation to an analogous digital signal 222 as shown in FIGS. 20A and 20C as discussed in further detail below.

Figure 20:
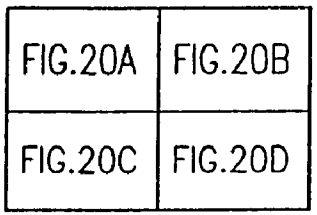
FIG. 20 is a graphical representation illustrating the relationship between FIGS. 20A, 20B, 20C, and 20D.
Figure 20D:
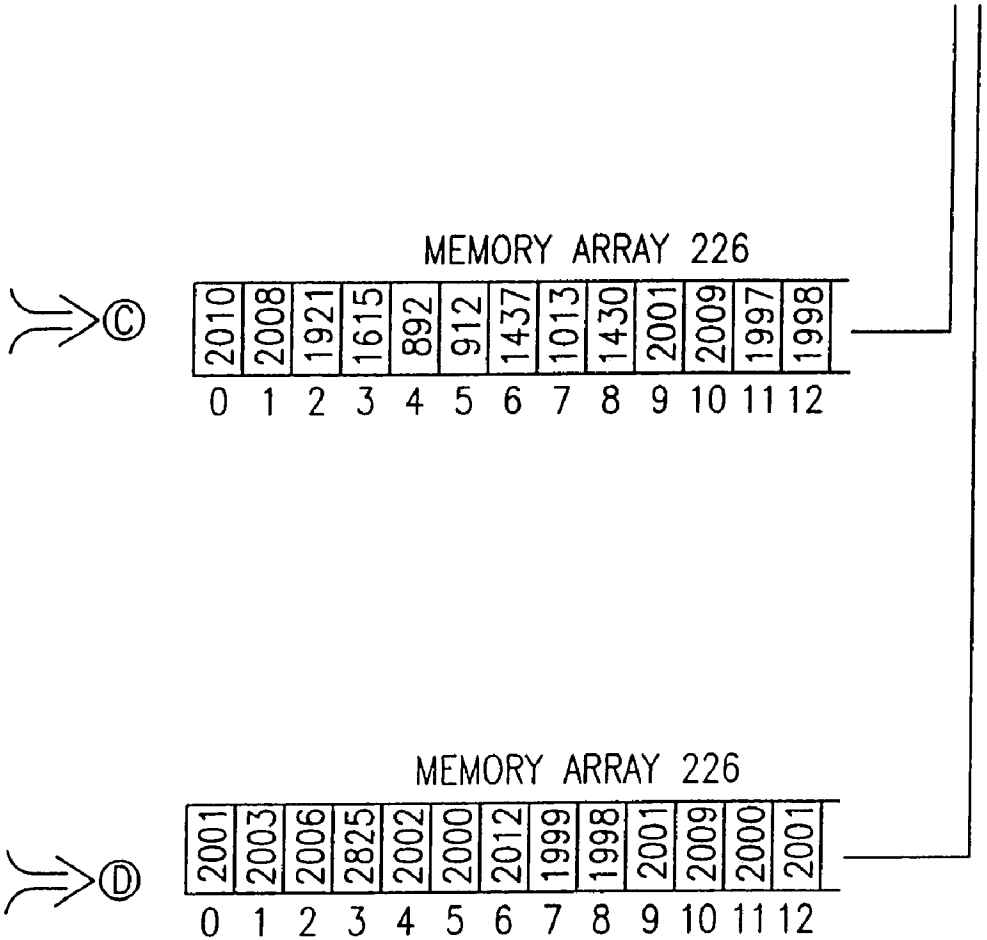
FIGS. 20A, 20B, 20C, and 20D, when taken together, form a pictorial graphical representation of transformation of the signature traces from FIG. 19B into digital signals that are stored as one-dimensional arrays and combined into a two-dimensional array for data input.
Figure 20A:
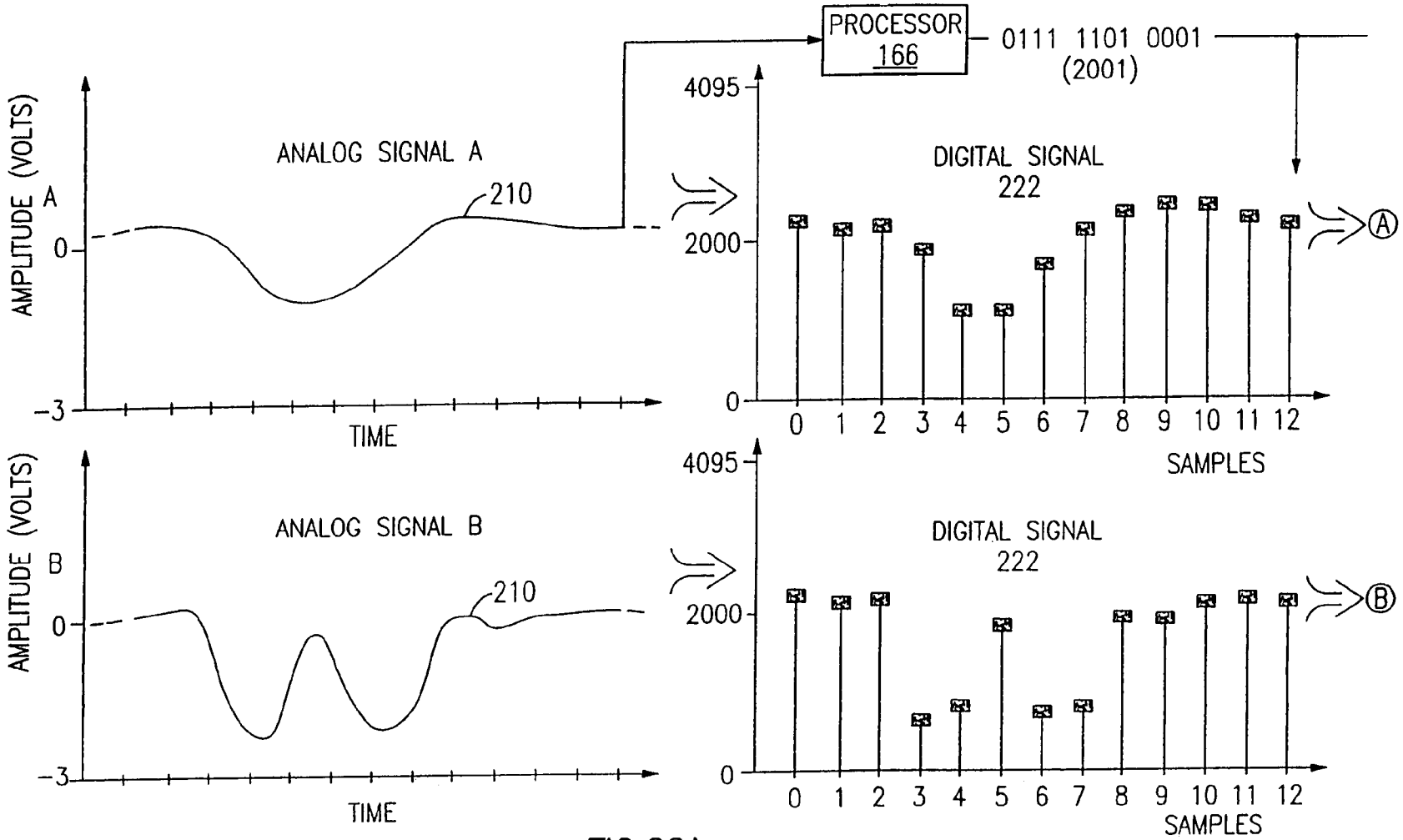
Figure 20B:
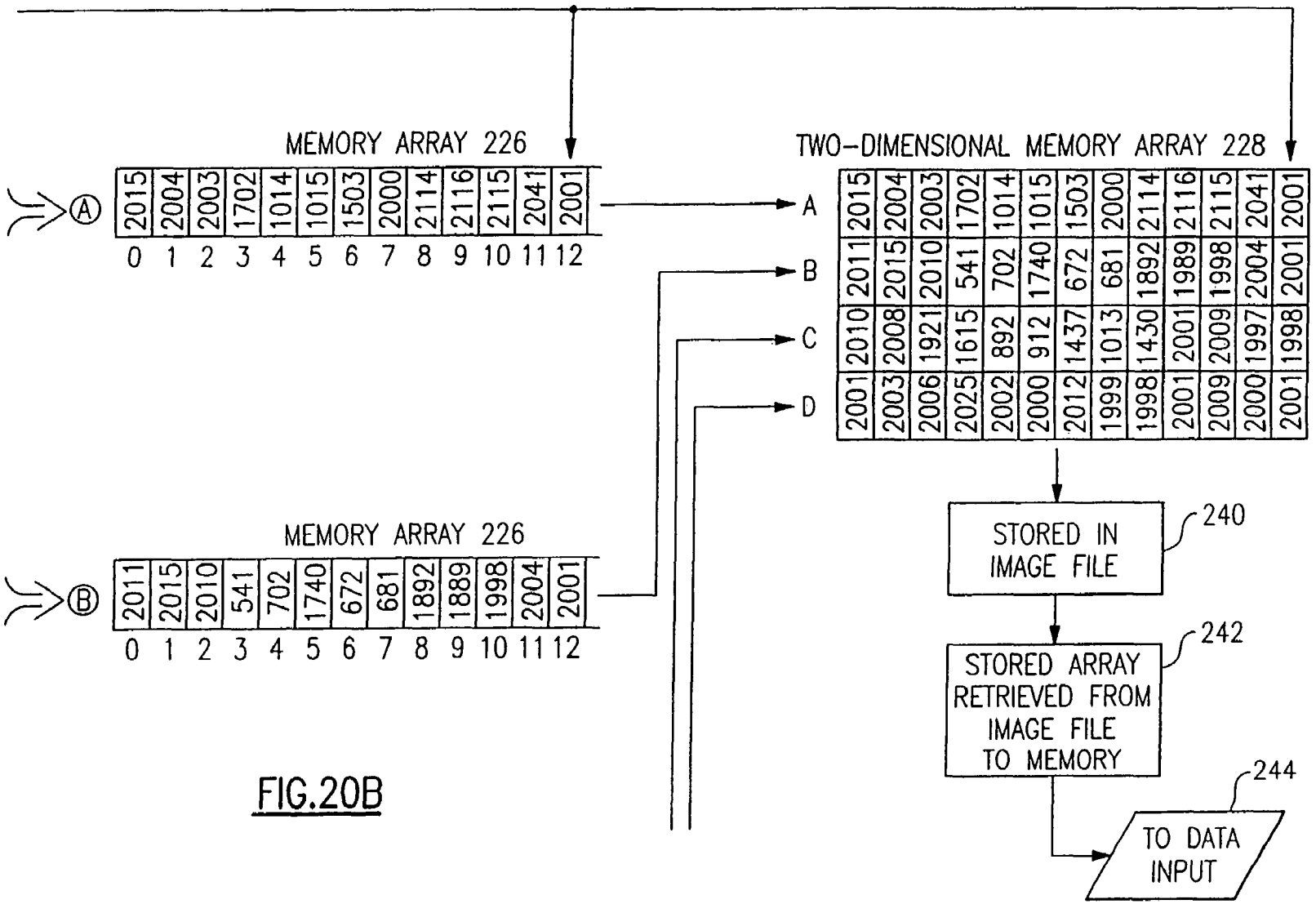
Figure 20C:
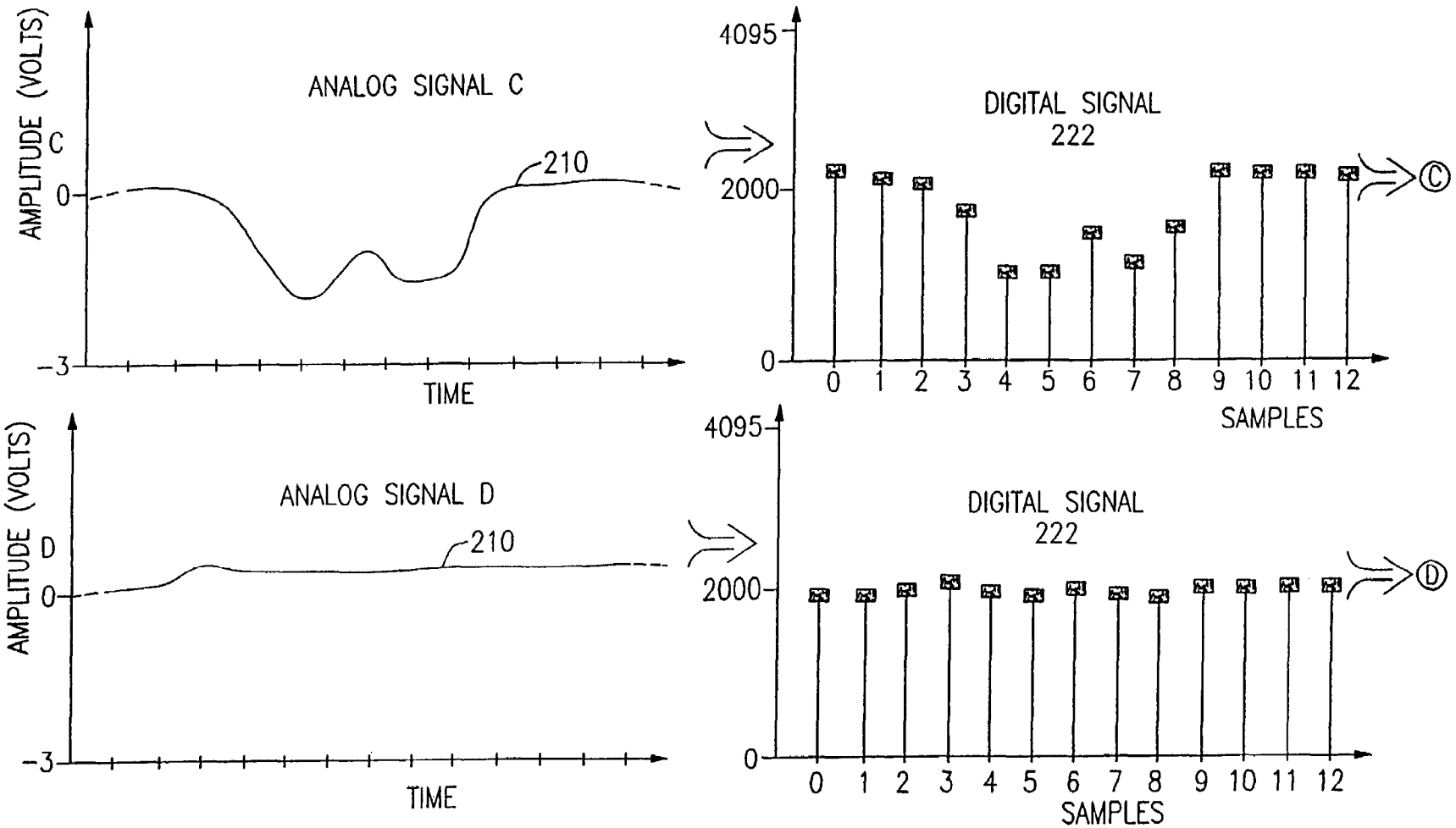

FIG. 20 is a graphical representation illustrating the relationship between FIGS. 20A, 20B, 20C, and 20D. FIGS. 20A, 20B, 20C, and 20D are pictorial graphical representations of transformation of the signature traces from FIG. 19B into digital signals 222 that are stored as one-dimensional arrays 226 and combined into a two-dimensional array 228 for data input 244.

With particular reference now to FIG. 20A, there is shown sampled analog signals 210 from tracks A and B of the optical bio-disc shown in FIGS. 18 and 19A. Processor 166 then encodes the corresponding instantaneous analog amplitude 214 of the analog signal 210 as a discrete binary integer 216 (see FIG. 17). The resulting series of data points is the digital signal 222 that is analogous to the sampled analog signal 210.

Referring next to FIG. 20B, digital signal 222 from tracks A and B (FIG. 20A) is stored as an independent one-dimensional memory array 226. Each consecutive track contributes a corresponding one-dimensional array, which when combined with the previous one-dimensional arrays, yields a two-dimensional array 228 that is analogous to an image. The digital data is then stored in memory or on disc as a two-dimensional array 228 of sample points 224 (FIG. 17) that represent the relative intensity of the return beam 154 or transmitted beam 156 (FIG. 18) at a particular point in the sample area. The two-dimensional array is then stored in memory or on disc in the form of a raw file or image file 240 as represented in FIG. 20B. The data stored in the image file 240 is then retrieved 242 to memory and used as data input 244 to analyzer 168 shown in FIG. 10.

FIG. 20C shows sampled analog signals 210 from tracks C and D of the optical bio-disc shown in FIGS. 18 and 19A. Processor 166 then encodes the corresponding instantaneous analog amplitude 214 of the analog signal 210 as a discrete binary integer 216 (FIG. 17). The resulting series of data points is the digital signal 222 that is analogous to the sampled analog signal 210.

Referring now to FIG. 20D, digital signal 222 from tracks C and D is stored as an independent one-dimensional memory array 226. Each consecutive track contributes a corresponding one-dimensional array, which when combined with the previous one-dimensional arrays, yields a two-dimensional array 228 that is analogous to an image. As above, the digital data is then stored in memory or on disc as a two-dimensional array 228 of sample points 224 (FIG. 17) that represent the relative intensity of the return beam 154 or transmitted beam 156 (FIG. 18) at a particular point in the sample area. The two-dimensional array is then stored in memory or on disc in the form of a raw file or image file 240 as shown in FIG. 20B. As indicated above, the data stored in the image file 240 is then retrieved 242 to memory and used as data input 244 to analyzer 168 FIG. 10.

The computational and processing algorithms are stored in analyzer 168 (FIG. 10) and applied to the input data 244 to produce useful output results 262 (FIG. 21) that may be displayed on the display monitor 114 (FIG. 10).

Figure 21:
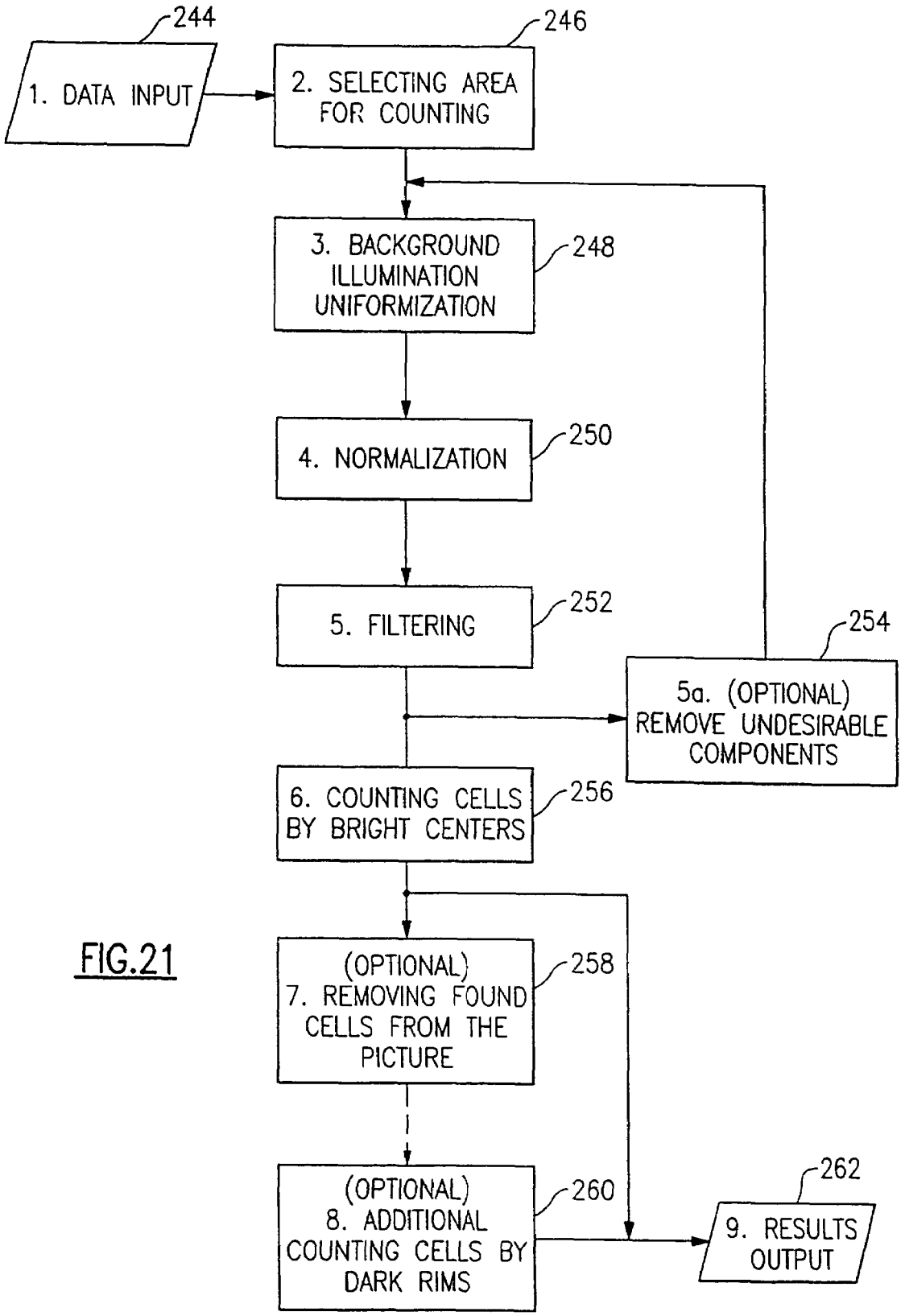
FIG. 21 is a logic flow chart depicting the principal steps for data evaluation according to processing methods and computational algorithms related to the invention.
Figures 22A, 22B, 22C, 22D:
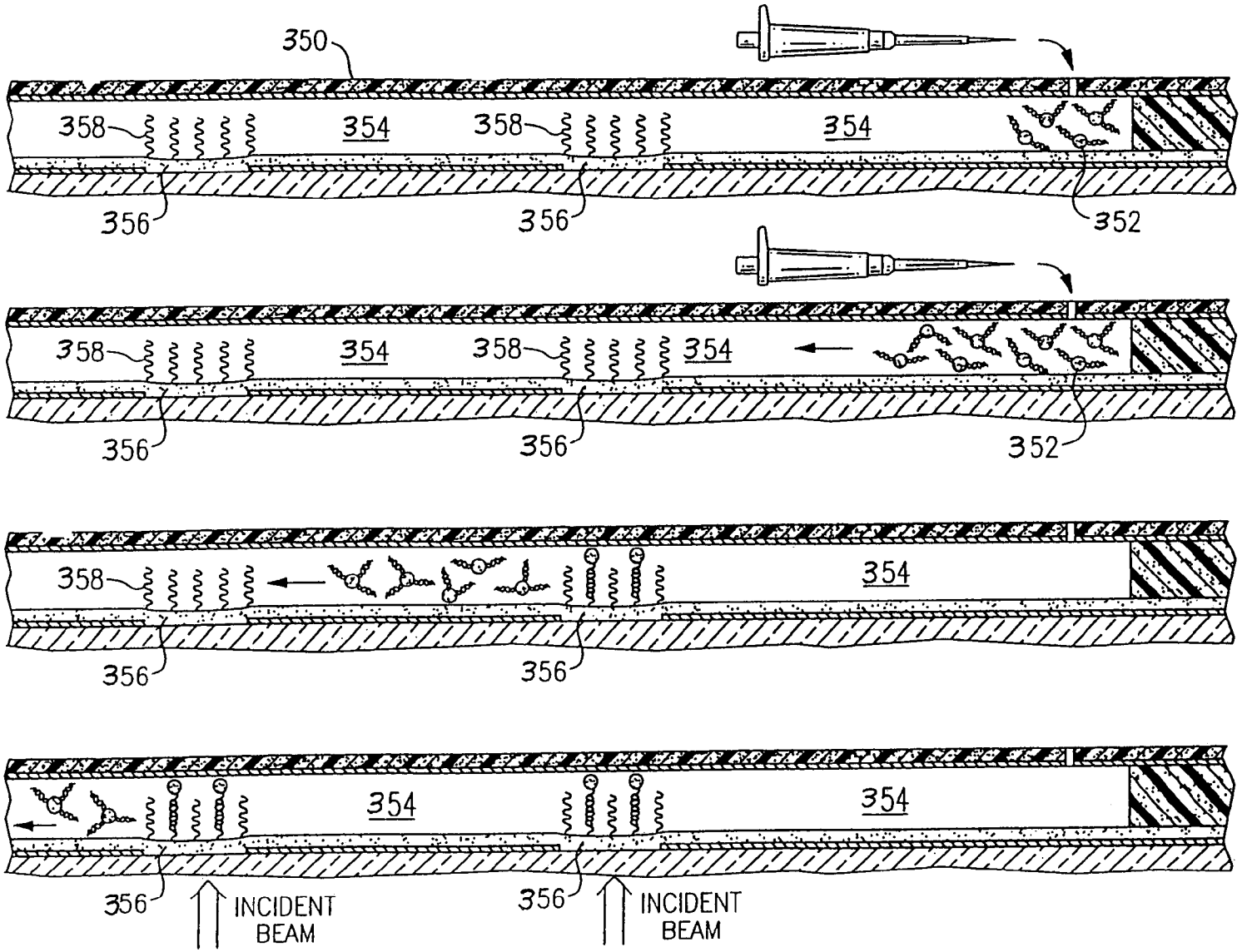
FIGS. 22A, 22B, 22C, and 22D are cross-sectional side views of an optical bio-disc showing a method of detecting investigational features in a test sample.
Figures 23A, 23B, 23C, 23D:
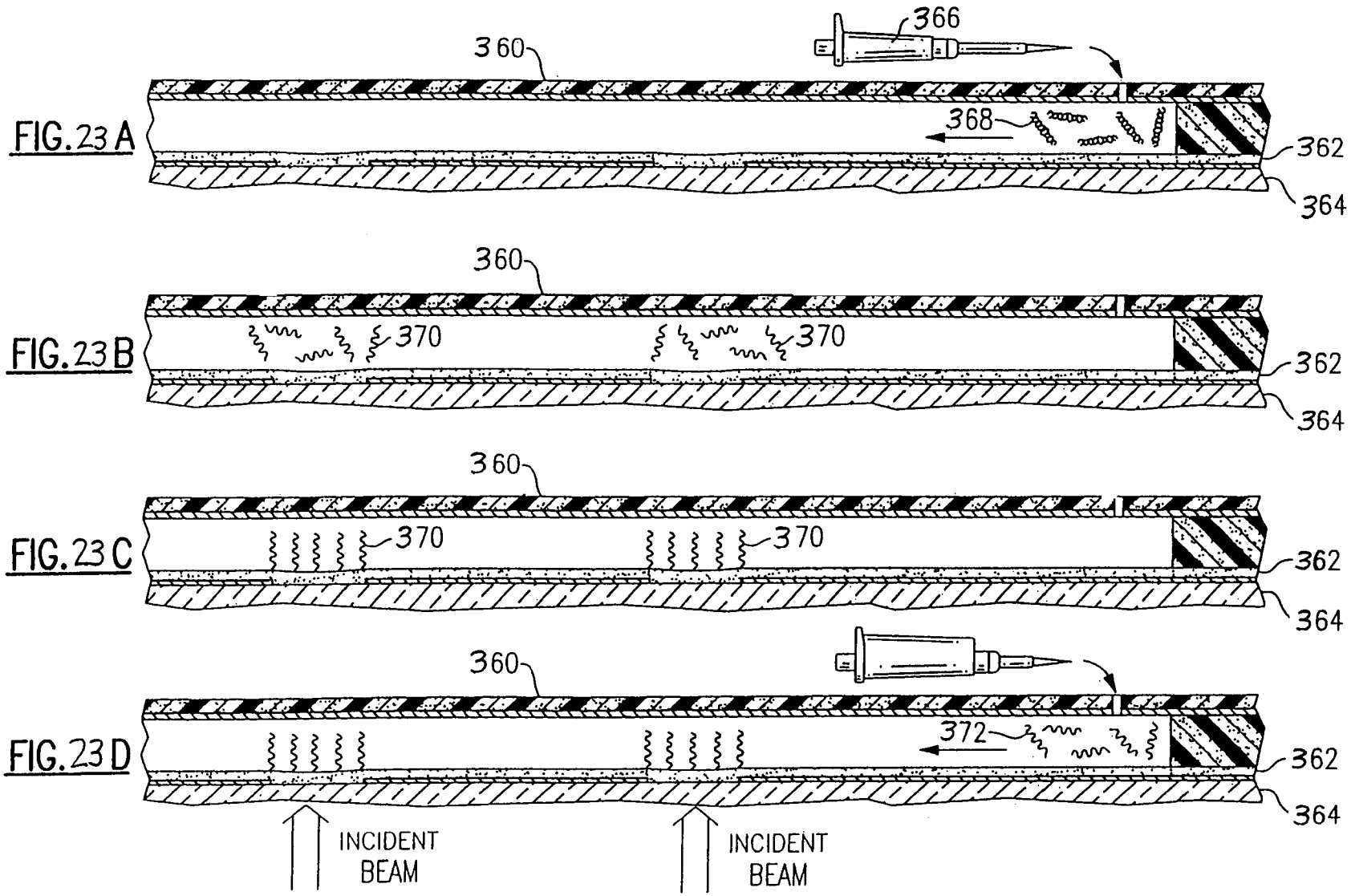
FIGS. 23A, 23B, 23C, and 23D are cross-sectional side views of an optical bio-disc used in a mixed phase assay to detect investigational features in a test sample.
Figure 24A:
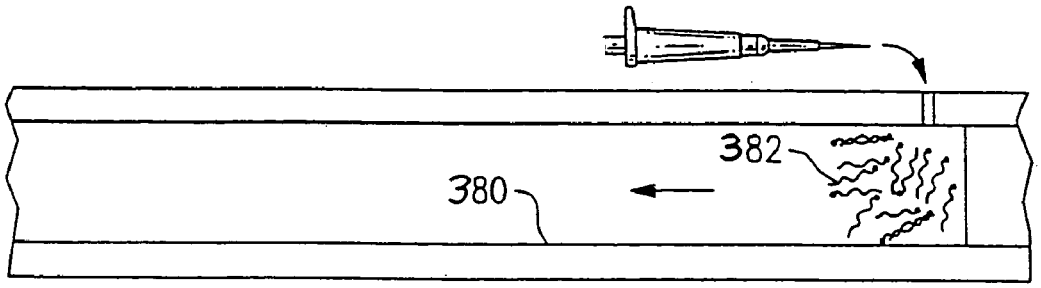
FIGS. 24A, 24B, 24C, 24D, 24E, and 24F are cross-sectional side views of an optical bio-disc showing a method of detecting investigational features in a test sample using ELISA.
Figure 24B:
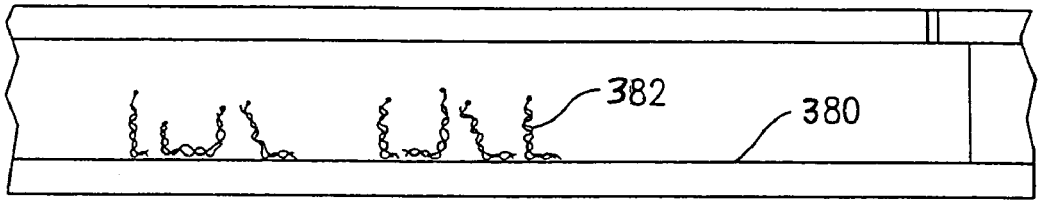
Figure 24C:
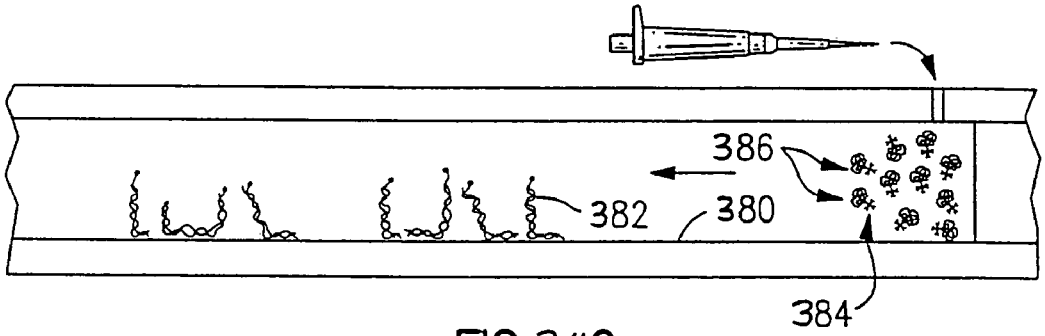
Figure 24D:
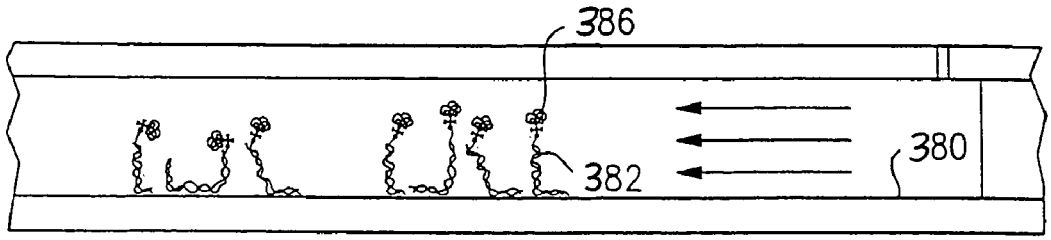
Figure 24E:
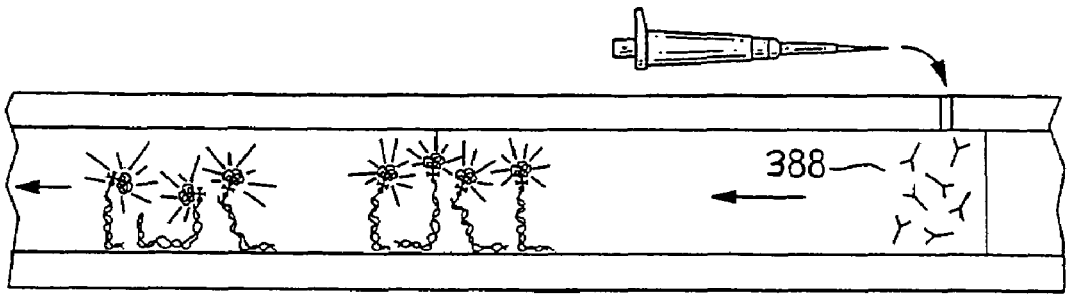
Figure 24F:
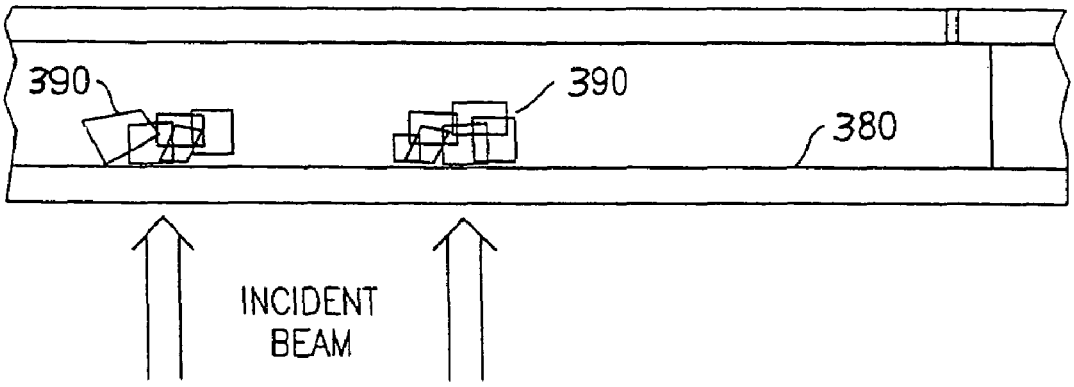

With reference now to FIG. 21 there is shown a logic flow chart of the principal steps for data evaluation according to the processing methods and computational algorithms related to the invention. A first principal step of the present processing method involves receipt of the input data 244. As described above, data evaluation starts with an array of integers in the range of 0 to 4096.

The next principle step 246 is selecting an area of the disc for counting. Once this area is defined, an objective then becomes making an actual count of all white blood cells contained in the defined area. The implementation of step 246 depends on the configuration of the disc and user's options. By way of example and not limitation, embodiments of the invention using discs with windows such as the target zones 140 shown in FIGS. 2 and 5, the software recognizes the windows and crops a section thereof for analysis and counting. In one preferred embodiment, such as that illustrated in FIG. 2, the target zones or windows have the shape of 1×2 mm rectangles with a semicircular section on each end thereof. In this embodiment, the software crops a standard rectangle of 1×2 mm area inside a respective window. In an aspect of this embodiment, the reader may take several consecutive sample values to compare the number of cells in several different windows.

In embodiments of the invention using a transmissive disc without windows, as shown in FIGS. 5, 6, 8, and 9, step 246 may be performed in one of two different manners. The position of the standard rectangle is chosen either by positioning its center relative to a point with fixed coordinates, or by finding reference mark which may be a spot of dark dye. In the case where a reference mark is employed, a dye with a desired contrast is deposited in a specific position on the disc with respect to two clusters of cells. The optical disc reader is then directed to skip to the center of one of the clusters of cells and the standard rectangle is then centered around the selected cluster.

As for the user options mentioned above in regard to step 246, the user may specify a desired sample area shape for cell counting, such as a rectangular area, by direct interaction with mouse selection or otherwise. In the present embodiment of the software, this involves using the mouse to click and drag a rectangle over the desired portion of the optical bio-disc-derived image that is displayed on monitor 114. Regardless of the evaluation area selection method, a respective rectangular area is evaluated for counting in the next step 248.

The third principal step in FIG. 21 is step 248, which is directed to background illumination uniformization. This process corrects possible background uniformity fluctuations caused in some hardware configurations. Background illumination uniformization offsets the intensity level of each sample point such that the overall background, or the portion of the image that is not cells, approaches a plane with an arbitrary background value Vbackground. While Vbackground may be decided in many ways, such as taking the average value over the standard rectangular sample area, in the present embodiment, the value is set to 2000. The value V at each point P of the selected rectangular sample area is replaced with the number (Vbackground+(V−average value over the neighborhood of P)) and truncated, if necessary, to fit the actual possible range of values, which is 0 to 4095 in a preferred embodiment of the invention. The dimensions of the neighborhood are chosen to be sufficiently larger than the size of a cell and sufficiently smaller than the size of the standard rectangular sample area.

The next step in the flow chart of FIG. 21 is a normalization step 250. In conducting normalization step 250, a linear transform is performed with the data in the standard rectangular sample area so that the average becomes 2000 with a standard deviation of 600. If necessary, the values are truncated to fit the range 0 to 4096. This step 250, as well as the background illumination uniformization step 248, makes the software less sensitive to hardware modifications and tuning. By way of example and not limitation, the signal gain in the detection circuitry, such as top detector 158 (FIG. 18), may change without significantly affecting the resultant cell counts.

As shown in FIG. 21, a filtering step 252 is next performed. For each point P in the standard rectangle, the number of points in the neighborhood of P, with dimensions smaller than indicated in step 248, with values sufficiently distinct from Vbackground is calculated. The points calculated should approximate the size of a cell in the image. If this number is large enough, the value at P remains as it was; otherwise it is assigned to Vbackground. This filtering operation is performed to remove noise, and in the optimal case only cells remain in the image while the background is uniformly equal Vbackground.

An optional step 254 directed to removing bad components may be performed as indicated in FIG. 21. Defects such as scratches, bubbles, dirt, and other similar irregularities may pass through filtering step 252. These defects may cause cell counting errors either directly or by affecting the overall distribution in the images histogram. Typically, these defects are sufficiently larger in size than cells and can be removed in step 254 as follows. First a binary image with the same dimensions as the selected region is formed. A in the binary image is defined as white, if the value at the corresponding point of the original image is equal to Vbackground, and black otherwise. Next, connected components of black points are extracted. Then subsequent erosion and expansion are applied to regularize the view of components. And finally, components that are larger than a defined threshold are removed. In one embodiment of this optional step, the component is removed from the original image by assigning the corresponding sample points in the original image with the value Vbackground. The threshold that determines which components constitute countable objects and which are to be removed is a user-defined value. This threshold may also vary depending on the investigational feature being counted i.e. white blood cells, red blood cells, or other biological matter. After optional step 254, steps 248, 250, and 252 are preferably repeated.

The next principal processing step shown in FIG. 21 is step 256, which is directed to counting cells by bright centers. The counting step 256 consists of several substeps. The first of these substeps includes performing a convolution. In this convolution substep, an auxiliary array referred to as a convolved picture is formed. The value of the convolved picture at point P is the result of integration of a picture after filtering in the circular neighborhood of P. More precisely, for one specific embodiment, the function that is integrated, is the function that equals v−2000 when v is greater than 2000 and 0 when v is less than or equal to 2000. The next substep performed in counting step 256 is finding the local maxima of the convolved picture in the neighborhood of a radius about the size of a cell. Next, duplicate local maxima with the same value in a closed neighborhood of each other are avoided. In the last substep in counting step 256, the remaining local maxima are declared to mark cells.

In some hardware configurations, some cells may appear without bright centers. In these instances, only a dark rim is visible and the following two optional steps 258 and 260 are useful.

Step 258 is directed to removing found cells from the picture. In step 258, the circular region around the center of each found cell is filled with the value 2000 so that the cells with both bright centers and dark rims would not be found twice.

Step 260 is directed to counting additional cells by dark rims. Two transforms are made with the image after step 258. In the first substep of this routine, substep (a), the value v at each point is replaced with (2000−v) and if the result is negative it is replaced with zero. In substep (b), the resulting picture is then convolved with a ring of inner radius R1 and outer radius R2. R1 and R2 are, respectively, the minimal and the maximal expected radius of a cell, the ring being shifted, subsequently, in substep (d) to the left, right, up and down. In substep (c), the results of four shifts are summed. After this transform, the image of a dark rim cell looks like a four petal flower. Finally in substep (d), maxima of the function obtained in substep (c) are found in a manner to that employed in counting step 256. They are declared to mark cells omitted in step 256.

After counting step 256, or after counting step 260 when optionally employed, the last principal step illustrated in FIG. 21 is a results output step 262. The number of cells found in the standard rectangle is displayed on the monitor 114 shown in FIGS. 1 and 5, and each cell identified is marked with a cross on the displayed optical bio-disc-derived image.

On-Disc Biological and Chemical Assays

The following discussion is directed to the biological and chemical applications for which the invention is useful. In sequencing applications, a sequence of nucleotide bases within the DNA sample can be determined by detecting which probes have the DNA sample bound thereto. In diagnostic applications, a genomic sample from an individual is screened against a predetermined set of probes to determine if the individual has a disease or a genetic disposition to a disease.

This invention combines microfluidic technology with genomics and proteomics on an optical bio-disc to detect investigational features in a test sample. Referring to FIGS. 22A, 22B, 22C, and 22D, an aqueous test sample 352 is placed on or within an optical bio-disc 350 and is driven through micro-channels 354 across a specially prepared surface 356 to effectuate the desired tests. Capillary action, pressure applied with an external applicator, and/or centrifugal force (i.e., the force on a body in curvilinear motion directed away from the center or curvature or axis of rotation) act upon the test sample to achieve contact with capture probes 358. Nucleic acid probe technology has application in detection of genetic mutations and related mechanisms, cancer screening, determining drug toxicity levels, detection of genetic disorders, detection of infectious disease, and genetic fingerprinting.

Additionally, the invention is adapted for use in a mixed phase system to perform hybridization assays. Referring to FIGS. 23A, 23B, 23C, and 23D, a mixed phase assay involves performing hybridizations on a solid phase such as a thin nylon or nitrocellulose membrane 362. For example, the assays usually involve spin-coating a thin layer of nitrocellulose 362 onto the substrate 364 of a bio-disc 360, using a pipette 366 or similar device to load the membrane with a sample 368, denaturing the DNA or creating single stranded molecules 370, fixing the DNA or RNA to the membrane, and saturating the remaining membrane attachment sites with heterologous nucleic acids and/or proteins 372 to prevent the analytes and reporters from adhering to the membrane in a non-specific manner. In an advantageous embodiment, all of these steps are carried out before performing the actual hybridization. Subsequent steps are then performed to achieve hybridization and locate reporter beads in the capture areas or target zones. The incident beam is then utilized to detect the reporters as discussed in reference to FIG. 22.

Optical bio-discs are useful for experimental analysis and assays in the areas of genetics and proteomics in applications as diverse as pharmaco-genomics, gene expression, compound screening, toxicology, forensic investigation, Single Nucleotide Polymorphism (SNPs) analysis, Short Tandem Repeats (STRs), and clinical/molecular diagnostics.

Reporters

Many chemical, biochemical, and biological assays rely upon inducing a change in the optical properties of the particular sample being tested. Such a change may occur upon detection of the investigational feature itself (e.g., blood cells), or upon detection of a reporter. In the case where investigational features are too small to be detected by the read beam of the optical disc drive, reporters having a selective affinity (i.e., a tendency to react or combine with atoms or compounds of different chemical constitution for the investigational features within the test sample) for the investigational feature to facilitate detection. The reporter will react, combine, or otherwise bind to the investigational feature, thereby causing a detectable color, chemiluminescent, luminescent, or other identifiable label into the investigational feature.

Luminescence is formally divided into two categories, fluorescence and phosphorescence, depending on the nature of the excited state. A luminescent molecule has the ability to absorb photons of energy at one wavelength and subsequently emit the energy at another wavelength. Luminescence is caused by incident radiation impinging upon or exciting an electron of a molecule. The electron absorbs the incident radiation and is raised from a lower quantum energy level to a higher one. The excess energy is released as photons of light as the electron returns to the lower, ground-state energy level. Since each reporter has its own luminescent character, more than one labeled molecule, each tagged with a different reporter, can be used at the same time to detect two or more investigational features within the same test sample.

In addition to luminescence, techniques such as color staining using an enzyme-linked immunosorbent assay (ELISA) and gold labeling can be used to alter the optical properties of biological antigen material. For example, in order to test for the presence of an antibody in a blood sample, possibly indicating a viral infection, an ELISA can be carried out which produces a visible colored deposit if the antibody is present. Referring to FIGS. 24A, 24B, 24C, 24D, 24E, and 24F, an ELISA makes use of a surface 380 that is coated with an antigen 382 specific to the antibody 384 to be tested for. Upon exposure of the surface to the blood sample 386, antibodies in the sample bind to the antigens. Subsequent staining of the surface with specific enzyme-conjugated antibodies 388 and reaction of the enzyme with a substrate produces a precipitate 390 that correlates with the level of antigen binding and hence allows the presence of antibodies in the sample to be identified by the optical disc drive. This precipitate is then detected by the incident beam. Further details relating to use of precipitates as a reporting mechanism are disclosed in U.S. Provisional Application No. 60/292,110 entitled "Surface Assembly for Immobilizing DNA Capture Probes Using Pellets as Reporters in Genetic Assays Including Optical Bio-Discs and Methods Relating Thereto" filed May 18, 2001 and U.S. Provisional Application No. 60/313,917 entitled "Surface Assembly for Immobilizing DNA Capture Probes in Genetic Assays Using Enzymatic Reactions to Generate Signal in Optical Bio-Discs and Methods Relating Thereto" filed Aug. 21, 2001, both of which are herein incorporated by reference.

Figure 25:
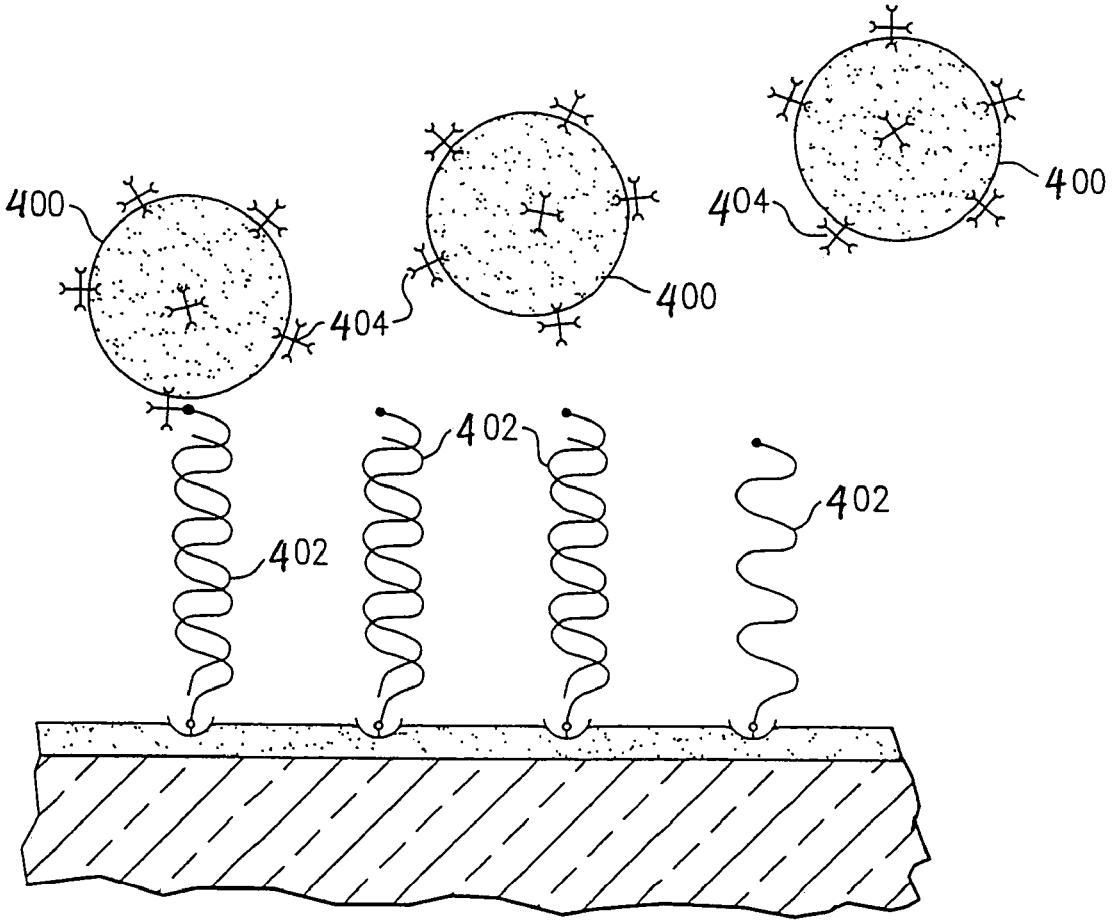
FIG. 25 is a detailed partial cross-sectional view of the surface of a bio-disc showing reporter beads having specific affinity for antigens bound to the surface.
Figures 26A, 26B, 26C, 26D:
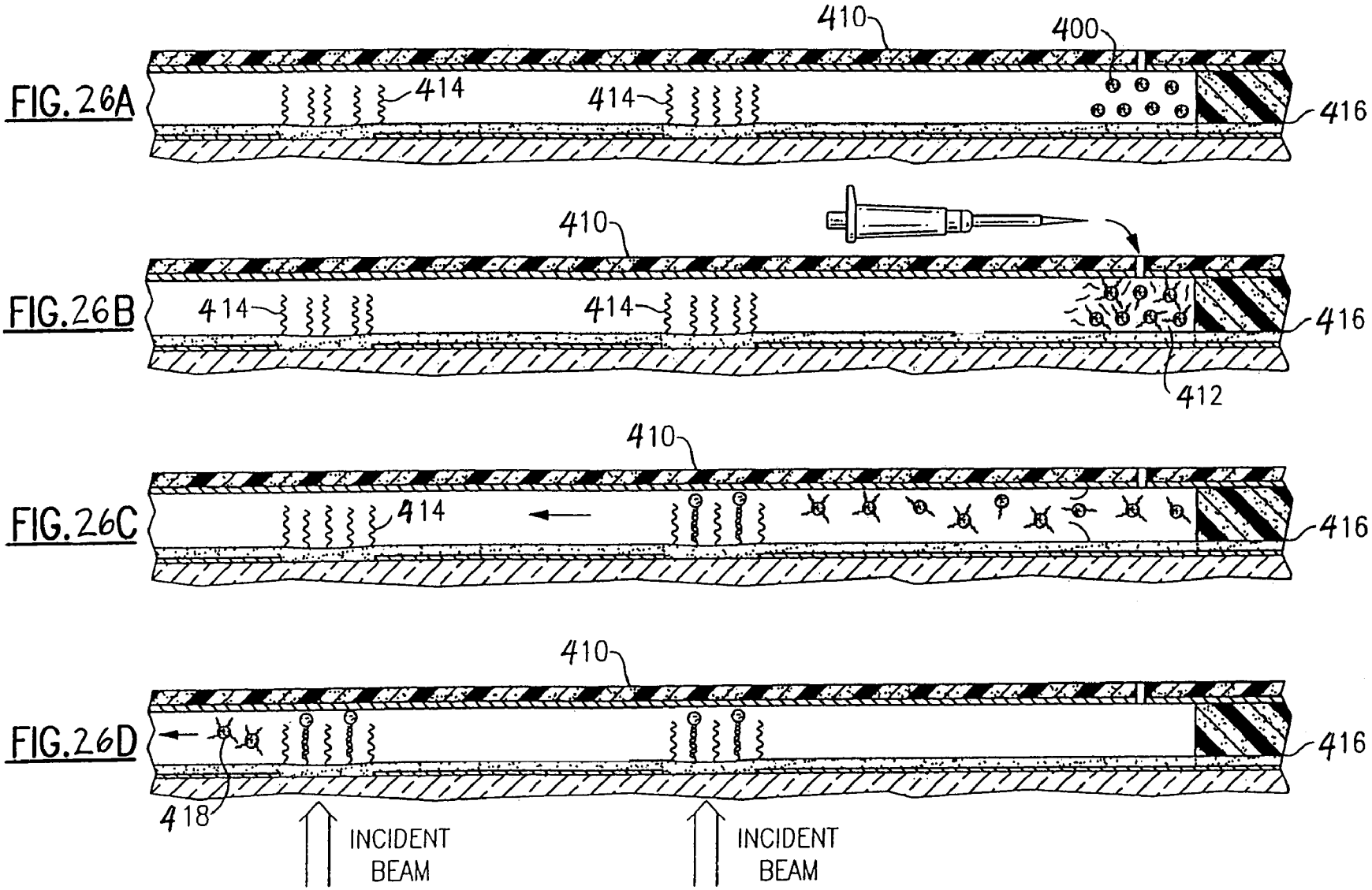
FIGS. 26A, 26B, 26C, and 26D are cross-sectional side views of an optical bio-disc showing a method of using reporter beads to detect investigational features in a test sample.

Referring to FIG. 25, bead-based assays involve use of spherical micro-particles, or beads 400 to alter the optical properties of biological antigen material 402. The beads 400 are coated with a chemical layer 404 having a specific affinity for the investigational feature in a test sample. Referring to FIGS. 26A, 26B, 26C, and 26D, when a test sample is loaded into or onto an optical disc 410 containing reporter beads 400 (FIG. 25), the investigational feature 412, if present, binds to the reporter beads 400. Investigational feature 412 further binds to specific capture agents 414 on the surface 416 of the optical disc 410. In this way, if the investigational feature is present in the biological solution, it becomes a binding agent to bind bead reporters 400 to capture agents 414 on the surface 416 of the bio-disc 410. When the bio-disc is spun in the optical disc drive, the resulting centrifugal force sends unbound bead reporters 418 to an outer periphery of the disc, while bound bead reporters remain distributed over the area of the disc coated with the capture agent. The bound beads can be detected and quantified using an optical disc reader. Related dual bead assays are further disclosed in commonly assigned, co-pending U.S. patent application Ser. No. 09/997,741 entitled "Dual Bead Assays Including Optical Biodiscs and Methods Relating Thereto" filed Nov. 27, 2001, which is incorporated herein by reference.

Reporters useful in the invention include, but are not limited to, synthetic or biologically produced nucleic acid sequences, synthetic or biologically produced ligand-binding amino acids sequences, products of enzymatic reactions, and plastic micro-spheres or beads made of, for example, latex, polystyrene or colloidal gold particles with coatings of bio-molecules that have an affinity for a given material such as a biotin molecule in a strand of DNA. Appropriate coatings include those made from streptavidin or neutravidin, for example. These beads are selected in size so that the read or interrogation beam of the optical disc drive can "see" or detect a change of surface reflectivity caused by the particles.

Figure 27:
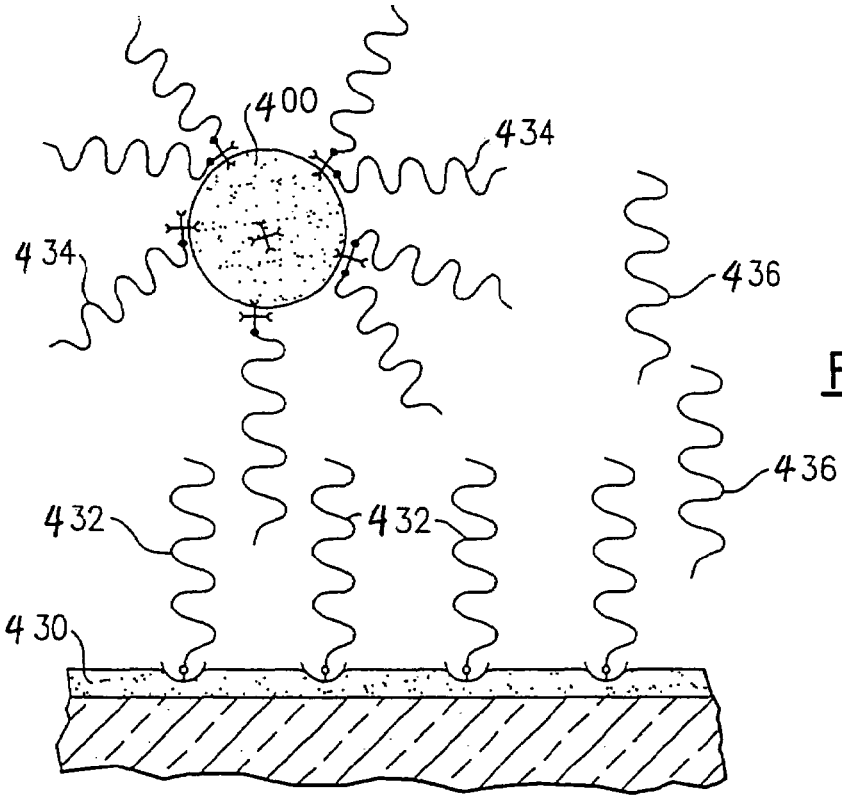
FIG. 27 is a detailed partial cross-sectional view of the surface of a bio-disc showing use of reporter beads, capture probes, and signal probes to detect investigational features in a test sample.
Figure 28:
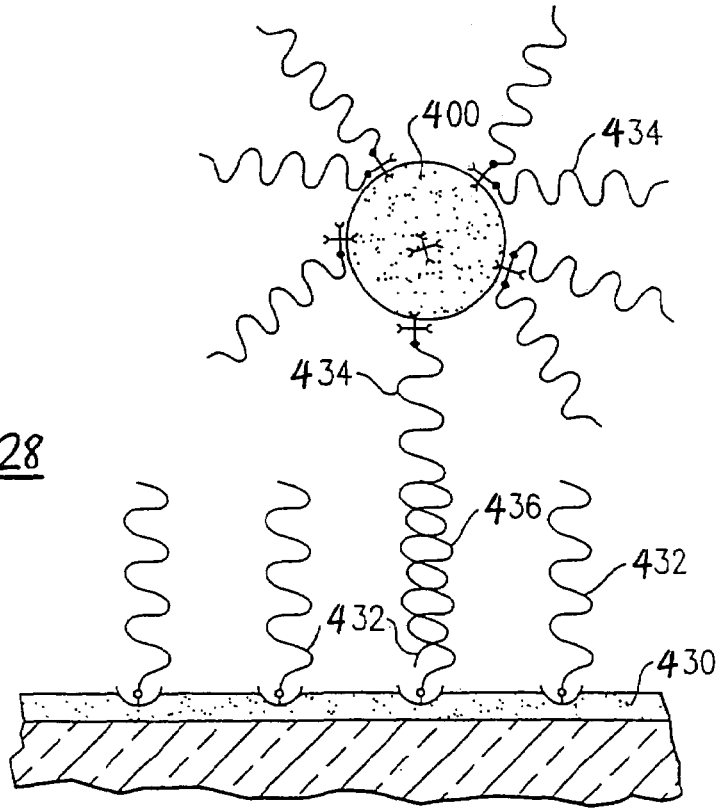
FIG. 28 is view similar to FIG. 27, showing hybridization of the investigational feature to the capture and signal probes.

In some embodiments associated with the invention, reporter beads are bound to the disc surface through DNA hybridization. Referring to FIGS. 27 and 28, a capture probe 432 is attached to the disc surface 430, while a signal probe 434 is attached to reporter beads 400 (FIG. 25). In the case of a hybridization assay, both of the probes are complementary to the target sequence 436. In the presence of target sequence 436, both capture and signal probes hybridize with the target. In this manner, beads 400 are attached to disc surface 430. In a subsequent centrifugation (or wash) step, all unbound beads are removed. Alternatively, the target itself is directly bound or linked to the beads without the presence of an extra signaling probe.

Figure 29:
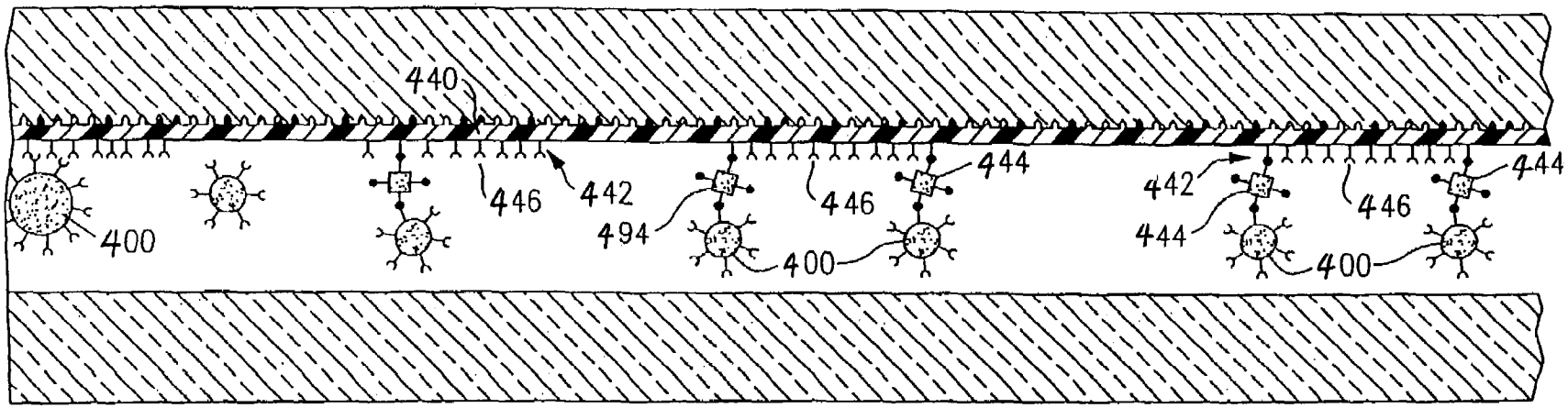
FIG. 29 is a cross-sectional side view of a bio-disc showing use of antibody-coated capture zones to detect analytes of interest in a test sample.

Referring to FIG. 29, in the case of an immunoassay, the disc surface 440 is coated with a receptor 442 (e.g., antibody), which specifically binds to the analyte of interest 444 (e.g., investigational feature). The capture zones 446 for each specific analyte to be assayed could be separated in the analysis field of the disc. If an analyte 444 (antigen or antibody) is captured by the receptor 442 (antibody or antigen, respectively), present on the capture zone 446, then a signal generation combination specific for the analyte can be used to quantify the presence of the analyte.

Alternatively, an investigational feature, if of adequate size for detection by the incident beam of an optical disc drive, may not require a reporter. Certain chemical reactions and the products and by-products resulting therefrom (i.e., precipitates), induce a sufficient change in the optical properties of the biological sample being tested. Such a change may also occur upon detection of the investigation feature itself, such as is the case when the invention is used to create an image of a microscopic structure. The optical disc drive detects changes in the optical properties of the surface of the bio-disc and creates images based thereon.

In a particular embodiment of the invention, an optical disc system (e.g., FIG. 10) includes a signal processing system and a photo detector circuit (e.g., 158 of FIG. 12) of an optical disc drive configured to generate at least one information-carrying signal (e.g., the HF, TE, or FE signals) from an optical disc assembly (e.g., disc 110 of FIG. 10). The signal processing system is coupled to the photo detector 158 to obtain from the at least one information-carrying signal both operational used to operate the optical disc system and indicia data (e.g., traces in FIG. 19B) indicative of a presence of an investigational feature associated with the optical disc assembly.

In a variant of the invention, the signal processing system of the optical disc system includes a PC and an analog-to-digital converter to provide a digitized signal to the PC. The analog-to-digital converter is coupled between the at least one information carrying signal and the PC. The PC includes a program module to detect and characterize peaks (e.g., see traces in FIG. 19B) in the digitized signal. Preferably, the PC further includes another program module to detect and count double peaks (e.g., see traces in FIG. 19B) in the digitized signal.

In another variant of the invention, the signal processing system of the optical disc system includes a PC, an analog-to-digital converter to provide a digitized signal to the PC, and an analyzer coupled between an analog-to-digital converter and a PC. The analog-to-digital converter is coupled between the at least one information carrying signal and the PC. The analyzer includes logic to detect and characterize peaks in the digitized signal. Preferably, the analyzer further includes logic to detect and count double peaks in the digitized signal.

In still another variant of the invention, the signal processing system of the optical disc system includes a PC and an analog-to-digital converter to provide a digitized signal to the PC. The analog-to-digital converter is coupled between the at least one information carrying signal and the PC. The signal processing system further includes an audio processing module coupled between the at least one information-carrying signal and the analog-to-digital converter. Preferably, the optical disc assembly is pre-recorded with a predetermined sound, and the PC includes a program module to detect the indicia data in a deviation of the at least one information carrying signal from the predetermined sound when the investigational feature is present. In an alternative variant, the predetermined sound is encoded silence.

In still yet another variant of the invention, the signal processing system of the optical disc system includes a PC and an analog-to-digital converter to provide a digitized signal to the PC. The analog-to-digital converter is coupled between the at least one information carrying signal and the PC. The signal processing system further includes an external buffer amplifier coupled between the at least one information-carrying signal and the analog-to-digital converter.

In a further variant of the invention, the signal processing system of the optical disc system includes a PC and an analog-to-digital converter to provide a digitized signal to the PC. The analog-to-digital converter is coupled between the at least one information carrying signal and the PC. The signal processing system further includes a trigger detection circuit coupled to the analog-to-digital converter. The trigger detection circuit is operative to detect a particular time in relation to a time when the indicia data is present in the at least one information-carrying signal.

In an alternative embodiment, the signal processing system includes a programmable digital signal processor selectively configurable to either (1) extract the operational information from the at least one information-carrying signal while in a first configuration or (2) operate as an analog-to-digital converter to provide the indicia data while in a second configuration.

In another alternative embodiment, the signal processing system of the optical disc system includes a PC, a programmable digital signal processor coupled to the at least one information-carrying signal, and an analyzer coupled between the programmable digital signal processor and the PC.

In yet another alternative embodiment, the signal processing system of the optical disc system includes a trigger detection circuit that detects a time period during which the investigational feature associated with the optical disc assembly is scanned by the photo detector circuit.

In a further alternative embodiment, the signal processing system of the optical disc system includes a trigger detection circuit that detects a particular time in relation to a time when the indicia data is present in the at least one information-carrying signal. The time when the indicia data is present in the at least one information-carrying signal occurs periodically. The particular time is either (1) a predetermined time in advance of, (2) a time at, or (3) a predetermined time after each time the indicia data either begins to be present or ends in the at least one information-carrying signal.

In still yet another alternative embodiment, the signal processing system of the optical disc system includes a PC, and an audio processing module coupled between the PC and the at least one information-carrying signal. Preferably, the sound processing module is either an external module independent of the optical disc drive, a drive module that is a part of the optical disc drive, or a modified drive module that is a part of the optical disc drive. In a variant of this embodiment, the PC includes a processor coupled to the sound module, and a software module stored in a memory to control the processor to extract the indicia data from sound data.

In yet a further alternative embodiment, the photo detector circuit of the optical disc system includes circuitry to generate an analog signal as the at least one information-carrying signal. The analog signal includes either a high frequency signal from a photo detector, a tracking error signal, a focus error signal, an automatic gain control setting, a push-pull tracking signal, a CD tracking signal, a CD-R tracking signal, a focus signal, a differential phase detector signal, a laser power monitor signal or a sound signal.

In another embodiment, the optical disc system further includes the optical disc assembly (e.g., 110 of FIG. 10). The optical disc assembly has the associated investigational feature disposed on the assembly in a first disc sector and has the operational information used to operate the optical disc drive encoded on the assembly in a remaining disc sector.

In a variant, the optical disc assembly includes a trigger mark (e.g., 126 of FIG. 10) that is disposed on the optical disc assembly in a predetermined position relative to the first disc sector. The signal processing system further includes a trigger detection circuit (e.g., 158 of FIG. 10) that detects the trigger mark. Preferably, the trigger detection circuit detects the trigger mark periodically and detects the trigger mark either (1) a predetermined time in advance of, (2) a time at, or (3) a predetermined time after a time when the associated investigational feature is read by the photo detector circuit based on the predetermined position of the trigger mark relative to the first disc sector.

In a variant, the associated investigational feature of the optical disc assembly includes either plastic micro-spheres with a bio-molecule coating, colloidal gold beads with a bio-molecule coating, silica beads, glass beads, magnetic beads, or fluorescent beads.

In another embodiment of the invention, there is provided a method that includes the steps of depositing a test sample, spinning the optical disc, directing an incident beam, detecting a return beam, processing the detected return beam, and processing the detected return beam. The step of depositing a test sample includes depositing the sample at a predetermined location on an optical disc assembly. The step of spinning the optical disc includes spinning the assembly in an optical disc drive. The step of directing an incident beam includes directing the beam onto the optical disc assembly. The step of detecting a return beam includes detecting the return beam formed as a result of the incident beam interacting with the test sample. The step of processing the detected return beam processes the detected return beam to acquire information about an investigational feature associated with the test sample.

In a variant of this embodiment, the step of detecting a return beam forms a plurality of analog signals. The step of processing the detected return beam includes summing a first subset of the plurality of analog signals to produce a sum signal, combining either the first subset or a second subset of the plurality of analog signals to produce a tracking error signal, obtaining information used to operate an optical disc drive from the tracking error signal, and converting the sum signal to a digitized signal.

In another embodiment of the invention, the invention is a method that includes steps of acquiring a plurality of analog signals, summing a first subset, combining a second subset, obtaining information, and converting the sum signal to a digitized signal. The step of acquiring a plurality of analog signals acquires analog signals from an optical disc assembly using a plurality of photo detectors. The step of summing a first subset sums a first subset of the plurality of analog signals to produce a sum signal. The step of combining a second subset combines a second subset of the plurality of analog signals to produce a tracking error signal. The step of obtaining information obtains information used to operate an optical disc drive from the tracking error signal.

In a variant, the steps of acquiring and summing produce the sum signal that includes perturbations indicative of an investigational feature located at a location of the optical disc assembly.

In another variant, the method further includes a step of characterizing the investigational feature based on the digitized signal.

In another variant of the method, the step of converting includes configuring a portion of an optical disc drive chip set to operate as an analog-to-digital converter. Preferably, the step of configuring includes programming a digital signal processing chip within the optical disc drive chip set to operate as an analog-to-digital converter. Preferably, the digital signal processing chip includes a normalization function, an analog-to-digital converter function, a demodulation/decode function, and an output interface function. Preferably, the step of configuring further includes passing the sum signal around the demodulation/decode function by creating a path from the analog-to-digital converter function to the output interface function. Preferably, the step of configuring further includes deactivating the demodulation/decode function.

In another variant of the method, the step of converting includes configuring a digital signal processing chip that includes a normalization function, an analog-to-digital converter function, a demodulation/decode function, and an output interface function, and the step of configuring includes creating a path from the analog-to-digital converter function to the output interface function so that the sum signal is unprocessed by the demodulation/decode function. Preferably, the step of configuring includes deactivating the demodulation/decode function.

In yet another embodiment of the invention, a method includes steps of adapting a portion of a signal processing system, acquiring a plurality on analog signals, converting the analog signals, and characterizing investigational features based on a digitized signal. The step of adapting a portion of a signal processing system includes adapting the portion to operate as an analog-to-digital converter. The step of acquiring a plurality on analog signals acquires the analog signals from a photo detector circuit of an optical disc drive. The plurality of analog signals includes information that is indicative of investigational features on an optical disc assembly. The step of converting the analog signals converts the analog signals into a digitized signal with the signal processing system. Preferably, the step of adapting includes programming a digital signal processing chip within the signal processing system to operate as the analog-to-digital converter.

In another alternative embodiment of the invention, a method includes steps of receiving and converting. The step of receiving includes receiving each of at least one analog signal at a corresponding input of signal processing circuitry. The at least one analog signal has been provided by at least one corresponding photo detector element that detects light returned from a surface of an optical disc assembly. The step of converting includes converting each of the at least one analog signal into a corresponding digitized signal. Each digitized signal is substantially proportional to an intensity of the returned light detected by a corresponding one of the at least one photo detector element.

In a variant of this embodiment, the step of converting includes operating the signal processing circuitry to bypass any demodulation of a first digitized signal. Preferably, the step of converting further includes operating the signal processing circuitry to bypass any decoding of the first digitized signal, and operating the signal processing circuitry to bypass any checking for errors in the first digitized signal.

In another variant of this embodiment, the step of converting includes operating the signal processing circuitry to bypass any decoding of a first digitized signal.

In yet another variant of this embodiment, the step of converting includes operating the signal processing circuitry to bypass any checking for errors in a first digitized signal.

In still another variant of this embodiment, the method further includes a step of combining at least two of the at least one analog signal. Preferably, the step of combining is a step selected from a group consisting of adding, subtracting, dividing, multiplying, and a combination thereof. Preferably, the step of combining is performed before the step of converting. Alternatively, the step of combining may be performed after the step of converting.

In a further variant, the method further includes a step of supplying a first digitized signal of the at least one digitized signal at an output interface of the signal processing circuitry after the step of converting without substantially modifying the first digitized signal between the steps of converting and supplying. Preferably, the signal processing circuitry includes a digital signal processor. Preferably, the signal processing circuitry consists of a digital signal processor.

The materials for use in the method of the invention are ideally suited for the preparation of a kit. Such a kit may include a carrier member being compartmentalized to receive in close confinement an optical bio-disc and one or more containers such as vials, tubes, and the like, each of the containers including a separate element to be used in the method. For example, one of the containers may include a reporter and/or protein-specific binding reagent, such as an antibody. Another container may include isolated nucleic acids, antibodies, proteins, and/or reagents described herein, known in the art or developed in the future. The constituents may be present in liquid or lyophilized form, as desired. The antibodies used in the assay kits of the invention may be monoclonal or polyclonal antibodies. For convenience, one may also provide the reporter affixed to the substrate of the bio-disc. Additionally, the reporters may further be combined with an indicator, (e.g., a radioactive label or an enzyme) useful in assays developed in the future. A typical kit also includes a set of instructions for any or all of the methods described herein.

In a variant of this embodiment, the carrier may be further compartmentalized to include a setup optical disc containing software for configuring a computer for use with the bio-disc. Optionally, the kit may be packaged with a modified optical disc drive. For example, the kit may be sold for educational purposes as an alternative to the common microscope.

Bio-Discs with Equi-Radial Analysis Zones

Alternative embodiments of the bio-disc according to the invention will now be described with reference to FIGS. 30 to 35. Various features of the discs of these latter embodiments have been already illustrated with reference to FIGS. 1 to 21, and therefore such common features will not be described again in the following. Accordingly, and for the sake of simplicity, as a general rule in FIGS. 30 to 35 only the features differentiating the bio-disc 110 from those of FIGS. 1 to 21 are represented.

Furthermore, the following description of the bio-disc 110 of the invention can be readily applied to the transmissive-type as well as to the reflective-type optical bio-disc described above in conjunction with FIGS. 2-9.

Figure 30:
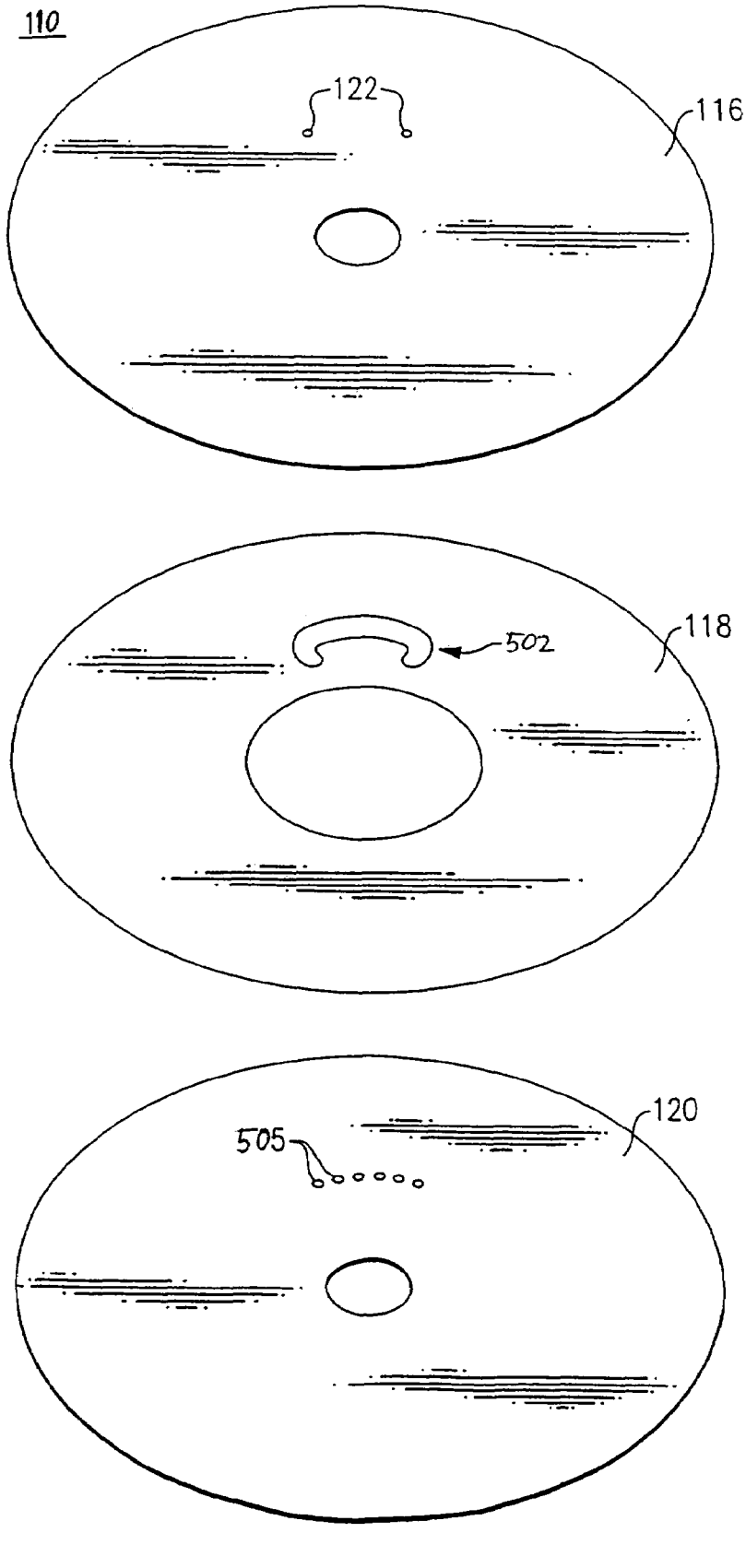
FIG. 30 is an exploded perspective view of an embodiment of bio-disc according to the invention.

Referring to FIG. 30 there is shown an exploded perspective view of the principal structural elements of one embodiment of the optical bio-disc according to the invention, which in the present case is globally indicated by 110.

Figure 31:
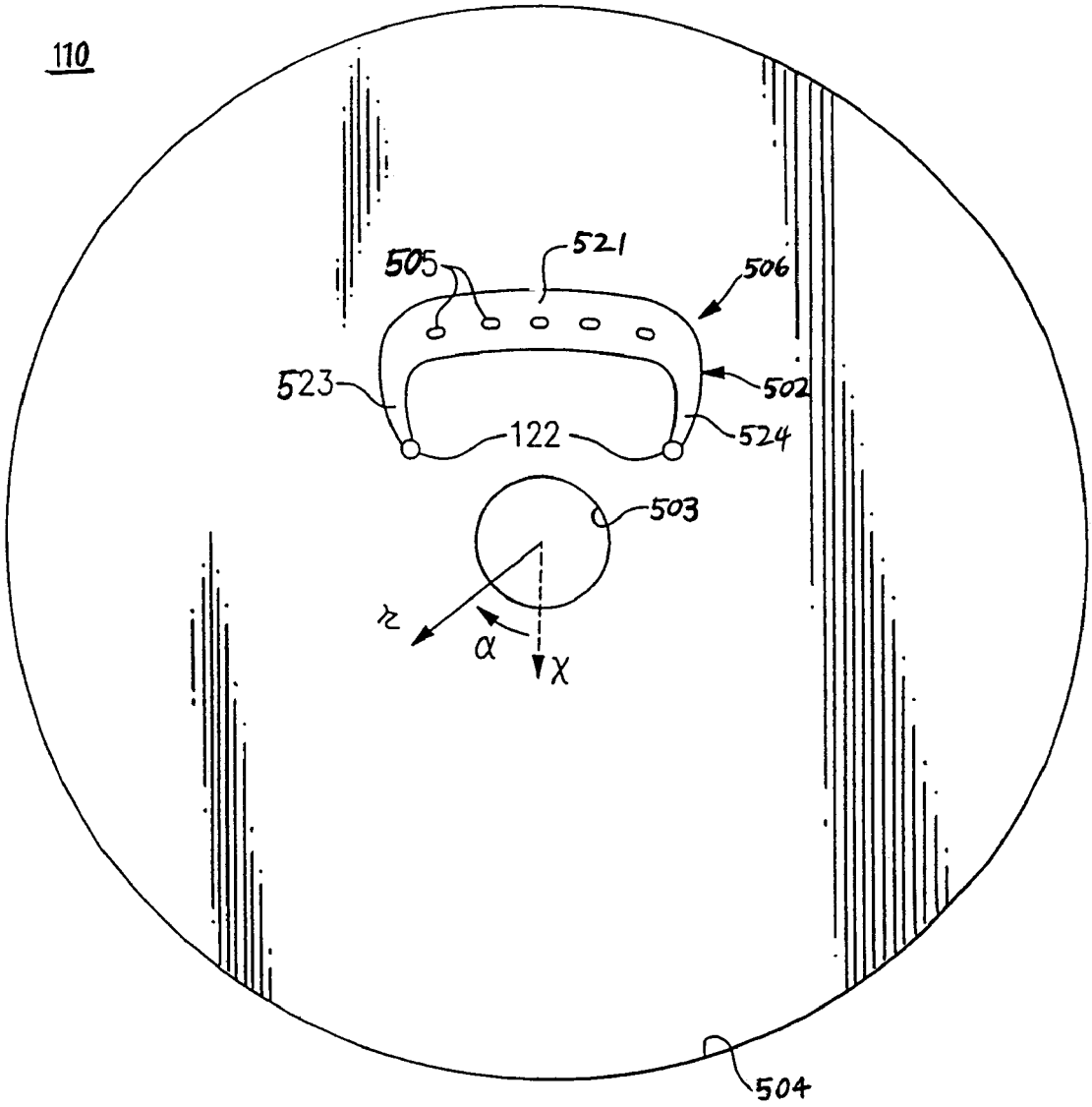
FIG. 31 is a top plan view of the disc of FIG. 30.

The next figure, FIG. 31 is a top plan view of bio-disc 110, wherein a cap portion 116 thereof is represented as transparent in order to reveal internal components of disc 110 itself.

With reference to FIGS. 30 and 31, optical bio-disc 110 includes the principal structural elements already introduced with reference to the preceding figures, namely the aforementioned cap portion 116, an adhesive member or channel layer 118 and a substrate 120.

The cap portion 116 includes one or more inlet ports 122. Purely by way of example and for the sake of simplicity, in FIGS. 30 and 31 only two inlet ports 122 are shown.

The adhesive member or channel layer 118 has fluid chambers 502 formed therein, in which inspection of investigational features can be conducted and which will be described in greater detail hereinbelow. Always by way of example and for the sake of simplicity, in FIGS. 30 and 31 only one fluid chamber 502 is shown.

The substrate 120 defines a circular inner perimeter 503 and a circular outer perimeter 504, concentric with the inner perimeter 503, of bio-disc 110.

The substrate 120 includes one or more reaction sites 505. In FIGS. 30 and 31 a disc including only a single set, or array, of reaction sites 505 is shown purely by way of example and for illustrative purposes only.

One of skill in the art will understand that reaction sites 505 may be in general target or capture zones. As already illustrated with reference to FIGS. 1 to 16, such target zones may be formed by physically removing an area or portion of a reflective or semi-reflective layer of the disc at a desired location or, alternatively, by masking the desired area prior to applying the reflective or semi-reflective layer. Alternatively, as already illustrated above, in the transmissive-type disc target zones may be created by silk screening ink onto the thin semi-reflective layer or they may be defined by address information encoded on the disc 110.

Bio-disc 110 also provides, at substrate 120, a series of information tracks analogous to the tracks 170 already described with reference to the embodiments of FIGS. 1 to 21 and which are therefore not represented in FIGS. 30 and 31.

In general, information tracks are of a substantially circular profile and increase in circumference as a function of radius extending from the inner perimeter 503 to the outer perimeter 504 of disc 110, typically according to a spiral profile.

Furthermore, bio-disc 110 may provide an operational layer associated with substrate 120, which layer includes encoded information located substantially along one or more information tracks, e.g. a layer analogous to the reflective layer 142 introduced with reference to FIGS. 1 to 16.

A more detailed description of fluid chamber 502 will now be provided, with reference to FIGS. 30 and 31.

First of all, it will be understood that bio-disc 110 provides, in correspondence of fluid chamber 502, an analysis area or zone, globally indicated by 506, including investigational features.

The analysis zone addressed by the invention may include any type of reaction site(s), array(s) of spot, capture site(s) or zone(s), target zone(s), viewing window(s) and the like, and, in general, it can be any target analysis zone of whatever type, nature, and construction.

According to the general teaching of the invention, the analysis zone 506, and therefore the fluid chamber 502, has a configuration alternative to that of the embodiments described with reference to FIGS. 1 to 16. This alternative configuration is such that when an incident beam of electromagnetic energy tracks along the information tracks, any investigational features within the analysis zone 506 are thereby interrogated following a varying angular coordinate, instead of that which is along a single radius (i.e. at a fixed angular coordinate) as in the embodiments of FIGS. 1 to 21.

As it can be easily understood and as it is shown in FIG. 31, by "angular coordinate" is herewith intended the planar angle a defined, in a plan view of disc 110, between a disc reference radial axis x and the disc radial axis r corresponding to the actual radial position of an element, e.g. an investigational feature, wherein the center of the reference system is of course set at the center of disc 110 itself. Analogously, by "radial coordinate" it is herewith intended the actual position of an element, e.g. an investigational feature, along the corresponding radial axis r.

According to a preferred embodiment, the analysis zone 506 is directed substantially along the information tracks.

In the specific embodiment shown in FIGS. 30 and 31, the fluid chamber 502 is a fluidic circuit or channel having a central portion 521 extending according to a substantially circumferential profile concentric with respect to disc inner and outer perimeter 503 and 504, and two lateral arm portions 523 and 524 extending along a substantially radial direction.

Reaction sites 505 are thus distributed along the circumferential extension of the fluid channel central portion 521, i.e. substantially along an arc of circumference. Therefore, according to the invention, reaction sites 505 are not arranged along a single radius, i.e. at a single angular coordinate, as in previous embodiments, but at a varying angular coordinate at fixed radius.

Accordingly, when an incident beam of electromagnetic energy tracks along the information tracks, the investigational features within the analysis zone 506 are thereby interrogated according to a substantially circumferential path.

In the following, this circumferential arrangement will be referred to as "equi-radial (eRad)", and the disc providing it as an "eRad disc". Thus, for purposes of convenience, the terms "equi-radial", "e-radial", "e-rad", "eRad", or "circumferential" may be utilized herein interchangeably.

An issue arising from the use of eRad disc 110 is the positioning of the inlet ports 122 on disc itself. As shown in FIG. 31, it is possible to have inlet ports 122 at a different radial position with respect to the circumferential portion 521 of the corresponding channel 502. However, preferably channel central portion 521 is at a higher radial coordinate with respect to the inlet ports 122, in order to prevent the centripetal forces inducing a liquid eventually contained in the channel to escape from the ports 122.

According to a variant embodiment it would also be possible to have the channel central portion at a lower radius than the inlet ports, provided that these ports are sealed, i.e. guaranteed not to leak.

Figure 32A:
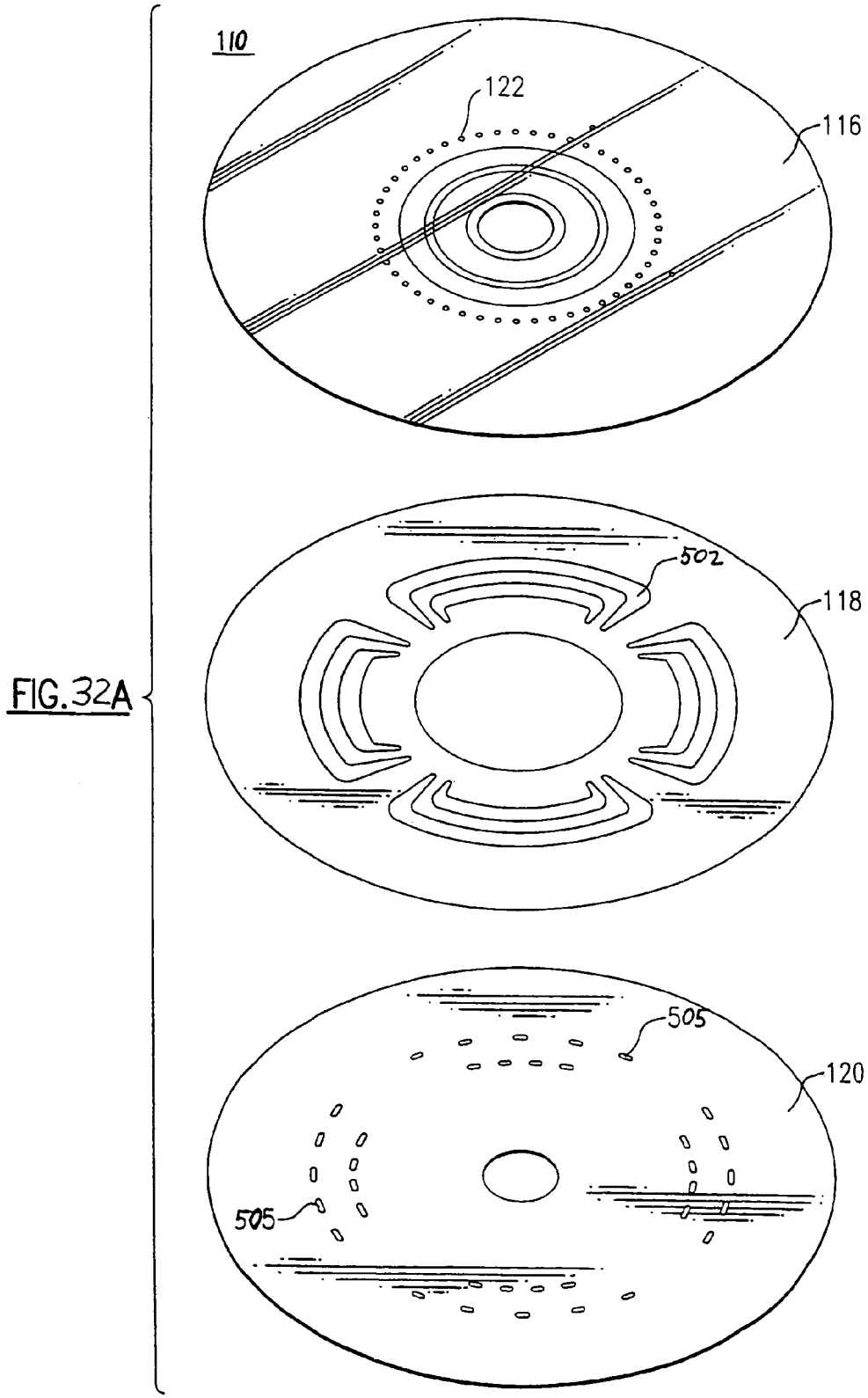
FIGS. 32A is an exploded perspective view of a reflective bio-disc incorporating the equi-radial channels of the invention.

FIG. 32A is an exploded perspective view of a reflective bio-disc incorporating the equi-radial (e-rad or eRad) or circumferential channels of the invention. This general construction corresponds to the radial-channel disc shown in FIG. 2. The e-rad implementation of the bio-disc 110 shown in FIG. 32A similarly includes the cap 116, the channel layer 118, and the substrate 120. The channel layer 118 includes the equi-radial fluid channels 502, while the substrate 120 includes the corresponding arrays of reaction sites or target zones 505.

Figure 32B:
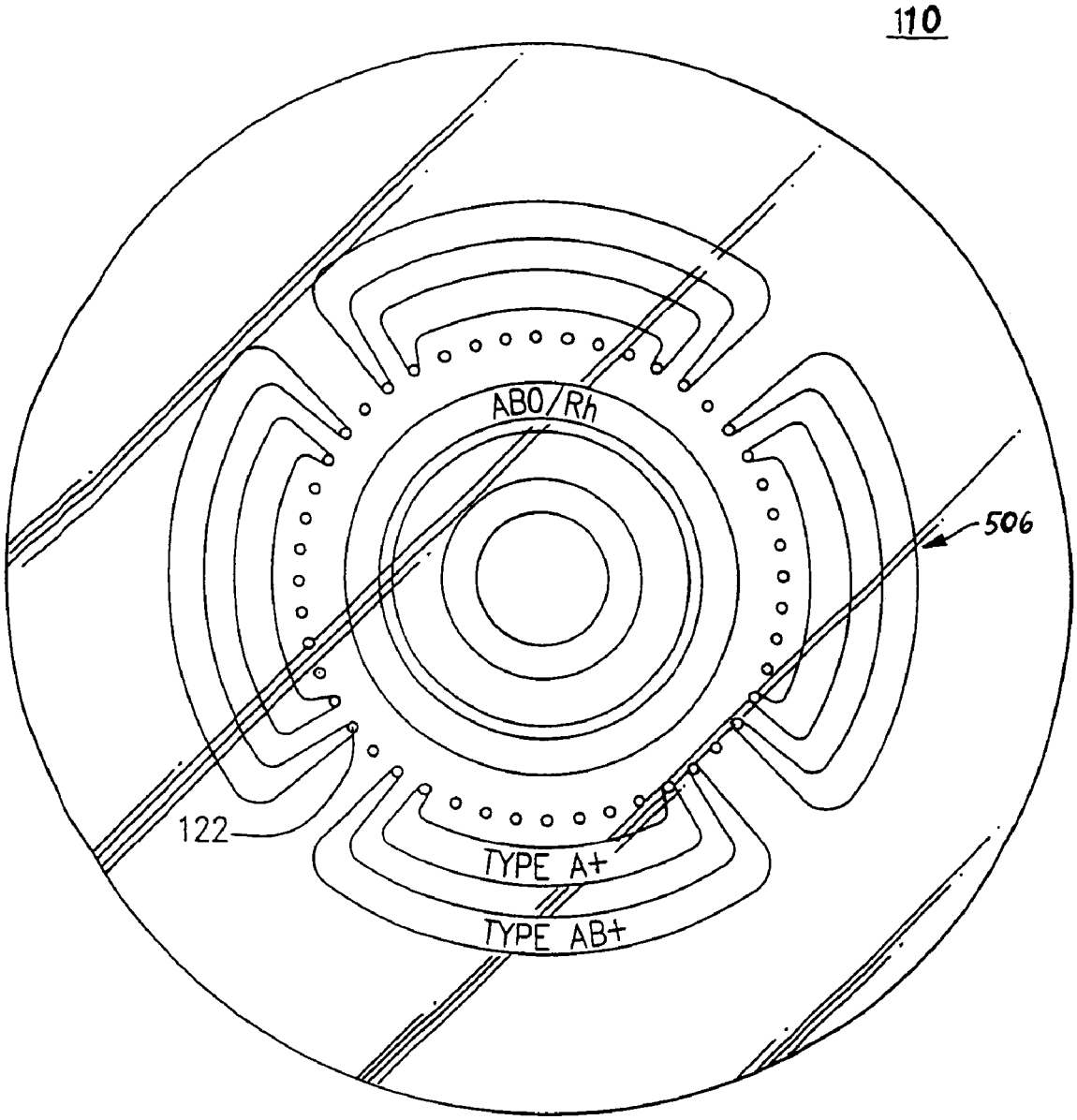
FIG. 32B is a top plan view of the disc shown in FIG. 32A.

FIG. 32B is a top plan view of the disc shown in FIG. 32A. FIG. 32B further shows a top plan view of an embodiment of the eRad disc with a transparent cap portion, which disc has two tiers of circumferential fluid channels with ABO blood type chemistry and two blood types (A+ and AB+). As shown in FIG. 32B, it is also possible to provide a priori, at the manufacturing stage of the disc of the invention, a plurality of entry ports, eventually at different radial coordinate, so that a range of equi-radial, spiraling, or radial reaction sites and/or channels are possible on one disc. These channels can be used for different test suites, or for multiple samples of single test suites.

Figure 32C:
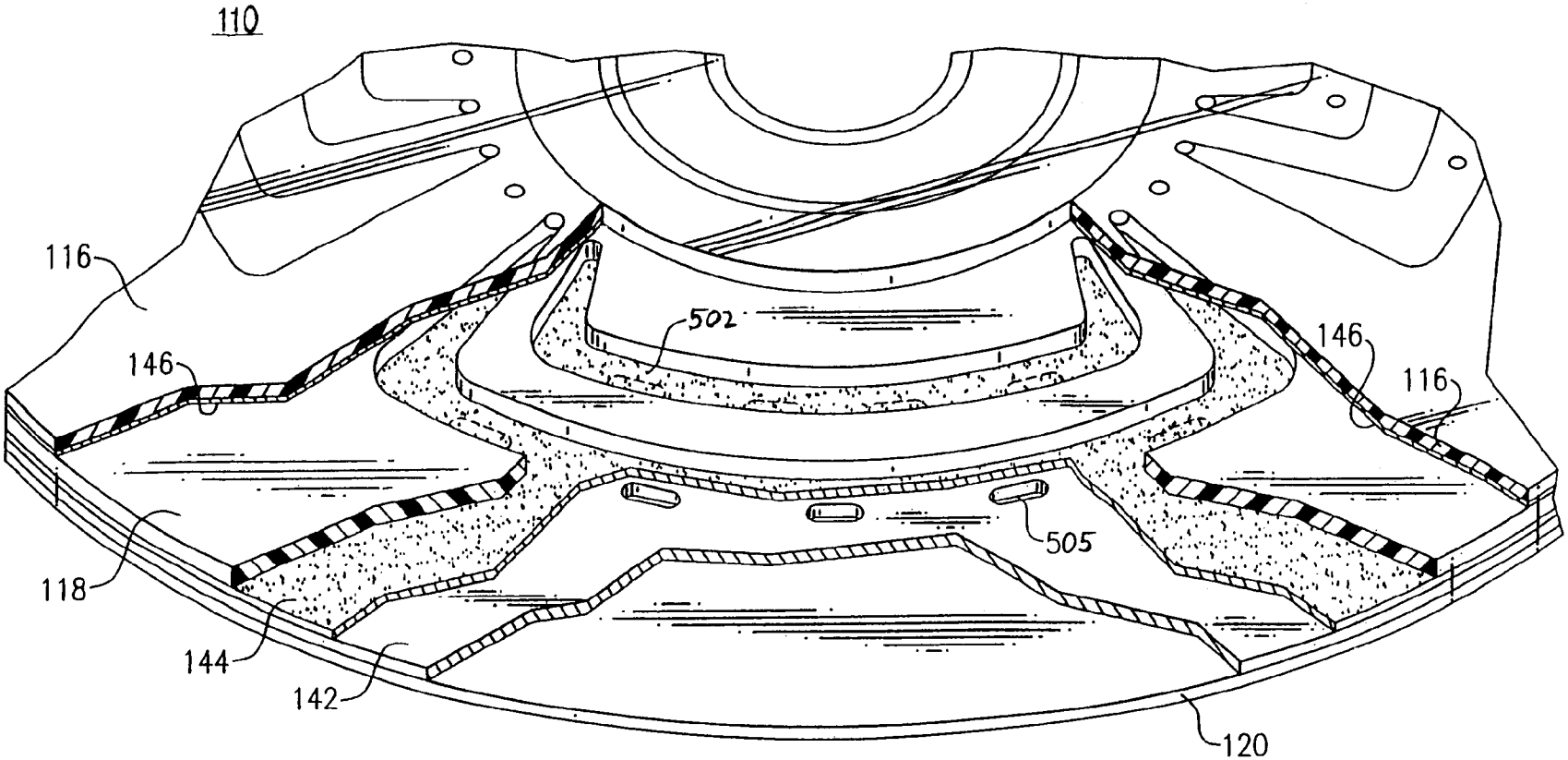
FIG. 32C is a perspective view of the disc illustrated in FIG. 32A with cut-away sections showing the different layers of the e-radial reflective disc.

FIG. 32C is a perspective view of the disc illustrated in FIG. 32A with cut-away sections showing the different layers of the e-radial reflective disc. This view is similar to the reflective disc 110 shown in FIG. 4. The e-rad implementation of the reflective bio-disc 110 shown in FIG. 32C similarly includes the reflective layer 142, active layer 144 as applied over the reflective layer 142, and the reflective layer 146 on the cap portion 116.

Figure 33A:
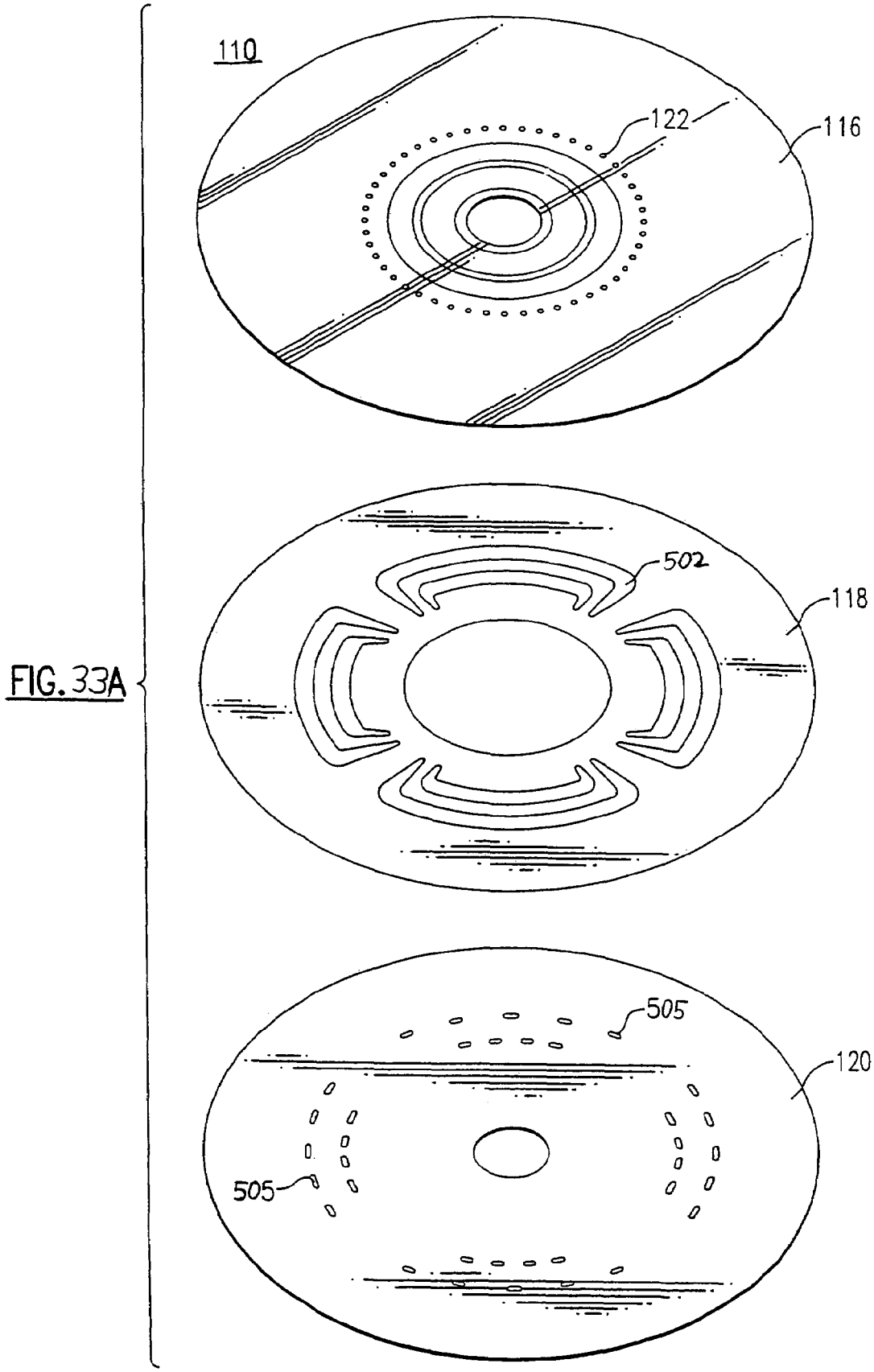
FIGS. 33A is an exploded perspective view of a transmissive bio-disc utilizing the e-radial channels of the invention.

FIGS. 33A is an exploded perspective view of a transmissive bio-disc utilizing the e-radial channels of the invention. This general construction corresponds to the radial-channel disc shown in FIG. 5. The transmissive e-rad implementation of the bio-disc 110 shown in FIG. 33A similarly includes the cap 116, the channel layer 118, and the substrate 120. The channel layer 118 includes the equi-radial fluid channels 502, while the substrate 120 includes the corresponding arrays of reaction sites 505.

Figure 33B:
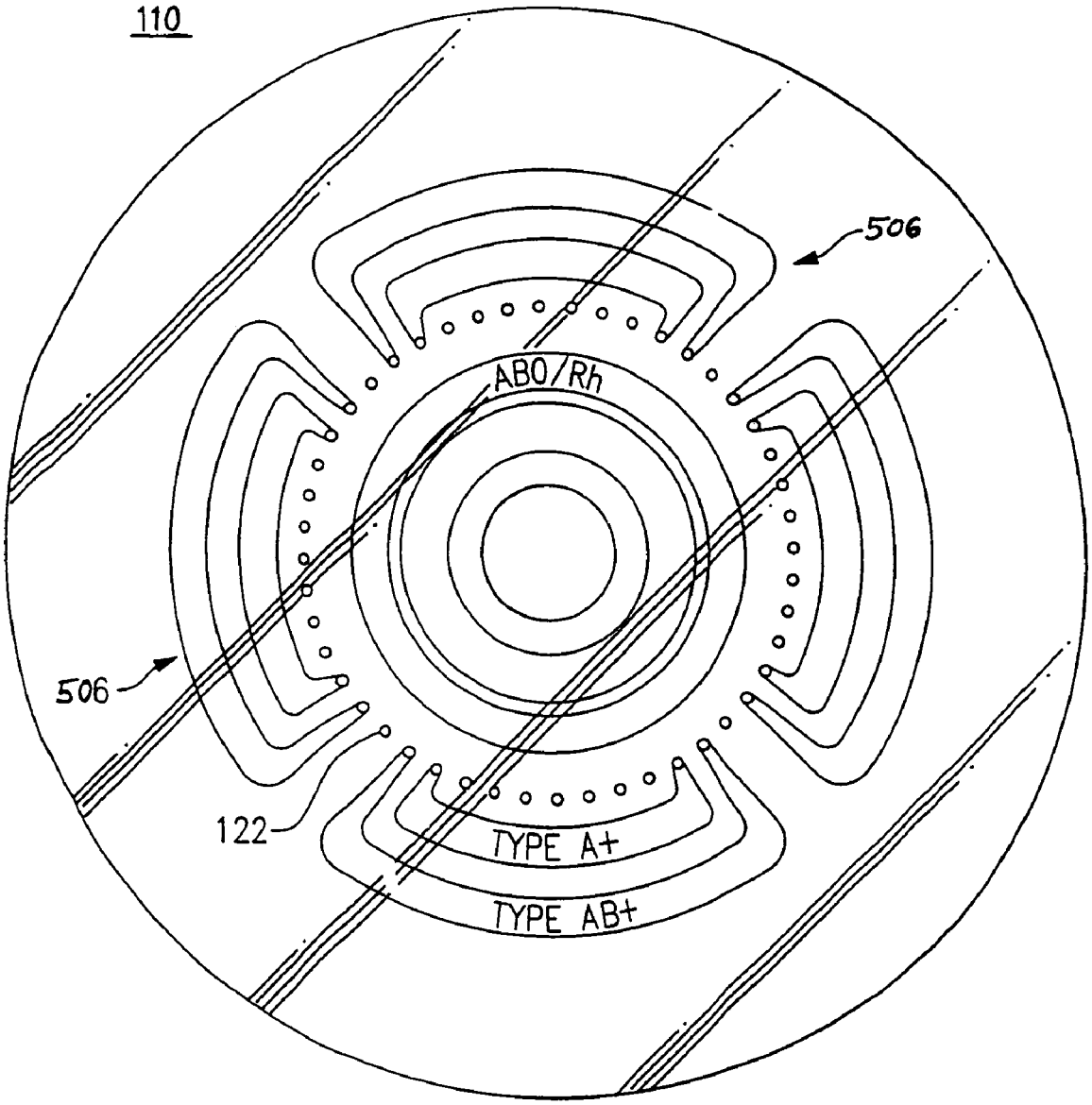
FIG. 33B is a top plan view of the disc shown in FIG. 33A.

FIG. 33B is a top plan view of the transmissive e-rad disc shown in FIG. 33A. FIG. 33B further shows two tiers of circumferential fluid channels with ABO chemistry and two blood types (A+ and AB+). As previously discussed, the assays are performed in the analysis zones 506.

Figure 33C:
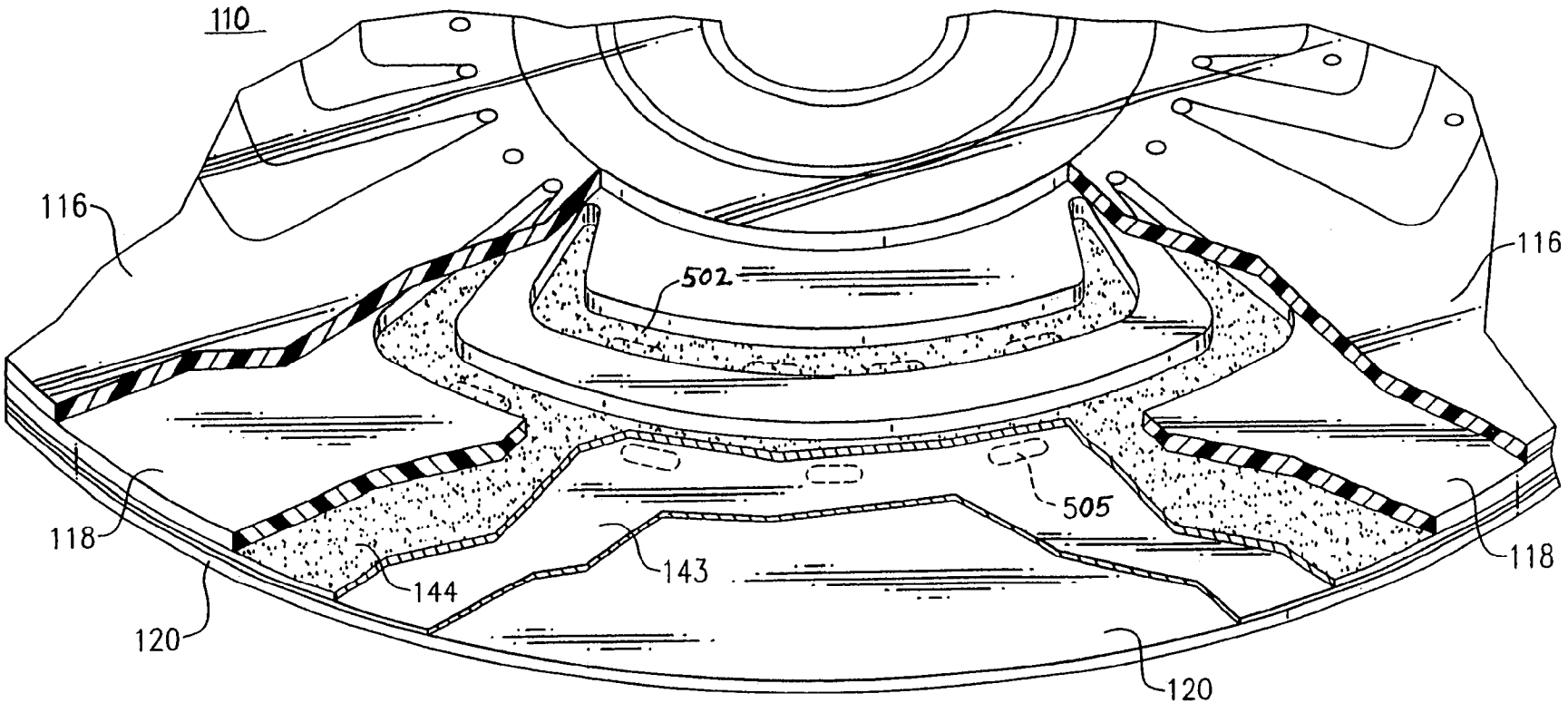
FIG. 33C is a perspective view of the disc illustrated in FIG. 33A with cut-away sections showing the different layers of this embodiment of the e-rad transmissive bio-disc.

FIG. 33C is a perspective view of the disc illustrated in FIG. 33A with cut-away sections showing the different layers of this embodiment of the e-rad transmissive bio-disc. This view is similar to the transmissive disc 110 shown in FIG. 9. The e-rad implementation of the transmissive bio-disc 110 shown in FIG. 31C similarly includes the thin semi-reflective layer 143 and the active layer 144 as applied over the thin semi-reflective layer 143.

Figure 34:
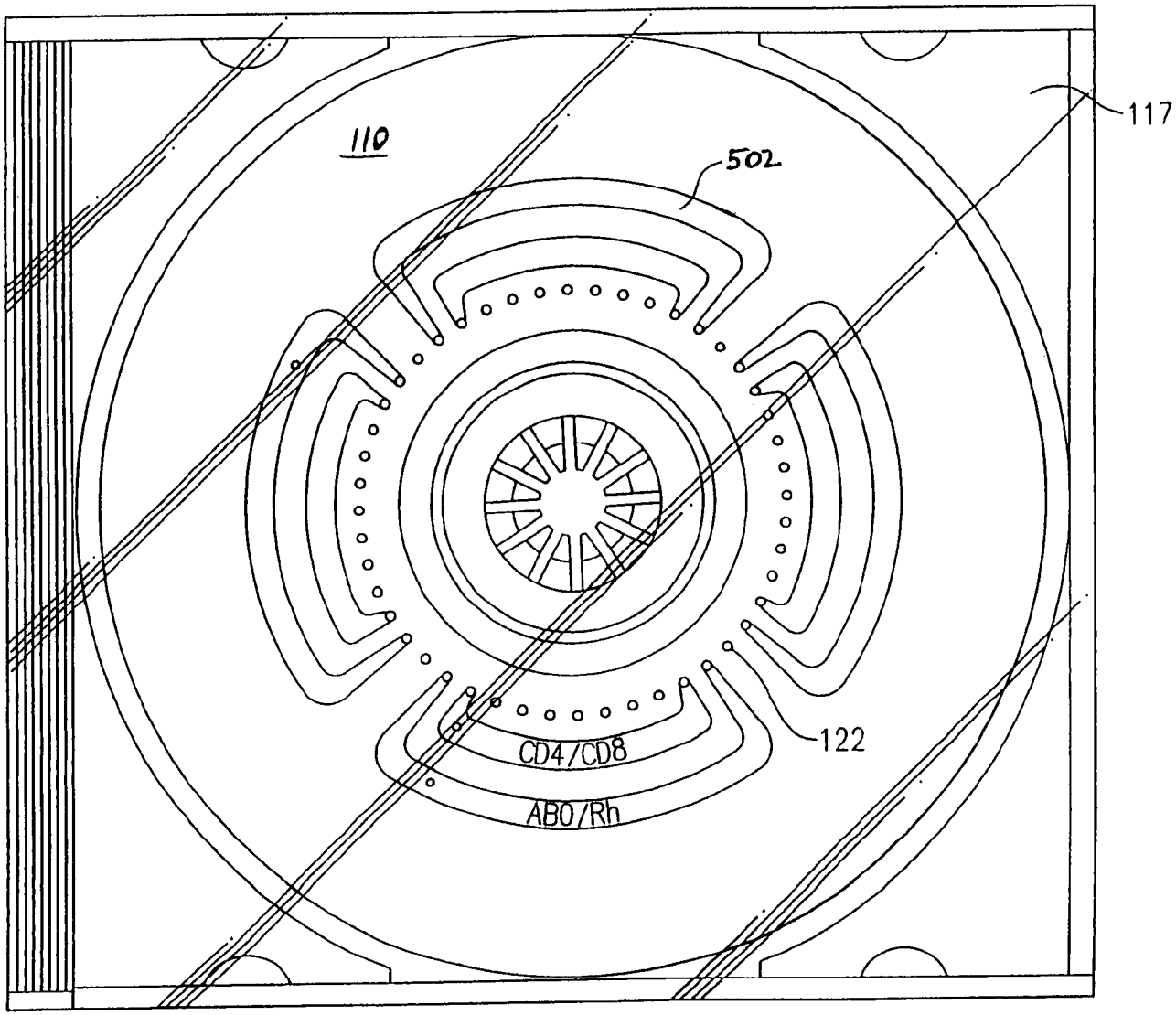
FIGS. 34 and 35 are each a top plan view of a respective additional embodiment of the bio-disc of the invention each shown in a bio-safe jewel case.

FIG. 34 shows a top plan view of an embodiment of eRad disc with a transparent cap portion, which disc has two tiers of circumferential fluid channels with two different assays, namely CD4/CD8 chemistry and ABO/RH chemistry. The disc 110 is illustrated in a bio-safe jewel case 117.

Figure 35:
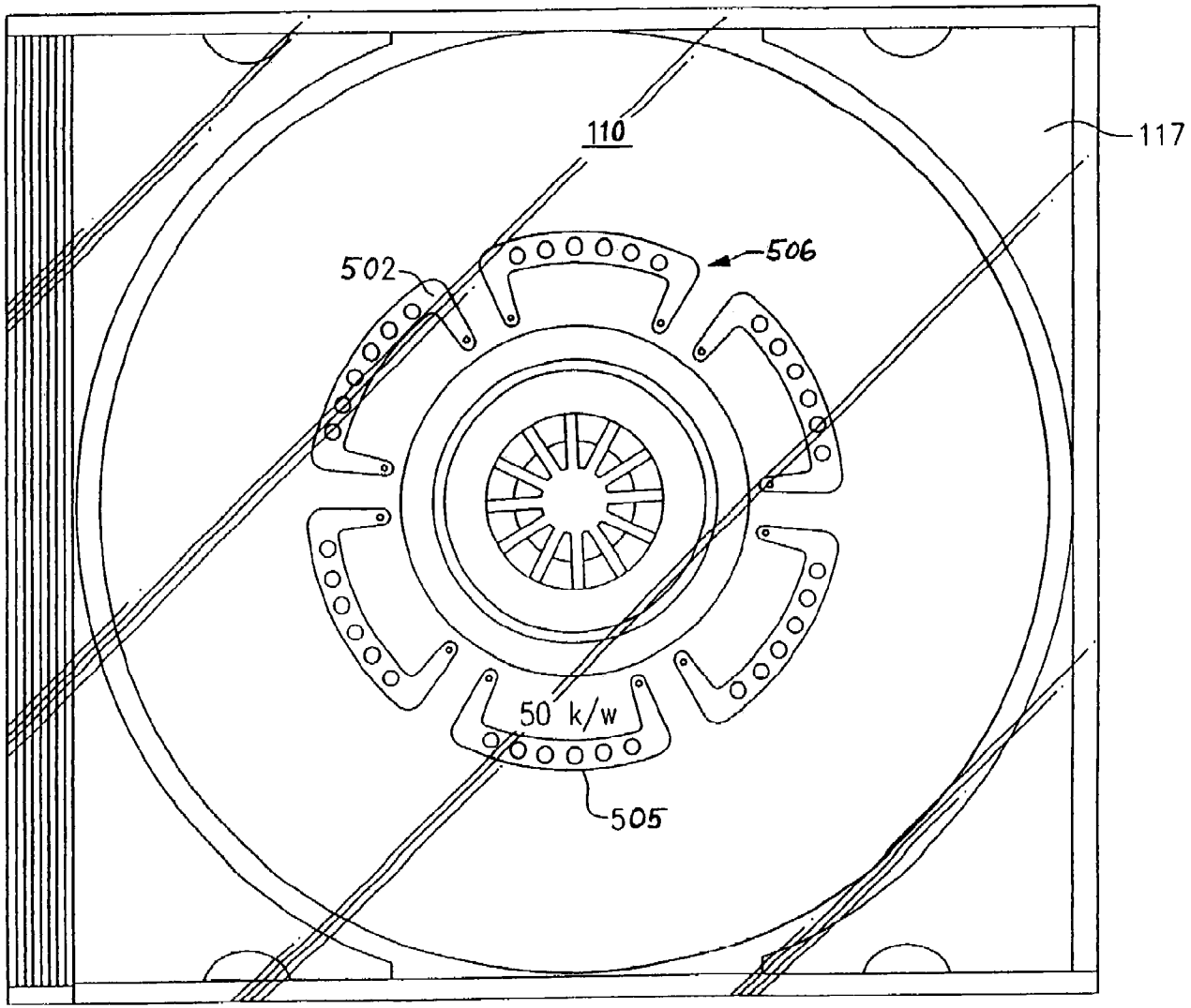

FIG. 35 shows a top plan view of an embodiment of CD4/CD8 eRad disc with a transparent cap portion, which disc has six circumferential fluid channels or Erad channels arranged at substantially the same radial coordinate and including three concentrations of cultured cells. The disc 110 of FIG. 35 is also illustrated in the bio-safe jewel case 117.

According to the invention, the interrogation means are adapted to interrogate the investigational features within the disc analysis zone according to a varying angular coordinate, and preferably circumferentially or spirally.

Preferably, the arrangement of the disc and of the system is such that rotation of the disc itself distributes investigational features in a substantially consistent distribution along the chamber.

More preferably, rotation of the disc distributes the concentration of investigational features in a substantially even distribution along the analysis chamber.

The invention also provides an analysis method using a bio-disc and an optical disc drive system as described so far, which method provides an interrogation step of the disc investigational features such that when an incident beam of electromagnetic energy tracks along disc information tracks, any investigational features within the analysis zone are thereby interrogated according to a varying angular coordinate, and in particular according to a circumferential or spiral path.

Fluidic Circuits and Methods for Sample Preparation

In many medical diagnostic applications, it is helpful to centrifuge fluid samples in order to separate out one or more components contained therein, and then move or isolate each component into a separate chamber. For instance, it is frequently helpful to centrifuge out the blood cells from whole blood, and then isolate the serum into a separate chamber for analysis. It is advantageous that this separation and movement of liquid be performed within a fluidic circuit. In a fluidic circuit located in the bio-disc, centrifugal and capillary forces may be utilized in order to move fluids within the fluidic circuit. Certain assays may require mixing two or more reagents (often after previous centrifuging steps), which may advantageously be carried out on the bio-disc without external intervention.

One way of controlling fluid flow within fluidic circuits is the use of capillary valves, in which liquid stops at a certain narrowing or change in surface tension of a fluidic passage, and only centrifugation above a certain speed induces the liquid to cross this barrier. Described below are embodiments of an improved sample separation, isolation, and analysis apparatus or system and a method suitable for disc based diagnostic systems.

The various motive forces that may drive a liquid through a restricted channel or passage include, for example, centrifugal forces and capillary action. Systems and methods are desired for use of these forces in such a way that [1] liquid can be loaded or introduced through an entry or inlet port into a loading, mixing, or separation chamber, [2] the disc may be centrifuged in order to separate out unwanted particles, and [3] on cessation of centrifugation the liquid may be moved or isolated into a new chamber. FIGS. 36 and 39 each include multiple fluidic circuits, where certain of the fluidic circuits illustrate the location of materials with the fluidic circuits at different steps in the sample preparation process and are denoted by [1], [2], or [3], which correspond to the above-listed sample preparation steps. In a typical symmetric fluidic circuit, on cessation of centrifugation the liquid will either remain still (State [2]), or move into the original configuration (State [1]), rather than moving into another or an adjacent channel (State [3]). Improved systems and methods which ensure that something changes during states [1] and/or [2] so that when centrifugation is stopped, State [3] is the most stable state, are described in detail below.

Rotationally Controlled Liquid Valve

For a liquid to enter a channel by capillary forces, not only must the hydrophilicity of the channel be sufficiently high, but also the air displaced by the liquid motion must be able to escape. If a channel is sealed or closed, capillary forces will draw liquid into the channel only until the air pressure in the channel rises to give an equal and opposite force.

Figure 36A:
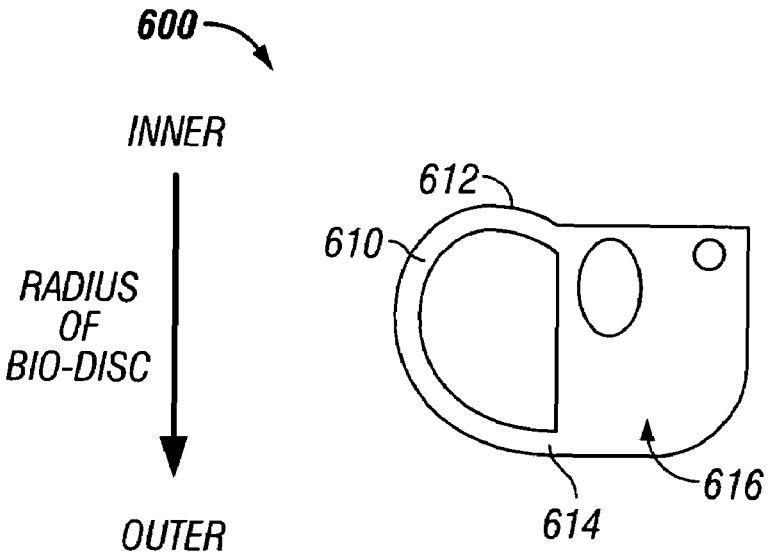
Figure 36B:
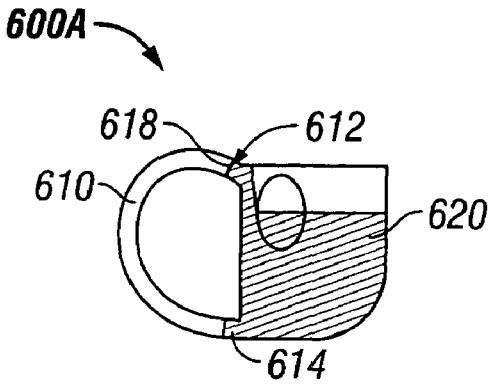
Figure 36C:
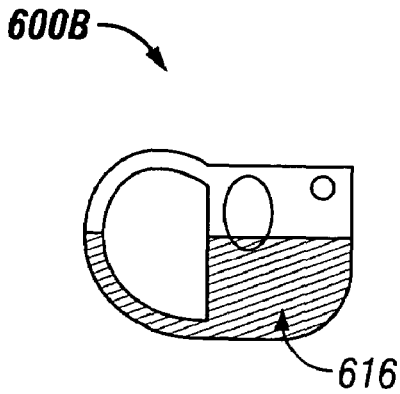
Figure 36D:
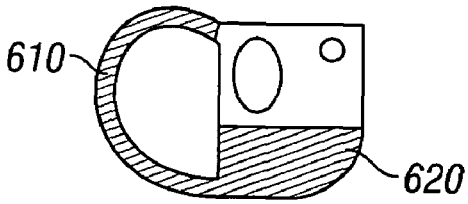

FIGS. 36A, 36B, 36C, and 36D are each a top view of a fluidic circuit configured to be placed on a bio-disc, such as the bio-discs described with respect to the earlier figures, wherein FIGS. 36B, 36C, and 36D are illustrative of steps in an assay process. In the embodiment of FIGS. 36A, 36B, 36C, and 36D, a return channel 610 is configured as a loop with a fluid exit portion 612 and a fluid entrance portion 614. The fluid exit portion 612 is at an inner radius of a rotatable substrate (not shown), while the entrance portion 614 is closer to the outer radius of the rotatable substrate. The fluidic circuits 600A (FIG. 36B), 600B (FIG. 36C), and 600C (FIG. 36D) each illustrate the position of materials within the fluidic circuit at various stages_of separation of a component, such as serum, from a sample, such as whole blood. As illustrated in FIG. 36B, in state [1] (fluidic circuit 600A), a liquid 620 is introduced into the loading chamber 616 and is drawn into the exit portion 612 of the loop. However, the liquid 620 is prevented from entering the return channel 610 by a stopper 618, such as a capillary valve, a change in surface tension, a filter, or a hydrophobic coating, for example. The liquid 620 also flows into the entrance portion 614 of the return channel 610, but cannot completely enter the return channel 610 due to pressure build up, or "air-lock," in the return channel 610 created by the blockage of the fluid at the exit portion 612.

When the optical bio-disc, including the fluidic circuit 600, is rotated, centrifugal forces cause the liquid 620 in the exit portion 612 of the return channel 610 to flow out of the exit portion 612, thereby unblocking the exit portion 612 and reducing or eliminating the air lock. When the air lock is reduced, the liquid 620 in the loading chamber 616 enters the return channel 610 through the entrance portion 614. As illustrated in FIG. 36C, which represents the state of the fluidic circuit 600 during centrifugation and is referred to as state [2]. In state [2], the liquid 620 fills the return channel 610 to a level that depends upon the strength of the centrifugal force and the amount of liquid 620 in the loading chamber 616. As illustrated in fluidic circuit FIG. 36D, which represents the state of the fluidic circuit 600 after centrifugation and is referred to as state [3]. In state [3], capillary forces draw the liquid 620 through the return channel 610, thus filling the return channel 610 with the liquid 620.

Figure 37:
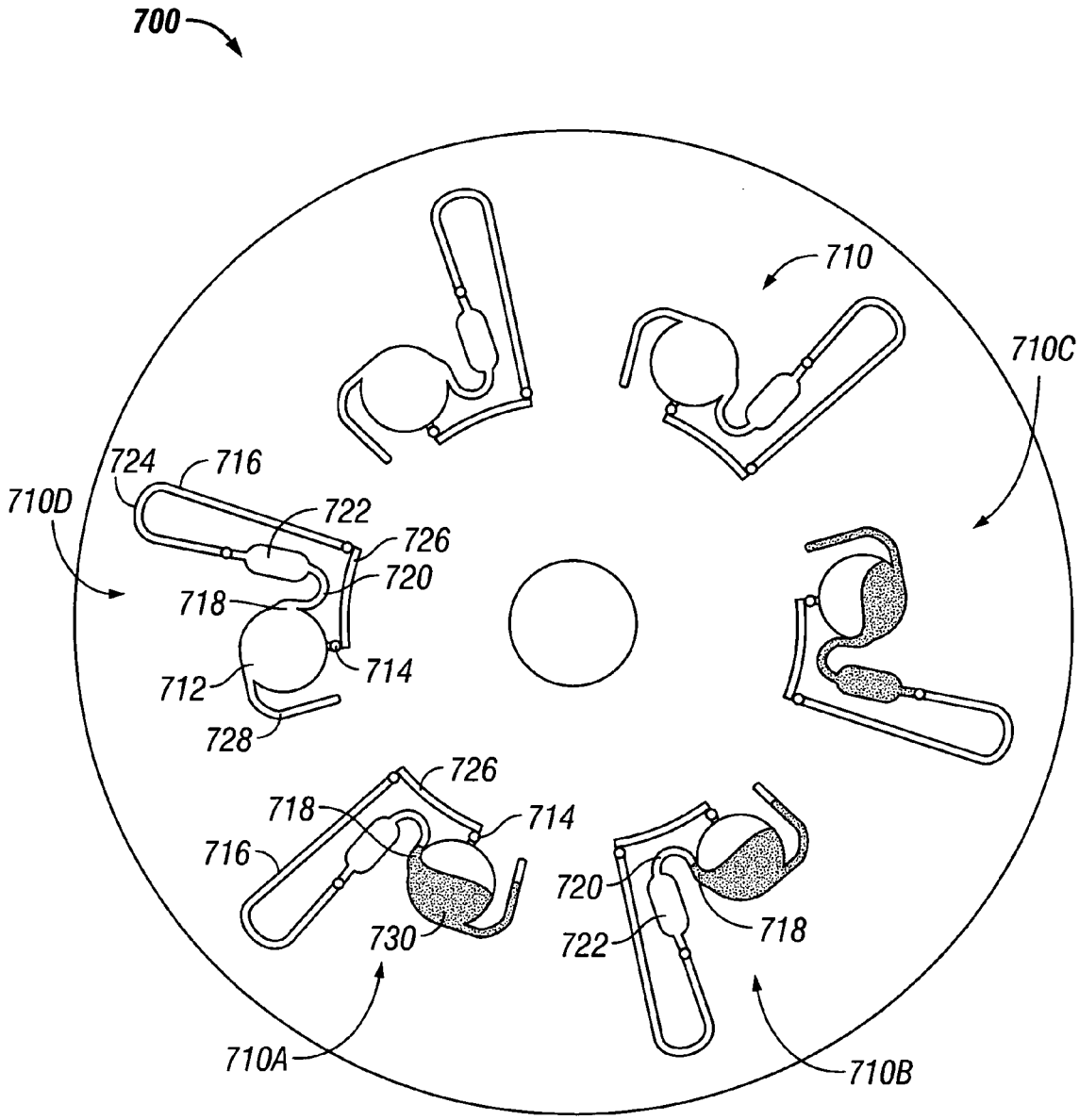
FIG. 37 is a top plan view of a bio-disc having fluidic circuits with a liquid valve for separating samples, wherein certain of the fluidic circuits illustrate movement of material in the fluidic circuit during an assay process.

FIG. 37 is a top plan view of a bio-disc having fluidic circuits 710 configured to separate samples, wherein the fluidic circuits 710A, 710B, and 710C are in respective of the three states [1], [2], and [3], as described above. The exemplary fluidic circuits 710 include a loading chamber 712, an inlet port 714 configured to receive sample that is to be loaded into the loading chamber 712. The fluidic circuits 710 further include a return channel 716 that is in fluid communication with the loading chamber 712. In the embodiment of FIG. 37, the return channel 716 includes an entrance portion 718 that is in fluid communication with the loading chamber 712, an elbow section 720 that is in fluid communication with the entrance portion 718. In the embodiment of FIG. 37, the elbow section 720 opens into an analysis chamber 722 that is in fluid communication with a U-section 724, where the U-section is connected to an exit portion 726 of the return channel 716. In this embodiment, the exit portion 726 is in fluid communication with the loading chamber 712 and is located closer to the center of the optical bio-disc 700 than the entrance portion 718.

In the embodiment of FIG. 37, the inlet port 714 is advantageously located proximal to the exit portion 726 of the return channel 716 so that when fluid is loaded through the inlet port 714, some of the fluid enters the exit portion of the return channel, which thereby creates a fluid or liquid valve that prevents the fluid in the loading chamber 712 from entering the elbow section 720 of the return channel 716. The fluidic circuit 710 may optionally include a vent chamber 728 that is in fluid communication with the loading chamber 712, as shown in fluidic circuit 710D, which allows venting of air out of the loading chamber 712 to allow loading of the sample into the loading chamber 712.

In one embodiment, the fluidic circuit 710 may advantageously be used to separate and isolate serum from a whole blood sample. As noted above, fluidic circuits 710A, B, and C illustrate exemplary fluidic circuits that are in respective of the three states [1], [2], and [3] of a sample preparation process. In particular, the fluidic circuit 710A (state [1]) is illustrated with a sample 730, such as blood, loaded through the inlet port 714 into the loading chamber 712 where a part of the sample 730 enters the exit portion 726 of the loop. An "air lock" is created when the sample 730 comes in contact with the entry portion 718 and a part of the sample 730 enters the entry portion 718 of the return channel 716 since the exit portion 726 is essentially blocked by a part of the sample 730. The air lock thus prevents the sample from entering into the rest of the return channel 716. The blockage in the exit portion 726 is removed by rotating the disc, which eliminates the air lock and the cells in the blood sample are separated by rotating the disc further, as shown in the fluidic circuit 710B (state [2]).

When the disc 700 is stopped, serum is drawn into the entrance portion 718, through the elbow section 720, and into the analysis chamber 722 of the return channel 716 by capillary forces, as shown in the fluidic circuit 710C (state [3]). In the configuration illustrated in FIG. 37, the serum may be stopped by a capillary valve in the return channel 716, giving time for a reaction in the analysis chamber 722. A subsequent rotation will draw the reaction products into the rest of the return channel 716 for detection or further reaction.

An alternative fluidic circuit and an associated method of achieving sample separation and isolation in conjunction with such a fluid circuit is to use a pneumatically driven sample separation and isolation fluidic circuit. An example of a pneumatically driven fluidic circuit is depicted in FIGS. 38A, 38B, 38C, and 38D, where a closed U-channel is used for the cell separation, and pressure built up during centrifugation leads the liquid to flow into a return channel (State [3]), along with normal surface tension forces. One motive force that may be utilized in this embodiment is a 'piston' of air ("High Pressure Air") compressed within an air chamber.

Figure 38A:
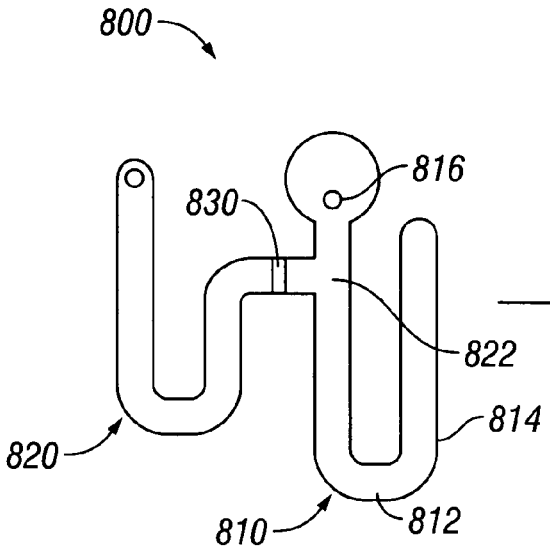
Figure 38B:
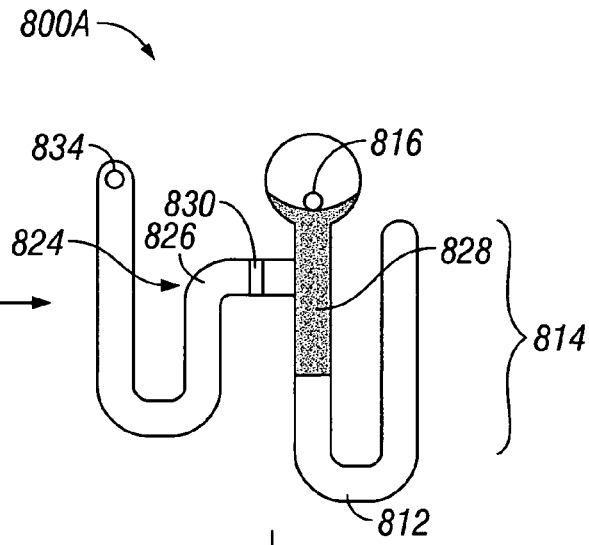
Figure 38D:
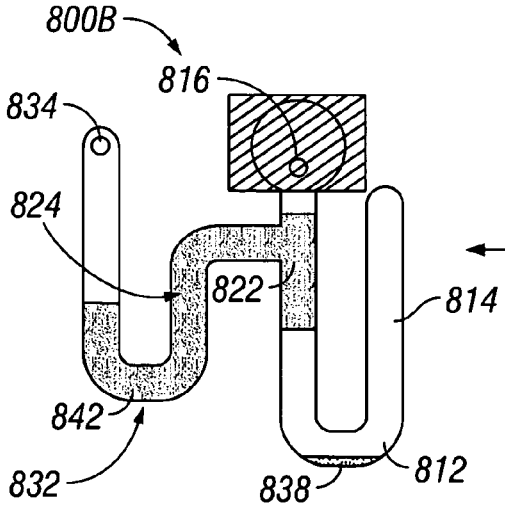
Figure 38C:
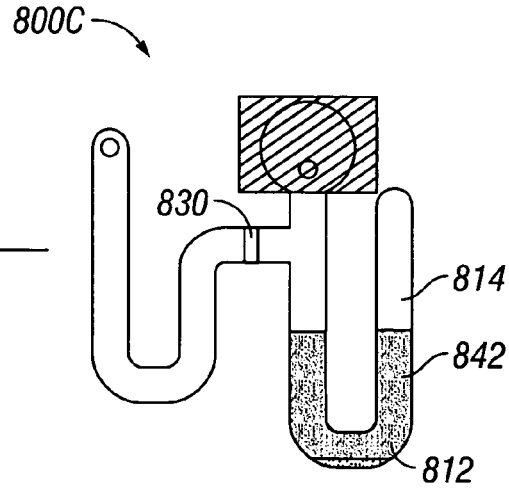

FIGS. 38A, 38B, 38C, and 38D are each a top view of a fluidic circuit configured to be placed on a bio-disc, such as the bio-discs described with respect to the earlier figures, wherein FIGS. 38B, 38C, and 38D are illustrative of steps in a pneumatically driven fluid separation system. Each of the fluidic circuits 800 includes two main channels, a first main channel 810 and a second main channel 820. The first main channel 810 includes a separation or loading chamber 812 in fluid communication with an air tight or sealed air chamber 814 and an inlet port 816 for loading samples into the loading chamber 812. The second main channel 820 is in fluid communication with the first main channel 810 through an entrance portion 822 connected to the separation chamber 812. In the embodiment of FIG. 38, the connection between the entrance portion 822 and the separation chamber 812 is situated in the separation chamber so that a sample 828 is prevented from entering the return channel 824 prior to separating unwanted elements in the sample 828. An elbow section 826 may be connected to and in fluid communication with the entrance portion 822 to further prevent flow of the sample 828 into the return channel 824 and allow any pre-separated sample 828 to flow back into the separation chamber 812 during sample preparation. A portion of the elbow section 826 may also be coated or filled with a hydrophobic barrier or a filter element 830 to also prevent portions of the sample 828 from prematurely entering the return channel 824. The return channel 824 may further include a U-segment 832 in fluid communication with the elbow section 826. In one embodiment, the U-segment 832 opens to a vent port 834 and may include an analysis area or section having reagents deposited therein. In one embodiment, the reagents allow for detection and or quantitation of analytes present in the isolated sample 828.

The fluidic circuits 800A (FIG. 38B), 800B (FIG. 38C), and 800C (FIG. 38D) illustrate three stages of separation of components of a material, such as serum, from a sample, such as whole blood using the fluidic circuit 800. As illustrated in FIG. 38B, in state [1] (fluidic circuit 800A), a whole blood sample 828 may be loaded into the separation chamber 812 through the inlet port 816. The sample 828 may then flow into the separation chamber 812 and is prevented from entering the elbow section 826 by the hydrophobic barrier 830. As illustrated in FIG. 38C, in state [2] (fluidic circuit 800B), the inlet port 816 may then be sealed and the disc rotated at a pre-determined speed and time to allow separation of serum 842 from the cells 838 in the blood sample 828. During rotation, a portion of the serum 842 enters the air chamber 814, thus compressing the air inside the air chamber 814 and creating pressurized air within the air chamber 814. FIG. 38D illustrates fluidic circuit 800C in state [3], where rotation of the disc is stopped. In this state, the pressurized air in the air chamber 814 causes the serum 842 in the separation chamber 812 to move into the entrance portion 822 of the return channel 824 through the filter or hydrophobic barrier 830 and into the U-segment 832 of the return channel 824. Since the inlet port 816 is sealed and the vent port 834 remains open, most of the serum 842 is directed into the return channel 824.

Figure 39A:
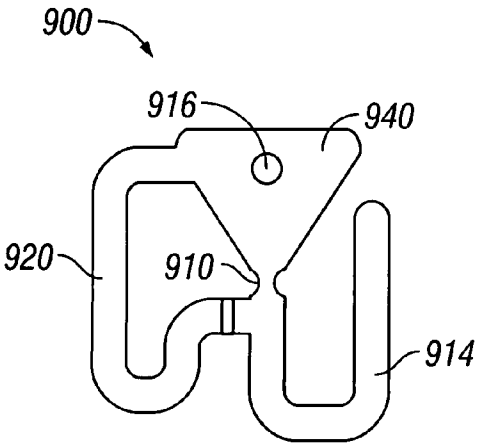
Figure 39B:
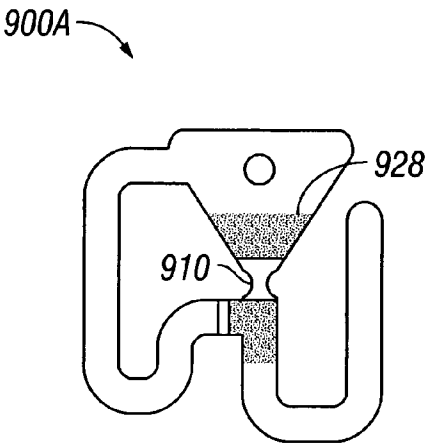
Figure 39C:
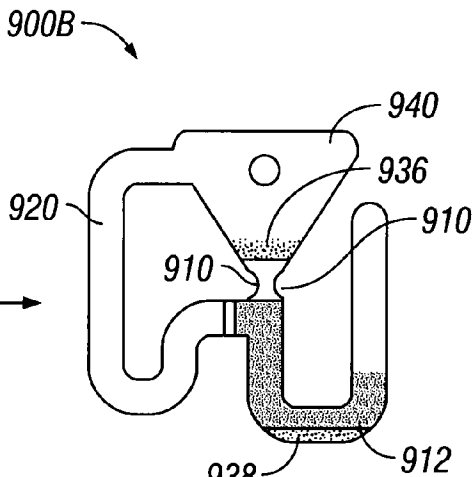
Figure 39D:
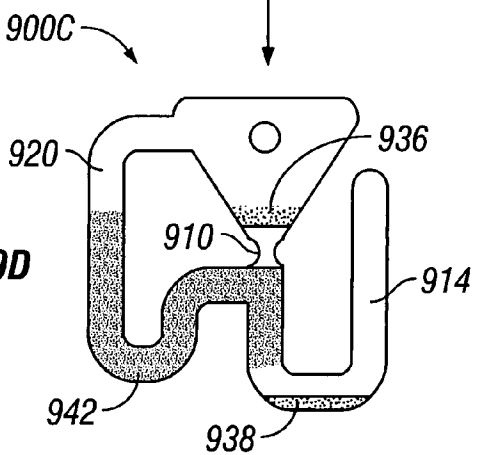

FIGS. 39A, 39B, 39C, and 39D are each a top view of a fluidic circuit configured to be placed on a bio-disc, such as the bio-discs described with respect to the earlier figures. In this embodiment of FIGS. 39A, 39B, 39C, and 39C, the fluidic circuit 900 is configured such that a single port is used as an inlet and vent port 916. The fluidic circuit 900 includes many components of the circuit described in conjunction with FIG. 38 and further includes a sample separation portion 910 that may be a narrow channel configured to trap large particles from the sample, such as cells, and allow the liquid part of the sample (e.g., serum) to pass through. In the embodiment of FIGS. 39A, 39B, 39C, and 39D, fluidic circuit 900 includes an inlet and vent port 916, an air chamber 914, and a return channel 920. Fluidic circuits 900A (FIG. 39B), B (FIG. 39C), and C (FIG. 39D) illustrate three stages of separation of components of a sample, such as serum, from a sample, such as whole blood. In particular, as shown in FIG. 39B, fluidic circuit 900A is in state [1]. In this state, portions of the sample 928 may pass through the sample separation portion 910, which may include a filter or sieve. In one embodiment, the sample separation portion 910 prevents cells from passing through while allowing the serum to move past the sample separation portion 910. FIG. 39C illustrates fluidic circuit 900B in state [2], where centrifugation has begun. As illustrated in FIG. 39C, cells 938 accumulate, or pellet, at or around the separation portion 910, while plasma moves through the sample separation portion 910. In this embodiment cells 938 that do get through the sample separation portion 910 accumulate, or pellet, in the separation chamber 912. The cells 938 that pellet in or around the separation portion 912 essentially block back flow of fluid into the loading chamber 940. FIG. 39D illustrates fluidic circuit 900C in state [3] where centrifugation has stopped. As illustrated in FIG. 39D, a serum 942 is pneumatically directed into the return channel 920 by the high pressure air in the air chamber 914. Fluid does not enter the loading chamber 940 due to the blockage caused by the pellet of cells 936. As discussed above, the return channel 920 may be pre-loaded with reagents to allow detection and quantitation of analytes in the isolated sample.

The return channels described above and in conjunction with FIGS. 36A, 36B, 36D, 37, 38A, 38B, 38C, 38D, 39A, 39B, 39C, and 39D may be connected to and in fluid communication with one or more analysis chambers where aliquots of the isolated sample may be redirected or transferred to and analyzed for different targets or analytes. For example, a single sample of whole blood may be processed as described above. The isolated serum may then be directed into one or more analysis chambers from the return channel. In one embodiment, three analysis chambers, including a first analysis chamber having reagents for reverse typing, a second analysis chamber having reagents for glucose quantitation, and a third analysis chamber having reagents for cholesterol analysis are included in a fluidic circuit. This set-up thus allows the analysis of three different analytes from a single sample. As will be apparent to one of skill in the art, multiple analytes may be detected and analyzed using the above-described systems and methods. Further details relating to blood typing using optical bio-discs are disclosed in, for example, the above referenced U.S. patent application Ser. No. 10/298,263 entitled "Methods and Apparatus for Blood Typing with Optical Bio-Discs".

Figure 40:
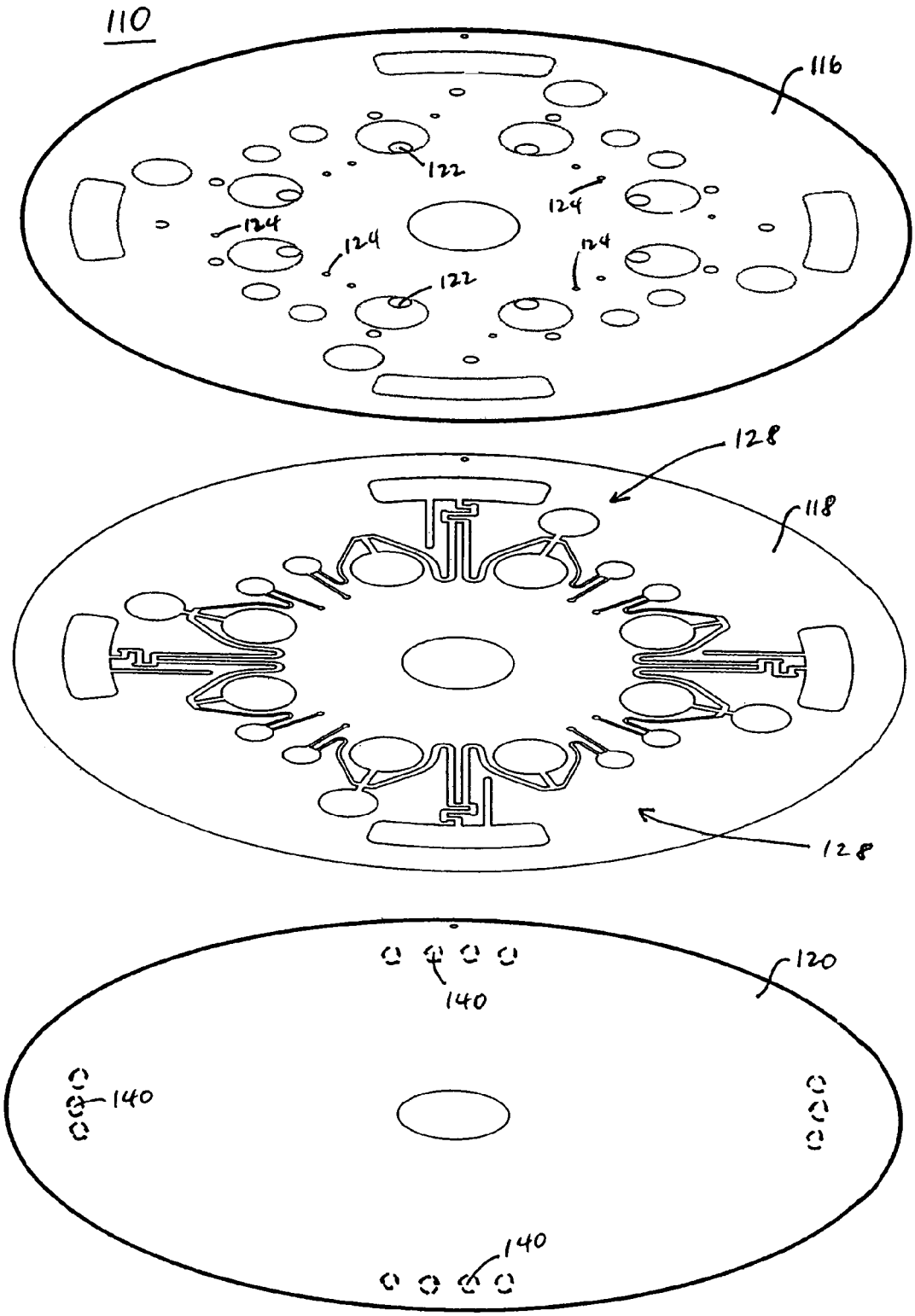
FIG. 40 is an exploded perspective view of yet another embodiment of the bio-disc having a fluidic circuit for processing samples.

Referring now to FIG. 40, there is shown an exploded perspective view of certain structural elements of the optical bio-disc 110 having fluidic circuits 128 for sample preparation and analysis. The structural elements illustrated in FIG. 40 include the cap portion 116, the adhesive or channel member 118, and the substrate 120 layer. The exemplary cap portion 116 includes one or more inlet ports 122 and one or more vent ports 124. The cap portion 116 may optionally include portions of the fluidic circuits formed therein.

The exemplary adhesive or channel layer 118 includes fluidic circuits 128 formed therein. The fluidic circuits 128 are formed by stamping or cutting the membrane to remove a portion thereof and form the shapes as illustrated. The fluidic circuits 128 may include any of the fluidic circuits described above, for example, including those exemplary fluidic circuits described in FIGS. 36-39.

The exemplary substrate 120 may include target or capture zones 140. In one embodiment, the substrate 120 is made of polycarbonate and has a thin semi-reflective layer 143 (Not shown) deposited on the top thereof, which is illustrated and described above in conjunction with FIG. 6. In one embodiment, the semi-reflective layer 143 associated with the substrate 120 of the disc 110 is significantly thinner than the reflective layer 142 on the substrate 120 of the reflective disc 110 illustrated in FIGS. 2, 3 and 4. As discussed above, the thinner semi-reflective layer 143 allows for some transmission of the interrogation beam 152 through the structural layers of the transmissive disc, as shown in FIGS. 6 and 12, for example. The thin semi-reflective layer 143 may be formed from a metal such as aluminum or gold.

Figure 41:
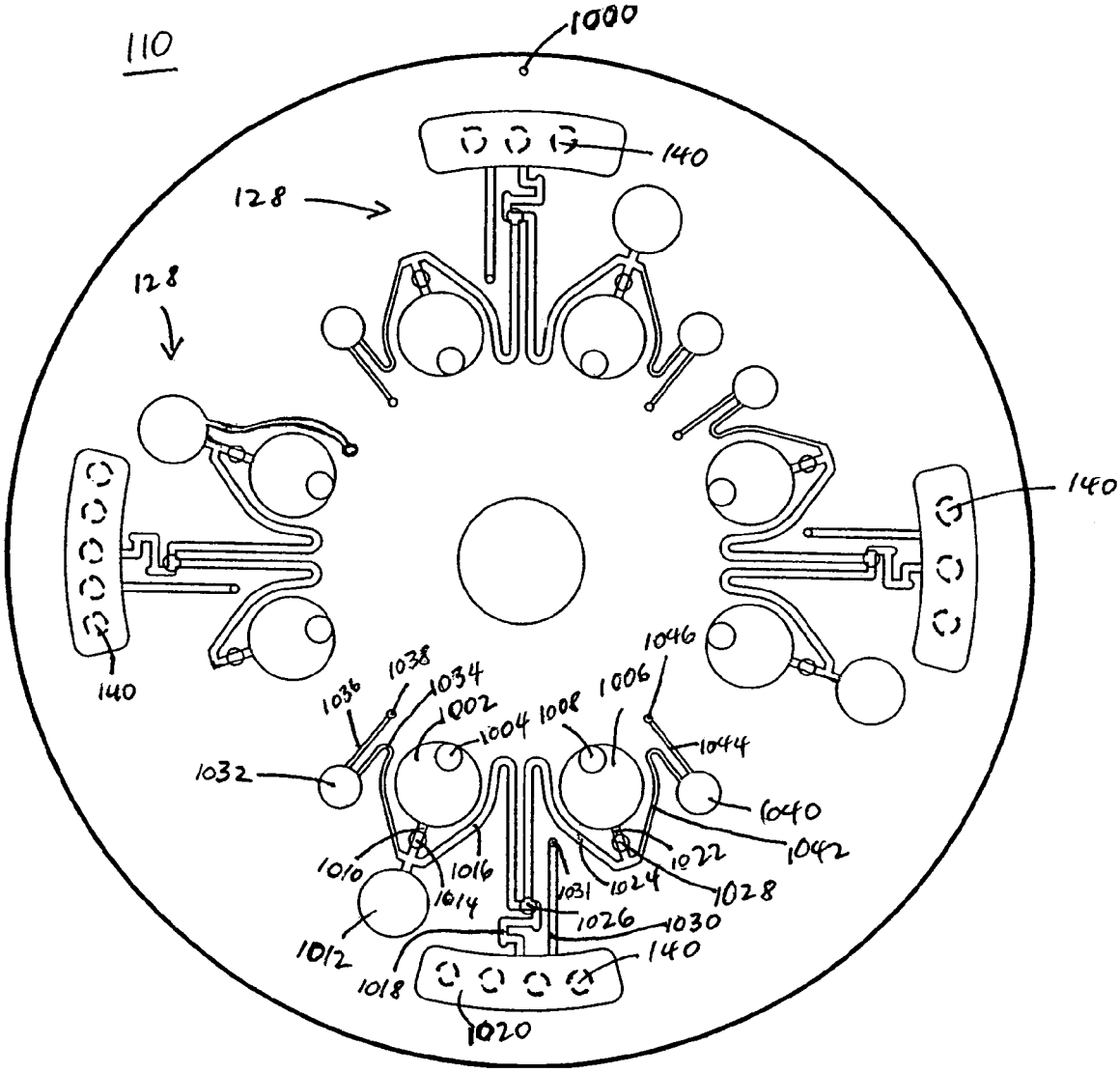
FIG. 41 is a top plan view of the disc of FIG. 40 showing various embodiments of the fluidic circuit.

With reference next to FIG. 41, there is shown a top plan view of the transmissive type optical bio-disc 110 illustrated in FIG. 40. FIG. 41 depicts the transmissive type optical disc having the transparent cap portion 116 revealing different embodiments of the fluidic circuits or channels 128, an alignment hole 1000, and the target zones 140 as situated within the disc. In one embodiment, the alignment hole 1000 is used as a guide to place the various layers of the disc 110 in register with each other to form the fluidic circuit 128. Each of the fluidic circuits 128 may include a sample loading chamber 1002 having a sample inlet port 1004 opening. The circuit 128 also includes a buffer loading chamber 1006 having a buffer inlet port 1008 opening. The sample loading chamber 1002 is in fluid communication with a first end of a radially directed sample pass through channel 1010. The second end of the sample pass through channel 1010, located furthest from the center of the disc relative to the first end, is in fluid communication with a sample separation chamber 1012. The sample pass through channel 1010 may optionally include a first capillary valve 1014. Chamber 1012 is also in fluid communication with a first end of a sample flow channel 1016 which terminates into and is in fluid communication with a first end of a mixing chamber 1018. The second end of the mixing chamber 1018 is in fluid communication with an analysis chamber 1020 which may include one or more analysis, capture, or target zones 140.

In the exemplary embodiment of FIG. 41, the buffer loading chamber 1006 is connected to and in fluid communication with a first end of a buffer pass through channel 1022. The second end of channel 1022 is in fluid communication with a first end of a buffer flow channel 1024 which is also in fluid communication with the first end of the mixing channel 1018 at its second end. A second capillary valve 1026 may optionally be placed at the junction of the sample flow channel 1016, buffer flow channel 1024, and mixing channel 1018 as illustrated. A third capillary valve 1028 may optionally be placed in the buffer pass through channel 1022. Analysis chamber 1020 also includes a vent channel 1030 which opens into a vent port 124 that allows air from the analysis chamber to vent out to prevent air blockages within the fluidic circuit 128. Mixing channel 1018 may be configured as a zigzag or sawtooth channel or stepwise channel with sharp angled edges, corners or turns as opposed to smooth non-angled channels wherein fluid flow is continuous with little or no turbulence. In an advantageous embodiment, the mixing channels having angled edges enhances mixing of fluids in a fluidic circuit by creating turbulent flow. The path of mixing channel 1018 is defined, for example, by a step function or a sawtooth function depending on the angle of the corners. The angle of the corners may be 5 to 160 degrees, for example. As illustrated, fluid flow in the mixing channel is defined by a step function wherein the turns within the mixing channel are at about 90 degree angles.

Alternatively, the fluidic circuit 128, as illustrated in FIG. 41 may include waste chambers to hold excess sample and/or excess buffer. In an alternative embodiment, a fluidic circuit includes a sample waste chamber 1032 that is connected to the sample pass through chamber 1010 through a sample water channel 1032. Waste chamber 1032 also includes its own vent channel 1036 with a vent port 1038. In another alternate embodiment, the fluidic circuit 128 may include a buffer waste chamber 1040 connected to the buffer pass through channel 1022 at the junction of channel 1022 and the buffer flow channel 1024 by a buffer waste channel 1042. Waste chamber 1040 may also include a vent channel 1044 with a vent port opening 1046 to allow venting out of air in chamber 1040 to prevent air blockage in channel 1042 and chamber 1040.

The fluidic circuit illustrated and described in conjunction with FIGS. 40 and 41 may be used in assays requiring serum sample from a whole blood sample including, but not limited to reverse blood typing, glucose, cholesterol, LDH, myoglobin, triglycerides, GSH, TSH, HCG assays and various tumor marker assays.

To analyze blood serum for a specific analyte, for example, whole blood is loaded into the sample loading chamber 1002 through inlet port 1004. The blood is prevented from flowing into the rest of the fluidic circuit by the first capillary valve 1014. A dilution buffer may be loaded into the buffer loading chamber 1006 through inlet port 1008. The amount of buffer loaded into chamber 1006 depend upon the dilution factor required for the assay. Buffer is prevented from moving into the rest of the fluidic circuit by the third capillary valve 1028. After the sample and buffer are loaded, their respective inlet ports are sealed to prevent leaking of fluid out of the fluidic circuit. The disc is then loaded into the optical disc drive and rotated at a predetermined speed and time to allow movement of the blood from the loading chamber, through valve 1014 and into the separation chamber 1012. Consequently the buffer is also forced through valve 1028 thereby eliminating the capillary valve and allowing free movement of buffer through the circuit 128. The disc is further rotated to separate the serum from the blood cells. Once this is achieved, rotation is halted for a predetermined time to prime sample flow channel 1016 and buffer flow channel 1024 by allowing movement of buffer into flow channel 1024 and the separated serum to move from the separation chamber 1012 into flow channel 1016. An analysis software program may then be used to control the speed, acceleration, deceleration, ramping, and duration of the disc rotation. The buffer and serum are prevented from entering the mixing channel 1018 by valve 1026. Excess serum and buffer, if any, moves into their respective waste chambers 1032 and 1040 through their respective waste channels 1034 and 1042. After priming flow channels 1016 and 1024, the disc is rotated at another predetermined speed and for a predetermined time to allow fluid to move past valve 626 and into mixing chamber 618. The serum and buffer are mixed as they move through mixing chamber 618 thereby diluting the serum sample. The diluted serum sample moves into the analysis chamber 620 where it is tested for analytes of interest.

As discussed above, the analysis chamber may include analysis zones 140 having capture agents that bind analytes of interest present in the sample. Signal or reporter agents may also be preloaded into the analysis chamber 1020 that allows for the detection and quantitation of the analyte captured within the analysis zones 140. Reporter agents may include, for example, microspheres or nanospheres coated with a signal molecule such as a binding agent that specifically bind to the analyte of interest. Detection is carried out using the optical disc drive by directing and scanning the optical read beam 152 (FIG. 10) through the analysis zones and analyzing the return beam 154 or transmitted beam 156 (FIG. 10) to determine the presence and amount of signal agents present in the analysis zones. Analysis and quantitation of analytes may be carried out using an analysis software. Analysis of samples using capture agents and signal agents are disclosed in, for example, the above referenced, commonly assigned and co-pending U.S. patent applications Ser. No. 10/348,049 entitled "Multi-Purpose Optical Analysis Disc for Conducting Assays and Related Methods for Attaching Capture Agents"; Ser. No. 10/035,836 entitled "Surface Assembly for Immobilizing DNA Capture Probes and Bead-Based Assay Including Optical Bio-Discs and Methods Relating Thereto"; and Ser. No. 10/035,836 entitled "Surface Assembly for Immobilizing DNA Capture Probes and Bead-Based Assay Including Optical Bio-Discs and Methods Relating Thereto".

Alternatively, the entire analysis chamber may be used as the analysis zone. In this embodiment, the analysis chamber may be preloaded with analysis reagents that react with a specific analyte in the diluted serum sample to produce a detectable signal such as a color change or color development. The resulting color developed in the process is preferably proportional to the amount of analyte in the sample. The analyte may then be quantified by scanning the read beam through the analysis chamber, detecting the return beam 154 or transmitted beam 156 (FIG. 10), and determining the amount of analyte based on the intensity of the return or transmitted beam. One or more calibration reference points may be used to accurately quantify the analyte by analyzing a reagent blank analysis chamber or a chamber having a known quantity of analyte. Further details relating to colorimetric assays using optical bio-discs is disclosed in, for example, commonly assigned co-pending U.S. Provisional Application Ser. No. 60/483,342 entitled "Fluidic Circuits, Methods and Apparatus for Use of Whole Blood Samples in Colorimetric Assays" filed on Jun. 27, 2003 which is incorporated by reference in its entirety as if fully repeated herein.

The fluid separation systems described above and illustrated in FIGS. 36-39 may be used for any assay requiring a serum sample such as reverse blood typing, glucose, cholesterol, LDL, myoglobin, LDH, various tumor marker assays, and other immunohematologic and genetic assays. Furthermore, the fluid separation system may be used isolate proteins in a homogenized tissue sample, oil or a hydrophobic layer in emulsion in organic extraction, supernatant from a microparticle suspension, any process requiring separation of fluids.

Concluding Statements

All patents, provisional applications, patent applications, and other publications mentioned in this specification are incorporated herein in their entireties by reference.

While this invention has been described in detail with reference to a certain preferred embodiments, it should be appreciated that the present invention is not limited to those precise embodiments. Rather, in view of the present disclosure that describes the current best mode for practicing the invention, many modifications and variations would present themselves to those of skill in the art without departing from the scope and spirit of this invention. The scope of the invention is, therefore, indicated by the following claims rather than by the foregoing description. All changes, modifications, and variations coming within the meaning and range of equivalency of the claims are to be considered within their scope.

Furthermore, those skilled in the art will recognize, or be able to ascertain, using no more than routine experimentation, many equivalents to the specific embodiments of the invention described herein. Such equivalents are also intended to be encompassed by the following claims.

What is claimed is:

1. An optical disc for processing and analyzing a sample, comprising:

a substantially circular substrate;

a cap portion;

a channel layer positioned between said substrate and said cap portion, said channel layer comprising at least one fluidic circuit, said fluidic circuit comprising:

a mixing chamber configured to mix a portion of said sample with a fluid, said mixing chamber having a first end and a second end;

a first valve connected to said first end of said mixing chamber;

a sample circuit configured to pass said portion of said sample to said mixing chamber, said sample circuit comprising a sample flow channel with a first and second end, said first end positioned closer to the center of said optical disc than said second end and configured to introduce a volume of said portion of said sample into said sample flow channel, and said second end in fluid communication with said first valve, wherein said first valve is configured to prevent interaction of said portion of said sample with said fluid, and to prevent flow of said portion of said sample out of said sample flow channel through said second end and said first valve and into said mixing chamber until the optical disc is rotated at a predetermined speed which causes said portion of said sample to be forced through said first valve;

a fluid circuit configured to pass said fluid to said mixing chamber, said fluid circuit comprising a fluid flow channel with a first and second end, said first end positioned closer to the center of said optical disc than said second end and configured to introduce a volume of said fluid into said fluid flow channel, and said second end in fluid communication with said first valve, wherein said first valve is configured to prevent interaction of said portion of said sample with said fluid, and to prevent flow of said volume of said fluid out of said fluid flow channel through said second end and said first valve and into said mixing chamber until the optical disc is rotated at said predetermined speed;

an analysis chamber connected to said second end of said mixing chamber for analyzing the mixed sample, and wherein said sample circuit further comprises:

a sample loading chamber configured to receive and hold said fluid sample, said sample loading chamber comprising a sample inlet port for introducing the sample into the sample loading chamber;

a sample pass through channel having a first end and a second end, said first end of said sample pass through channel connected to said sample loading chamber and said second end of said sample pass through channel connected to said first end of said sample flow channel;

a second valve positioned within said sample pass through channel and configured to prevent said sample from flowing out of said sample pass through channel until said optical disc is rotated at a predetermined speed which causes said sample to be forced through said second valve;

a separation chamber having an inlet port connected to said second end of said sample pass through channel and to said first end of said sample flow channel, said separation chamber configured to separate said portion of the sample when the optical disc is rotated; and wherein said fluid circuit further comprises:

a fluid loading chamber configured to receive and hold a fluid, said fluid loading chamber comprising an inlet port for introducing the fluid into the sample loading chamber;

a fluid pass through channel having a first end and a second end, said first end of said fluid pass through channel connected to said fluid loading chamber and said second end of said fluid pass through channel connected to said first end of said fluid flow channel; and a third valve positioned within said fluid pass through channel and configured to prevent said fluid from flowing out of said fluid pass through channel until said optical disc is rotated at a predetermined speed which causes said fluid to be forced through said third valve.

2. The optical disc of claim 1 further comprising:

a vent channel having a first end and a second end, said first and of said vent channel in fluid communication with said analysis chamber; and a vent port connected to said second end of said vent channel.

3. The optical disc of claim 2, further comprising:

a sample waste channel having a first end and a second end, said first end of said sample waste channel connected to and in fluid communication with said sample pass through channel;

a sample waste chamber in fluid communication with said second end of said sample waste channel;

a sample waste vent channel in fluid communication with said sample waste chamber; and a sample vent port in fluid communication with said sample vent channel.

4. The optical disc of claim 3, further comprising:

a fluid waste channel having a first end and a second end, said first end of said fluid waste channel connected to and in fluid communication with said fluid pass through channel;

a fluid waste chamber in fluid communication with said second end of said fluid waste channel;

a fluid waste vent channel in fluid communication with said fluid waste chamber; and a fluid vent port in fluid communication with said buffer fluid waste vent channel.

5. The optical disc of claim 4 further comprising:

a sample waste vent channel in fluid communication with said separation chamber; and a sample vent port in fluid communication with said sample waste vent channel.

6. The optical disc of claim 1, wherein the analysis chamber comprises analysis zones having capture agents that bind with analytes of interest in the mixed sample.

7. The optical disc of claim 1 wherein the fluid comprises a buffer.

8. The optical disc of claim 1 wherein said first, second and third valves comprise capillary valves.

* * * * *